US008045874B2

(12) United States Patent
Yoshida et al.

(10) Patent No.: US 8,045,874 B2
(45) Date of Patent: Oct. 25, 2011

(54) IMAGE FORMING APPARATUS AND IMAGE DENSITY CONTROL METHOD

(75) Inventors: Akira Yoshida, Kawasaki (JP); Shin Hasegawa, Zama (JP); Hitoshi Ishibashi, Kamakura (JP); Yoshiaki Miyashita, Komae (JP); Kohta Fujimori, Yokohama (JP); Nobutaka Takeuchi, Yokohama (JP); Kayoko Tanaka, Machida (JP); Yushi Hirayama, Sagamihara (JP); Tetsuya Muto, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 344 days.

(21) Appl. No.: 12/367,736

(22) Filed: Feb. 9, 2009

(65) Prior Publication Data

US 2009/0202263 A1 Aug. 13, 2009

(30) Foreign Application Priority Data

Feb. 7, 2008 (JP) ..... 2008-028139
Mar. 10, 2008 (JP) ..... 2008-060009

(51) Int. Cl.
*G03G 15/00* (2006.01)
*G03G 15/06* (2006.01)

(52) U.S. Cl. ..... 399/49; 399/55; 399/72

(58) Field of Classification Search ..... 399/27, 399/29, 30, 44, 49, 55, 72
See application file for complete search history.

(56) References Cited

U.S. PATENT DOCUMENTS 4,910,557 A * 3/1990 Imai ..... 399/72 X
5,182,600 A 1/1993 Hasegawa et al.
5,198,861 A 3/1993 Hasegawa et al.
5,274,424 A * 12/1993 Hattori et al. ..... 399/49
5,327,196 A 7/1994 Kato et al.
5,387,965 A 2/1995 Hasegawa et al.
5,608,495 A * 3/1997 Kitakubo et al. ..... 399/72
5,630,195 A 5/1997 Sawayama et al.
5,694,223 A * 12/1997 Katori et al. ..... 399/49 X
5,761,570 A 6/1998 Sawayama et al.
5,822,079 A * 10/1998 Okuno et al. ..... 399/49 X
5,857,131 A 1/1999 Hasegawa
(Continued)

FOREIGN PATENT DOCUMENTS

JP 2004-354623 12/2004
(Continued)

*Primary Examiner* — Sandra Brase
(74) *Attorney, Agent, or Firm* — Oblon, Spivak, McClelland, Maier & Neustadt, L.L.P.

(57) ABSTRACT

An image forming apparatus includes a control device that calculates a developing ability of the developing device based on a detection value detected by an optical detection device from the plural toner patches. The control device adjusts an image formation condition based on the calculated developing ability. A factor detection device is provided to detect a contributing factor that causes the developing ability to largely change after the last adjustment of the image formation condition. The control device controls image formation such that when the factor detection device does not detect the contribution factor and a developing ability calculated this time is different from that calculated last time (as to a part of the plural toner patches), the plural toner patches are formed based on a prescribed fixed image formation condition so that an attraction amount of toner attracting to the plural toner patches enter a prescribed range detectable for the optical detection device. The remaining toner patches are formed (based on an image formation condition determined) in accordance with the image formation condition previously adjusted. When the detection device detects the contribution factor, the entire toner patches are formed based on the prescribed fixed condition.

19 Claims, 29 Drawing Sheets

U.S. PATENT DOCUMENTS

| | | | | |
|---|---|---|---|---|
| 5,860,038 | A | 1/1999 | Kato et al. | |
| 5,987,272 | A * | 11/1999 | Maeda et al. | 399/44 X |
| 6,055,386 | A | 4/2000 | Kato et al. | |
| 6,160,569 | A | 12/2000 | Fujimori et al. | |
| 6,496,677 | B2 | 12/2002 | Fujimori | |
| 6,501,917 | B1 * | 12/2002 | Karasawa | 399/49 X |
| 7,149,439 | B2 * | 12/2006 | Hirata et al. | 399/29 |
| 7,228,081 | B2 | 6/2007 | Hasegawa et al. | |
| 7,236,276 | B2 * | 6/2007 | Nakane et al. | 399/49 X |
| 7,251,420 | B2 | 7/2007 | Fujimori et al. | |
| 7,251,422 | B2 * | 7/2007 | Tokuyama et al. | 399/49 |
| 7,260,336 | B2 * | 8/2007 | Shimura et al. | 399/49 |
| 2004/0251435 | A1 | 12/2004 | Sawayama et al. | |
| 2008/0170220 | A1 | 7/2008 | Sawayama et al. | |

FOREIGN PATENT DOCUMENTS

| | | |
|---|---|---|
| JP | 2006-106222 | 4/2006 |
| JP | 2006-139180 | 6/2006 |

* cited by examiner

| CHANGE OF IMAGE AREA RATE FROM LAST TIME : z [%] | SHIFTING AMOUNT OF GRADATION SEQUENCE PATTERN [V] |
|---|---|
| 20≤z | −40 |
| 10≤z<20 | −20 |
| −10<z<10 | 0 |
| −20<z≤−10 | 20 |
| −20≥z | 40 |

FIG. 29

FORMULA 1-1:
MAXIMUM DEVELOPMENT POTENTIAL: PotMax = (DEVELOPMENT BIAS: Vb) − (POTENTIAL OF SOLID IMAGE SECTION AFTER EXPOSURE: Vl) [V]

FORMULA 1-2:
VPb (n) = PotMax × n / m + (POTENTIAL OF SOLID IMAGE SECTION AFTER EXPOSURE: Vl) [V]

FORMULA 1-3:
VPb (k) = VPb INITIAL VALUE (k)

FORMULA 1-4:
CHARGE BIAS: VPc (n) [V] = VPb (n) × (1 + 0.01 × BACKGROUND POTENTIAL COEFFICIENT) + BACKGROUND POTENTIAL OFFSET

FORMULA 1-5:
MAXIMUM DEVELOPMENT POTENTIAL = (TARGET TONER ATTRACTION AMOUNT [$mg/cm^2$]) / (DEVELOPMENT GAMMA ($\gamma$) [($mg/cm^2$) / kV]) + DEVELOPMENT START VOLTAGE: Vk)

FORMULA 1-6:
VPb (e) = VPb INITIAL VALUE (e) × (ENVIRONMENT CORRECTION COEFFICIENT)

FORMULA 1-7:
VPb (c) = VPb INITIAL VALUE (c) × (TIME LAPSE CORRECTION COEFFICIENT)

FIG. 30A

FIG. 30 | FIG. 30A | FIG. 30B

FORMULA 2-1:
$\Delta Vsp_reg.[n] = Vsp_reg.[n] - Voffset_reg$

FORMULA 2-2:
$\Delta Vsp_dif.[n] = Vsp_dif.[n] - Voffset_dif$

FORMULA 2-3:
$\alpha = \min(\Delta Vsp_reg[n] / Vsp_Dif.[n])$

FORMULA 2-4:
$\Delta Vsp_reg._dif.[n] = \Delta Vsp_dif.[n] \times \alpha$

FORMULA 2-5:
$\Delta Vsp_reg._reg.[n] = \Delta Vsp_reg.[n] - \Delta Vsp_reg._dif.[n]$ FORMULA 2-6:
$\beta[n] = \Delta Vsp_reg._reg / \Delta Vsg_reg._reg$ (= EXPOSURE RATE OF BACKGROUND OF TRANSFER BELT)

FORMULA 2-7:
$\Delta Vsp_dif' =$ [OUTPUT VOLTAGE OF DIFFUSION LIGHT] − [OUTPUT OF BELT BACKGROUND] × [NORMALIZATION VALUE OF POSITIVE REFLECTION COMPONENT] $= \Delta Vsp_dif(n) - \Delta Vsg_dif \times \beta(n)$

FORMULA 2-8:

$$\xi_1 \sum_{i=1}^{m} x[i]^2 + \xi_2 \sum_{i=1}^{m} x[i]^1 + \xi_3 \sum_{i=1}^{m} x[i]^0 = \sum_{i=0}^{m} y[i]x[i]^0 \cdots (1)$$

$$\xi_1 \sum_{i=1}^{m} x[i]^3 + \xi_2 \sum_{i=1}^{m} x[i]^2 + \xi_3 \sum_{i=1}^{m} x[i]^1 = \sum_{i=0}^{m} y[i]x[i]^1 \cdots (2)$$

$$\xi_1 \sum_{i=1}^{m} x[i]^4 + \xi_2 \sum_{i=1}^{m} x[i]^3 + \xi_3 \sum_{i=1}^{m} x[i]^2 = \sum_{i=0}^{m} y[i]x[i]^2 \cdots (3)$$

m: NUMBER OF DATA
x[i]: NORMALIZATION VALUE OF POSITIVE REFLECTION LIGHT − POSITIVE REFLECTION COMPONENT
y[i]: OUTPUT OF DIFFUSION LIGHT AFTER CORRECTION OF BACKGROUND CHANGE

FIG. 30B

FORMULA 2-9:

SENSITIVITY CORRECTION COEFFICIENT: $\eta = \dfrac{b}{\xi_1 a^2 + \xi_2 a + \xi_3}$

FORMULA 2-10:

OUTPUT OF DIFFUSION LIGHT AFTER SENSITIVITY CORRECTION: $\Delta Vsp_dif^{11}$ = [OUTPUT OF DIFFUSION LIGHT AFTER BACKGROUND CHANGE CORRECTION] × [SENSITIVITY CORRECTION COEFFICIENT : $\eta$ ] = $\Delta Vsp_dif^{1}$ (n) × $\eta$

FORMULA 2-11:

MAXIMUM DEVELOPMENT POTENTIAL: PotMax = (DEVELOPMENT BIAS: Vb) − (POTENTIAL OF SOLID IMAGE SECTION AFTER EXPOSURE: Vl) [V]

FORMULA 2-12:

VPn (K) = PotMax (K) × 2n / 12 − (POTENTIAL OF SOLID IMAGE SECTION AFTER EXPOSURE: Vl) [−V]

FORMULA 2-13:

VPn (m) = PotMAX (m) × {(m+3(n−1))} / 12 − (POTENTIAL OF SOLID IMAGE SECTION AFTER EXPOSURE: Vl) [−V]

FORMULA 2-14:

CHARGE BIAS: VPcn (COLOR) [V] = VPn (COLOR) [V] + BACKGROUND POTENTIAL OFFSET [V]

FORMULA 2-15:

VPn (m) = PotMAX (m) × {(m+3(n−1))} / 12 − (POTENTIAL OF SOLID IMAGE SECTION AFTER EXPOSURE: Vl) [−V] + CORRECTION VALUE

FIG. 31

TABLE 1

| | |
|---|---|
| CONDITION 1 | A COLOR WAS PRESENT, ONLY ONE POINT OF WHICH IS INCLUDED IN A VALID RANGE FOR CALCULATING A SENSITIVITY CORRECTION COEFFICIENT IN THE PREVIOUS PROCESS CONTROL. |
| CONDITION 2 | TWO DATA FOR CALCULATING DEVELOPMENT GAMMA ARE PRESENT IN THE PREVIOUS PROCESS CONTROL. |
| CONDITION 3 | TONER DENSITY ADJUSTMENT HAS BEEN EXECUTED EITHER IN THE PREVIOUS PROCESS CONTROL OR DURING THE TERM BETWEEN PREVIOUS AND CURRENT PROCESS CONTROLS. |
| CONDITION 4 | THE PREVIOUS PROCESS CONTROL RESULTS IN ERROR. |
| CONDITION 5 | DEVELOPER IN A DEVELOPING APPARATUS HAS BEEN REPLACED DURING THE TERM BETWEEN PREVIOUS AND CURRENT PROCESS CONTROLS. |
| CONDITION 6 | TONER END RECOVERY OPERATION HAS BEEN EXECUTED DURING THE TERM BETWEEN PREVIOUS AND CURRENT PROCESS CONTROLS. |
| CONDITION 7 | INITIAL TONER REPLENISHING MODE IS EXECUTED. |

FIG. 32

TABLE 2

| | |
|---|---|
| CONDITION 8 | AN AREA RATE AVERAGE OF AN OUTPUT IMAGE BEFORE EXECUTION OF CURRENT PROCESS CONTROL IS SIGNIFICANTLY DIFFERENT FROM THAT BEFORE THE LAST PROCESS CONTROL. |
| CONDITION 9 | ENVIRONMENT HAS BEEN SIGNIFICANTLY CHANGED AFTER THE LAST ADJUSTMENT. |
| CONDITION 10 | APPARATUS HAS NOT BEEN USED FOR A LONG TIME. |

IMAGE FORMING APPARATUS AND IMAGE DENSITY CONTROL METHOD

CROSS REFERENCE TO RELATED APPLICATIONS

This application claims priority under 35 USC §119 to Japanese Patent Application Nos. 2008-028139 and 2008-060009, filed on Feb. 7 and Mar. 10, 2008, respectively, and the entire contents of which are herein incorporated by reference.

BACKGROUND OF THE INVENTION

1. Field of the Invention

The present invention relates to an image forming apparatus and a method for controlling density of an image.

2. Discussion of the Background Art

In an image forming apparatus, such as a copier, a laser printer, etc., using an electrophotographic system, the following control is executed so as to always obtain constant density of an image. Specifically, a gradation sequence pattern including ten to seventeen toner patches for density detection use are formed based on a different image formation condition (i.e., a development potential) so as to attract a different amount of toner on a latent image carrier, such as a photoconductive member, etc. Based on a detection value of the toner patches obtained by an optical sensor, a toner attraction amount is calculated per toner patch using a prescribed algorithm. As a result, a linear equation formula ($y=ax+b$) is obtained from a relation between the toner attraction amount and the image formation condition of the respective toner patches. Then, development gamma representing a developing ability (i.e., an inclination "a" of a linear equation formula in a coordinate in which development potentials and toner attraction amounts are plotted on lateral and vertical axes, respectively), and a development start voltage Vk (an intercept "b") of the linear equation formula are obtained. Then, an image formation condition, such as a LD power, a charge bias, a development bias, etc., is adjusted to control a prescribed development potential attracting an appropriate amount of toner based on the development gamma and the development start voltage Vk.

The optical sensor detecting the toner patches includes a light emitting element such as an LED and a light-receiving element such as a phototransistor, and detects a reflection light from the light emission element by the light-receiving element. The optical sensor is generally sensitive in detecting a small amount of toner attraction toner, while not sensitive in detecting a large amount thereof owing to detection sensitivity of the light-receiving element. Specifically, the optical sensor includes a prescribed sensitive range capable of sensitively detecting a toner patch. Thus, in order to precisely obtain a development gamma and a development start voltage Vk, an amount of toner attracting to each of plural toner patches constituting a gradation sequence pattern needs to disperse at the same interval from small to large toner attraction sides to be sensitively detected by the optical sensor.

In the past, ten to seventeen toner patches each attracting a different amount of toner are formed based on differently fixed development biases, respectively, so that the development gamma and the development start voltage Vk can be precisely calculated regardless that the development gamma is either high or low. As a result, when the development gamma is high (sharp), the developing ability increases and an image is formed attracting a lot of toner even formed based on a low development bias. Further, an amount of toner attracting to a toner patch even formed based on a medium development bias sometimes deviates from a detectable range for the optical sensor. Thus, to disperse from small to large toner attraction amount sides at the same interval within the detectable range for the optical sensor, plural toner patches of a gradation sequence pattern need to be formed based on the low development bias when the development gamma is high. Whereas when the development gamma is low (dull), the developing ability decreases and an image attracting a lot of toner cannot be formed unless the development bias is high. When the development gamma is low and toner patches are formed based on a low development bias, even the highest toner attraction amount of the toner in the gradation sequence pattern becomes relatively low, so that the toner patches concentrate on the low toner attraction amount side as a whole. When concentrated on the low toner attraction amount side, the development gamma and the development start voltage Vk cannot precisely be calculated due to affection of unevenness of the toner attraction amount. Thus, in order to precisely calculate the development gamma and the development start voltage Vk when the development gamma is low, toner patches formed based on a high development bias are needed beside those formed based on a low development bias.

Thus, to precisely calculate the development gamma regardless of its level, plural toner patches formed based on high and low development biases are needed. As a result, a conventional gradation sequence pattern needs ten to seventeen toner patches. However, when a lot of toner patches are used, adjustment of image density takes a longer time period increasingly consuming toner.

Japanese Patent Application Laid Open No. 2006-106222 describes an image forming apparatus capable of controlling density of an image. Specifically, a development gamma and a development start voltage Vk obtained based on a result of detection of a gradation sequence pattern by means of an optical sensor are stored in a memory. When the next image density control is executed, development biases for forming respective toner patches are calculated based on the development gamma and the development start voltage Vk stored in the memory so that an amount of toner attracting to each of the toner patches disperse from small to large toner attraction amount sides at the same interval within a detectable range for a sensor. Then, the gradation sequence pattern is formed based on the thus calculated development biases and controls image density. Generally, the development gamma does not significantly vary from the previous value.

Thus, as far as the respective toner patches of the gradation sequence pattern are formed based on the development gamma obtained last time so that an toner attraction amount of each of the respective toner patches disperse from small to large toner attraction amount sides at the same interval within the detectable range for the optical sensor, a number of the respective toner patches can be decreased. Specifically, when the development gamma is high, all of the toner patches in the gradation sequence pattern are formed based on the low developing bias, while the development gamma is low, the toner patches on the low toner attraction amount side are formed based on the low developing bias and those on the high toner attraction side are formed under the high developing bias. Thus, by changing the developing bias for the toner patches based on the development gamma calculated last time, a small number of toner patches are enough if dispersing from small to large toner attraction amount sides at the same interval within a detectable range for the sensor.

As a result, due to decrease in number of the toner patches, image density control can be quicker while toner consumption for image density control can be reduced.

However, when environment sharply changes from the last time or image density control is executed after long time absence of an apparatus or the like, development gamma sometime significantly increases.

When the development gamma significantly increases from previous one, only a toner patch on the low toner attraction amount side among those formed based on a development bias calculated based on the development gamma of the last time enters a detectable range for the optical sensor, and thus the development gamma cannot sometime be calculated in an apparatus, in which a number of toner patches of a gradation sequence pattern is decreased by forming the toner patches based on the development gamma calculated last time. In such a situation, the image forming apparatus of the Japanese Patent Application Laid Open No. 2006-106222 forms a gradation sequence pattern again by changing a developing bias or increasing the number of toner patches so that data of an toner attraction amount of at least two toner patches can enter the detectable range for the optical sensor.

However, repetitious formation of the gradation sequence pattern necessitates a longer image density control time period resulting in a long downtime of an apparatus.

In addition, consumption of toner for image density control use increases.

Then, the applicant is developing a new image forming apparatus. Specifically, the below described image forming apparatus is in the course of development, which forms respective toner patches based on a prescribed fixed developing bias, which always causes the respective toner patches to enter the detectable range for an optical sensor even if the development gamma is predicted to widely change. Further, when there actually exists a contribution factor, which significantly increases the development gamma this time more than that calculated last time and the development gamma significantly increases more than that of last time due to sharp environment change, the toner patches can disperse at the same interval within the detectable range for the optical sensor by fixing image formation conditions for all of forming toner patches.

There exist various contribution factors possibly increasing development gamma this time more than that calculated last time. Thus, detection of all of the contribution factors increases cost of an apparatus. Thus, only a principle contribution factor, such as environment, an absent time of an apparatus, etc., is detected. However, development gamma sometimes increases more than that calculated last time due to a contribution factor other than the principal contribution factor. For example, even though the principle contribution factor is not detected, and it is determined that development gamma this time does not increase than that of the last time thereby a gradation sequence pattern is formed based on a developing bias calculated last time, the gamma sometimes significantly increase this time than that calculated last time due to a contribution factor other than the principal contribution factor.

In such a situation, only one point of a toner patch on the low toner attraction amount side can possibly enter the detectable range for the optical sensor.

As a result, the development gamma cannot possibly be calculated.

SUMMARY OF THE INVENTION

The present invention has been made in view of the above noted and another problems and one object of the present invention is to provide a new and noble image forming apparatus. Such a new and noble image forming apparatus includes a control device that calculates a developing ability of the developing device based on a detection value detected by an optical detection device from the plural toner patches. The control device adjusts an image formation condition based on the calculated developing ability. A factor detection device is provided to detect a contributing factor that causes the developing ability to largely change after the last adjustment of the image formation condition. The control device controls image formation such that when the factor detection device does not detect the contribution factor and a developing ability calculated this time is different from that calculated last time (as to a part of the plural toner patches), the plural toner patches are formed based on a prescribed fixed image formation condition so that an attraction amount of toner attracting to the plural toner patches enter a prescribed range detectable for the optical detection device. The remaining toner patches are formed (based on an image formation condition determined) in accordance with the image formation condition previously adjusted. When the detection device detects the contribution factor, the entire toner patches are formed based on the prescribed fixed condition.

In another embodiment, the factor detection device detects a large error included in the developing ability calculated in the last adjustment of the image formation condition.

In yet another embodiment, the factor detection device detects a wide change of a charge amount of the toner included in the developer stored in the developing device after the last adjustment of the image formation condition.

In yet another embodiment, the factor detection device detects the wide change of a charge amount of toner by detecting replacement of the developer stored in the developing device.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 29 illustrates various formulas;

FIGS. 30A and 30B collectively illustrates exemplary formulas from 1 to 15;

FIG. 31 illustrates an exemplary table 1 showing various image formation conditions; and FIG. 32 illustrates an exemplary table 2 showing the other various image formation conditions.

PREFERRED EMBODIMENTS OF THE PRESENT INVENTION

Figure 1:
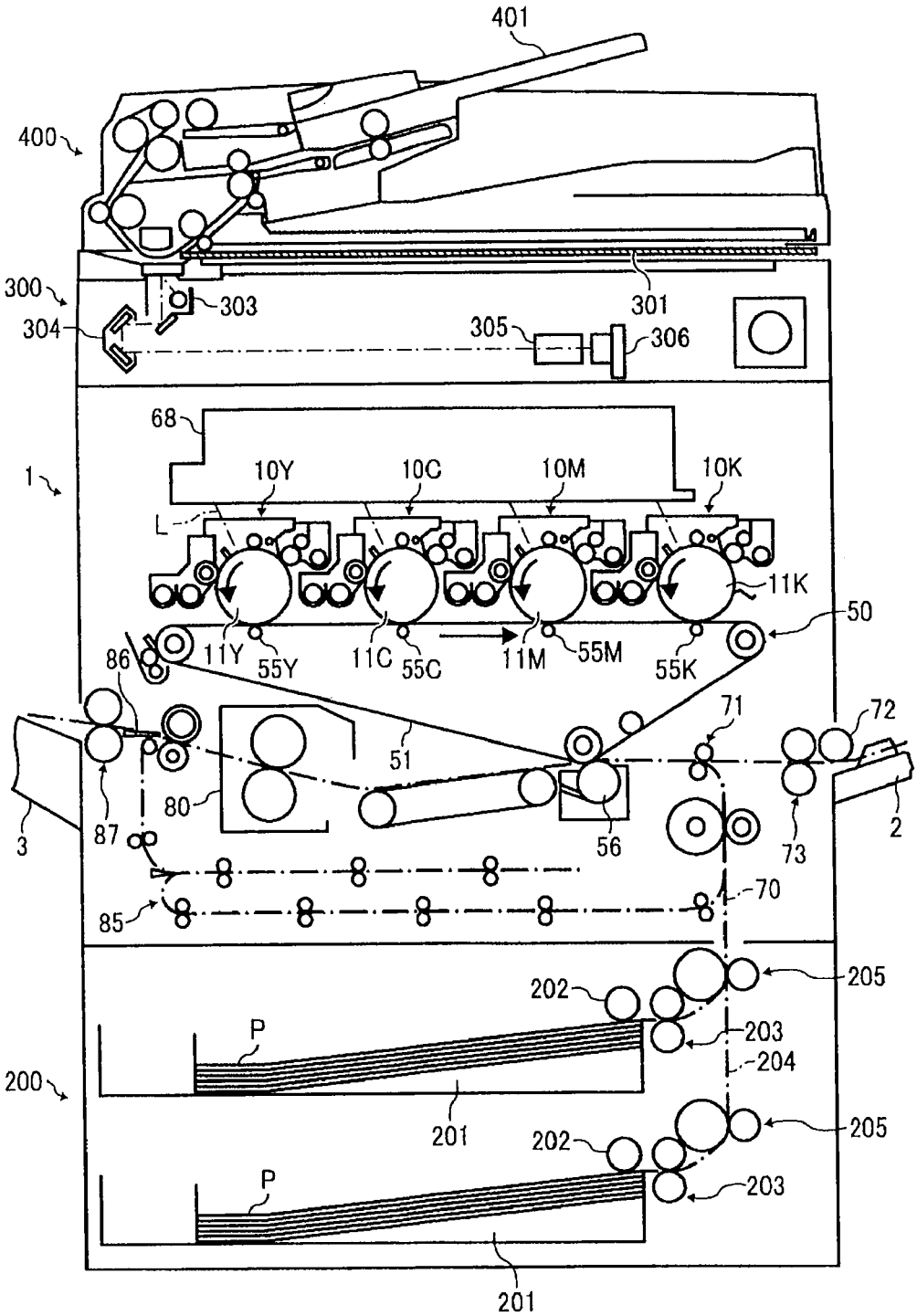
FIG. 1 is a schematic chart illustrating an exemplary copier according to one embodiment of the present invention.

Referring now to the drawings, wherein like reference numerals and marks designate identical or corresponding parts throughout several figures, in particular in particular in FIG. 1, a copier employing an electro photographic system according to one embodiment is described. As shown, the copier includes a printer section 1 for forming an image on a recording sheet P, a sheet feeding device 200 for feeding the recording sheet P to the printer section 1, a scanner 300 for reading an original document image, and an auto document feeder 400 for feeding an original document to the scanner 300 and the like.

In the scanner 300, a first driving carriage 303 that mounts an original document illumination use light source, a mirror and a second driving carriage 304 that mounts plural reflection mirrors or the like reciprocate. The original document set on a platen glass 301 is read and scanned at the same time. A scanning light launched from the second driving member 304 is converged by an imaging lens on an imaging plane of a reading sensor arranged behind the imaging lens 305. The scanning light is then read by a reading sensor 306 and is converted into an imaging signal.

On a side of a casing of the printer section 1, a manual sheet feed tray 2 for manually feeding a recording sheet P into the casing and a sheet ejection tray 3 for stacking the recording sheets P ejected from the casing with an image are arranged.

Figure 2:
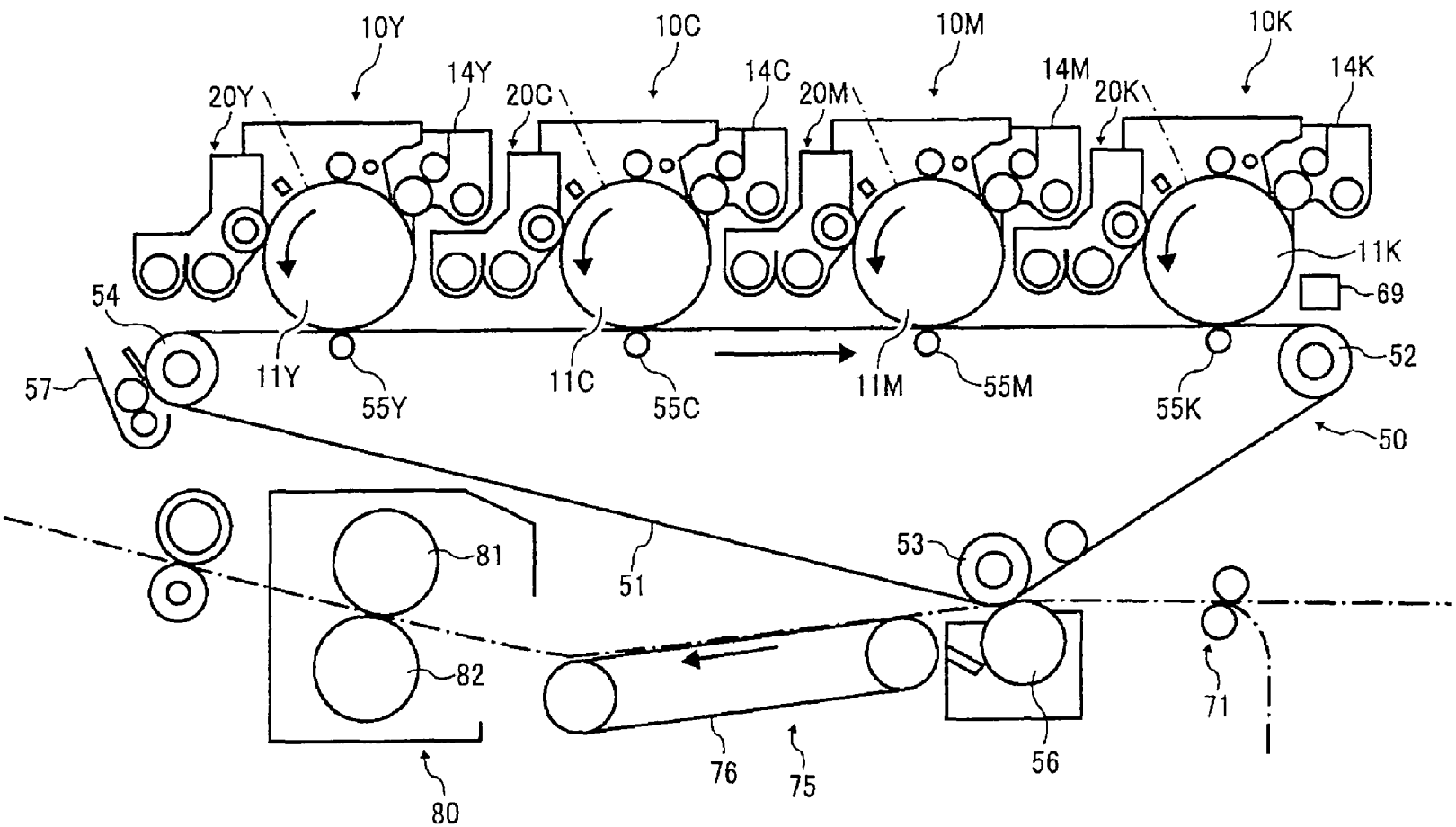
FIG. 2 is an enlarged view of an exemplary interior of a printer section of the copier.

As shown in FIG. 2, a transfer unit 50 includes an endless intermediate transfer belt 51 suspended by plural suspension rollers as an image bearing belt, and is arranged in the casing of the printer section 1. The intermediate transfer belt 51 is endlessly rotated clockwise by a driving roller 52 while being suspended by a driving roller 52 driven clockwise, a secondary transfer backup roller 53, a driven roller 54, and four primary transfer rollers 55Y to 55K. Suffixes Y to K of numbers representing the primary transfer rollers represent Yellow to Black colors, respectively (Herein below the same).

By largely curving at winding sections at the driving roller 52, the secondary transfer backup roller 53, and the driven roller 54, the intermediate transfer belt 51 is suspended in a reverse triangle state with its bottom side being upside. Thus, the bottom side serves as a belt upper suspension plane extending horizontally. Above the belt upper suspension plane, four process units 10Y to 10K are horizontally arranged side by side along the belt upper suspension plane.

Back to FIG. 1, above the four process units 10Y to 10K, an optical writing unit 68 is arranged as a latent image formation device. In the optical writing unit 68, a control section, not shown, drives four semi-conductor lasers, not shown, and emits four writing lights L in accordance with image information read by the scanner 300. The writing lights L scan drum state photoconductive members 11Y to 11K serving as image bears included in the process units 10Y to 10K in a dark, thereby writing latent images on the surfaces of the photoconductive members 11*y* to 11K for use of mono colors of Y to K.

According to this embodiment, the optical writing unit 68 execute optical scanning by emitting a laser light from the semi-conductor laser, deviating the laser light by a polygon mirror, not shown, and either reflecting the laser light by a reflection mirror, not shown, or passing the same through an optical lens. Instead of such a configuration, an LED array can execute the optical scanning.

Figure 3:
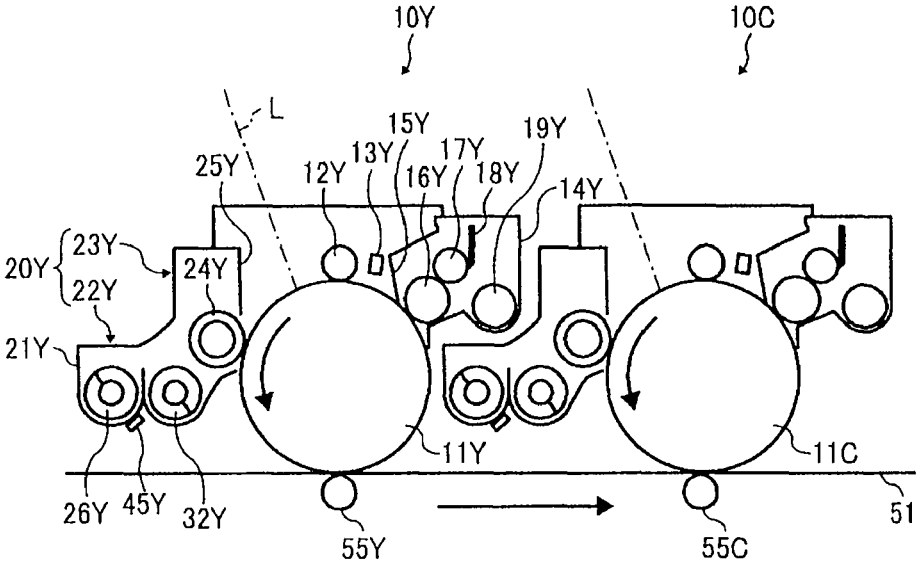
FIG. 3 is an enlarged view of exemplary process units for Yellow and Cyan uses included in the copier together with an exemplary intermediate transfer belt.

As shown in FIG. 3, the process unit 10Y for yellow use includes a charge member 12Y, a charge removing member 13Y, a drum cleaning device 14Y, and a developing device 20Y and the like around the photoconductive member 11Y. The process unit 10Y is held by a casing serving as a common holder and is integrally detached from the printer section as a unit.

The charge member 12Y is formed in a roller state and is freely rotatively supported by a bearing, not shown, contacting the photoconductive member 11Y. The charge member 12Y uniformly charges the surface of the photoconductive member 11Y with a polarity as same as that of a charge of the yellow toner while contact rotating the photoconductive member 11Y receiving a charge biases from a bias applying device, not shown. Instead of such a charge member 12Y, a scorotron charger or the like can be employed not to contact the photoconductive member 11Y and applies a uniform charge thereto.

The developing device 20Y stores yellow developer having magnetic carrier and non-magnetic yellow toner, not shown, in a casing 21Y. Such a developing device includes a developer conveyance device 22Y and a development section 23Y. In the development section 23Y, a development sleeve 24Y serving as a developer carrier member driven by a driving device, not shown, to endlessly move its own surface is partially exposed from an opening formed on the casing 21Y. Thus, a development region is formed in which the photoconductive member 11Y and the development sleeve 24Y face each other via a prescribed gap.

In the development sleeve 24Y formed from a non-magnetic hollow pipe state member, a magnet roller including plural magnet poles arranged along the circumference is fixed and not driven by the development sleeve 24Y. The development sleeve 24Y rotates and picks up yellow developer from inside the developer conveyance device 22Y while attracting the yellow developer to its own surface using a magnetic force generated by the magnet roller. Then, the yellow developer conveyed toward the development region as the development sleeve rotates and enters a gap formed between the surface of the development sleeve 24Y and a doctor blade 25Y opposing the surface at its leasing end via a prescribed gap. Thus, a developer layer on the sleeve is adjusted to have almost the same thickness as the gap. When the developer layer is conveyed to a section in the vicinity of the development region opposing the photoconductive member Y11 as the development sleeve 24Y rotates, the developer rises on the sleeve under influence of the magnetic force of a development magnetic pole, not shown, included in the magnet roller, thereby forming a magnetic brush.

To the development sleeve 24Y, a bias-applying device, not shown, applies a developing bias having the same polarity to that of toner. Thus, in the development region, a non-development potential capable of electrostatically moving the yellow toner from a non-image (i.e., a uniformly charged section, e.g. a background) section to the sleeve operates between the surface of the development sleeve 24Y and the non image section of the photoconductive member 11Y. Further, a development potential capable of electrostatically moving the yellow toner from the sleeve side to a latent image on the photoconductive member 11Y operates between the surface of the development sleeve 24Y and the latent image. The latent image on the photoconductive member 11Y is developed into a yellow toner image when the yellow toner in the yellow developer is transferred onto the latent image by operation of the development potential.

The yellow toner passing through the development region as the developing sleeve 24Y rotates is separated from the developing sleeve 24Y under influence of a repelling magnetic field formed between repelling magnetic poles, not shown, included in the magnet roller and returns into the developer conveyance device 22Y.

The developer conveyance device 22Y includes two first screw member 26Y and a second screw member 32Y, a partition wall arranged between both of the screws 26Y and 32Y, and a toner density detection sensor 45Y including a magnetic permeability sensor and the like. The partition wall separates a first conveyance room serving as a developer conveyance section for storing the first screw member 26Y from a second conveyance room serving as a developer conveyance section for storing the second screw member 32Y. Both of the conveyance rooms are communicated via an opening, not shown, in a region where the both ends of the screw members in an axial direction oppose each other.

Each of the first and second screw members 26Y and 32Y includes a bar like rotation shaft member freely rotatively supported by bearings, not shown, at both ends and a spiral wing protruding from the surface of the rotation shaft member in a spiral state. Then, as a driving device, not shown, rotates, yellow developer is conveyed in a rotational axis direction by means of the spiral wing.

In the first conveyance room the yellow developer is conveyed from a front side to a rear side in a direction perpendicular to a sheet of the drawing as the first screw member 26Y rotates. When conveyed to a section in the vicinity of the rear side end of the casing 21Y, the yellow developer enters the second conveyance room via an opening, not shown, formed on the partition wall.

Above the second conveyance room, the above-mentioned development section 23Y is formed so that the entire region of the second conveyance room and the development section 23Y opposing each other are communicated. Thus, the second screw member 32Y and the developing sleeve 24Y arranged at an obliquely upward position thereof oppose each other maintaining a parallel relation. In the second conveyance room, the yellow developer is conveyed from a rear side to a front side in a direction perpendicular to the sheet of the drawing as the second screw member 32Y rotates. During a process of such conveyance, the yellow developer around a rotation direction of the section screw member 32Y is either picked up to or is collected after development from the developing sleeve 24Y. Then, the yellow developer conveyed to a section in the vicinity of an end of the second conveyance room at the front side in the drawing returns to the first conveyance room.

A toner density detection sensor 45Y of a permeability type is secured to a bottom wall of the first conveyance room to detect toner density of the yellow toner from a lower side thereby outputting a voltage in accordance with a detection result. The controller section determines that toner density is high enough based on a difference value Tn(Vtref−Vt) between an output voltage Vt transmitted from the toner density detection sensor 45Y and a toner density control reference value Vtref when the difference value Tn is positive (+). When the difference value Tn is negative (−), the control section drives a toner-replenishing device, not shown, and replenishes an appropriated amount of yellow toner to the first conveyance room so that the output value Vt becomes a target value Vtref. Thus, density of the yellow developer decreased by development can be recovered.

A yellow toner image formed on the photoconductive member 11Y is transferred on the intermediate transfer belt 51 at a primary transfer nip as mentioned later in detail as a primary transfer. Toner not transferred onto the intermediate transfer belt 51 remains attracting the surface of the photoconductive member 11Y having been subjected to the primary transfer process.

A drum cleaning device 14Y includes a cleaning blade 15Y of a cantilever type made of polyurethane rubber or the like contacting the surface of the photoconductive member 11Y at its one free end. A brush roller 16Y including a rotation shaft member driven by a driving device, not shown, and infinitive number of conductive hairs rising from the circumferential surface of the rotation shaft member. Then the not transferred toner is scraped off from the photoconductive member 11Y by the cleaning blade 15Y or the brush roller 16Y. To the brush roller 16Y, a clean bias is applied via an electric field roller 17Y made of metal contacting the brush roller 16Y. A leading end of a scraper 18Y is depressed to the electric field roller 17Y. The not transferred toner scraped off by the cleaning blade 15Y or the brush roller 16Y from the photoconductive member 11Y is scraped off from the electric field roller 17Y after passing through the brush roller 16Y and the electric filed roller 17Y and drops onto the collection screw 19Y. Then, the not transferred toner is ejected outside the casing as collection screw 19Y rotates, and is returned into the developer conveyance device 22Y via the toner recycle conveyance device.

The surface of the photoconductive member 11Y, where the not transferred toner is cleaned by the drum cleaning device 14Y, is then subjected to charge removal executed by a charge removing device 13Y including a charge removing lamp or the like. The surface is then uniformly charged by the charge member 14Y. Hence, only the process unit 10Y for yellow color is described in detail. However, process units (10C, 10M, and 10K) for the other colors have the same configuration except color.

Back to FIG. 2, the photoconductive members 11Y to 11K in the process units 10K to 10K rotate contacting the intermediate transfer belt 51 endlessly rotated clockwise thereby forming four primary transfer nips for Y to K color use. In the backside of the primary transfer nips for Y to K colors, the primary transfer rollers 55*t* to 55K contact the backside surface of the intermediate transfer belt 51. A primary transfer bias having opposite polarity to that of toner charge is applied to the primary transfer rollers 55*t* to 55K by the bias-applying device, not shown. Owing to the primary transfer bias, a primary transfer electric field is created in each of the primary transfer nips for Y to K colors to electro statically move toner from the photoconductive member side to the belt side.

When the respective toner images of Y to K colors formed on the photoconductive members 11Y to 11K enter the primary transfer nips for Y to K colors, they are superimposed one by one on the intermediate transfer belt 51 by the operations of the primary transfer electric field and a nip pressure. Thus, four superimposed toner images (i.e., a four-color toner image) are formed on the outer surface of the intermediate transfer belt 51. Instead of using the primary transfer rollers 55*t* to 55K, conductive brushes receiving a primary transfer bias or a non-contact type corona charger can be employed.

Below the intermediate transfer belt 51, a secondary transfer roller 56 is arranged as a contact member and is driven counterclockwise by a driving member, not shown, while contacting the outer surface of the intermediate transfer belt 51 forming a secondary transfer nip. Then, on the rear side of the secondary transfer nip, a secondary transfer backup roller 53 winds the intermediate transfer belt 51.

To the secondary transfer backup roller 53, a secondary transfer bias having the same polarity to toner charge is applied by a secondary transfer power source, not shown. In contrast, the secondary transfer roller 56 contacting the outer surface of the belt and forming the secondary transfer nip is grounded. Thus, a secondary transfer electric field is created between the secondary transfer backup roller 53 and the secondary transfer roller 56. The four-color toner image formed on the outer surface of the intermediate transfer belt 51 enters the secondary transfer nip as the intermediate transfer belt 51 endlessly travels.

Back to FIG. 1, the sheet-feeding device 200 includes a sheet-feeding cassette 201 accommodating recording sheets P, a sheet-feeding roller 202 for launching the recording sheet P from the sheet-feeding cassette 201, and a pair of separation rollers 203 for separating the recording sheets P one by one when launched. Also included are plural pair of conveyance rollers 205 arranged downstream of the separation rollers 203 along a launching path 204. The sheet-feeding device 200 is arranged just below the printer section 1. The launching path 204 is communicated with a sheet-feeding path 70 of the printer section 1. Thus, the recording sheets P launched from the sheet-feeding cassette 201 are conveyed into the sheet-feeding path 70 via the launching path 204.

In the vicinity of the end of the sheet feeding path 70, a pair of registration rollers 71 is arranged so as to pinch and feed the recording sheet P to the secondary transfer nip at a prescribed time in synchronism with the four color toner image on the intermediate transfer belt 51. Then, in the secondary transfer nip, the four color toner image on the intermediate transfer belt 51 is transferred on to the recording sheet p at once under the influence of the secondary transfer electric field and the nip pressure as a secondary transfer, thereby a full color image is formed on a blank recording sheet P. The recording sheet P with the full color image is then ejected from the secondary transfer nip and is separated from the intermediate transfer belt 51.

On the left side of the secondary transfer nip, a conveyance belt unit 75 including an endless sheet conveyance belt 76 endlessly traveling counterclockwise and plural suspension rollers suspending the belt 76 are arranged. The recording sheet P separated from the intermediate transfer belt 51 is conveyed onto the upper suspension surface of the sheet conveyance belt 76, and is further conveyed to a fixing device 80.

The recording sheet P conveyed to the fixing device 80 is pinched by a heat applying roller 81 having a heat generation source such as a halogen lamp, not shown, and a pressure applying roller 82 pressure-contacting the heat applying roller 81. Then, due to pressure and heat applications, the full color image is fixed onto the surface of the recording sheet P and the same is ejected therefrom.

Few toner not transferred onto the recording sheet P in the secondary transfer process remains attracting to the surface of the intermediate transfer belt 51 after passing through the secondary transfer nip. However, the belt-cleaning device 57 contacting the outer surface of the intermediate transfer belt 51 from the belt removes the some toners.

A switch back device 85 is arranged just below the fixing device 80. When arriving at a conveyance path switching position wherein a swingable switching pick 86 is arranged, the recording sheet P ejected from the fixing device 80 is directed either to a pair of sheet ejection rollers 87 or the switch back device 85 in accordance with a swinging stop position of the pick 86. When conveyed toward the pair of sheet ejection rollers 87, the recording sheet P is stacked on an ejection sheet tray 3 after ejected outside.

When conveyed toward the switch back device 85, the recording sheet P is turned upside down by switch back conveyance of switch back device 85 and is conveyed toward the pair of registration rollers 71 again. Then, the recording sheet P enters the secondary transfer nip again and a full-color image is also formed on the backside.

A recording sheet p manually inserted into the manual sheet feeding tray 2 arranged on a side of the casing of the printer section 1 passes through a manual insertion supply roller 72 and a pair of manual insertion separation rollers 73 and is conveyed toward the pair of registration rollers.

When a copy is to be produced by the copier from an original document, the original document is set onto an original document table 401 included in the auto document-feeding device 400. Otherwise, the automatic document-feeding device 400 is open and the original document is set onto a platen glass 301 included in a scanner 300. Then, the auto document-feeding device 400 is closed to depress the original document. When a start switch is depressed after that, the original document is conveyed onto the platen glass 301 when set onto the auto document-feeding device 400. The scanner 300 then operates and reading and scanning by means of the first and second driving carriages 303 and 304 are started. Almost simultaneously, the transfer unit 50 and the respective process units 10Y to 10K start driving. In addition, the sheet-feeding device 200 starts feeding a recording sheet P. When a recording sheet P not accommodated in the sheet-feeding cassette 201 is used, another sheet P is set and launched from the manual sheet setting tray 2.

Figure 4:
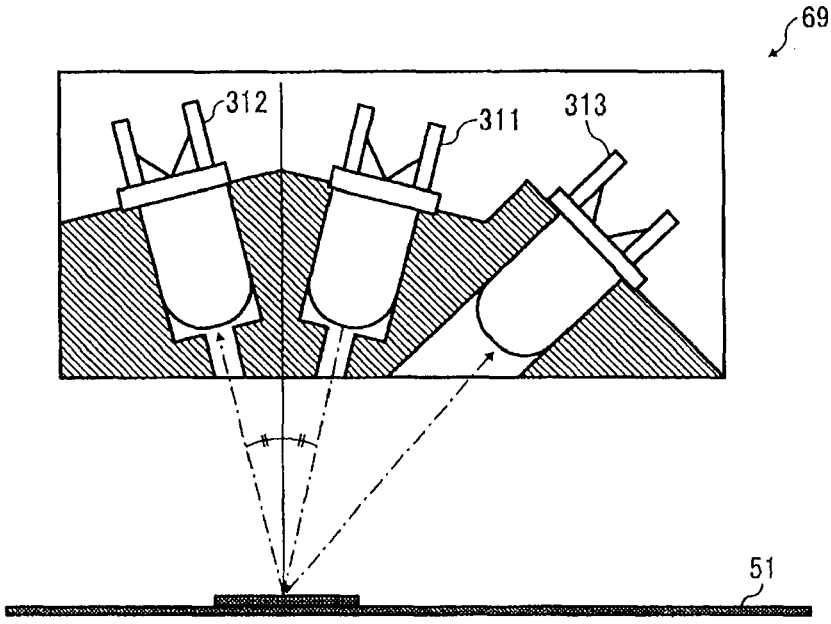
FIG. 4 is a schematic chart illustrating an exemplary optical sensor.

On the right side of the process unit 10K for black use in the drawing, an optical sensor 69 is arrange opposing the outer surface of the intermediate transfer belt 51 via a prescribed gap as illustrated in FIG. 4. As shown, the optical sensor 69 mainly includes a light generation element 311, a fair reflection light acceptance unit 312 serving as a first light receiving device for receiving a fair reflection light, and a diffusion reflection light acceptance unit 313 serving as a second light receiving device for receiving a diffusion reflection light. The light emitted from the light generation element 311 is emitted toward the surface of the intermediate transfer belt 51. Then, a fair reflection light fairly reflected from the surface or a toner patch transferred onto the surface of the intermediate transfer belt 51 is received by the fair reflection light acceptance unit 312, so that the fair reflection light acceptance unit 312 outputs a voltage in accordance with a light receiving amount. Further, the diffusion reflection light diffused and reflected from the surface or a toner patch transferred onto the surface of the intermediate transfer belt 51 is received by the diffusion reflection light acceptance unit 313, so that the diffusion reflection light acceptance unit 313 outputs a voltage in accordance with a light receiving amount.

As the light generation element 311, a GaAs light generation diode having peak light generation wavelength of 940 nm is used. Further, as the fair reflection light acceptance unit 312 and the diffusion reflection light acceptance unit 313, a Si phototransistor having peak light separation sensitivity wavelength of 850 nm is used. Specifically, the optical sensor detects infrared light having the wavelength not less than 830 nm avoiding a significant difference of a reflection rate between colors. With such an optical sensor, toner patches of all color of Y to K can be detected.

Figure 5:
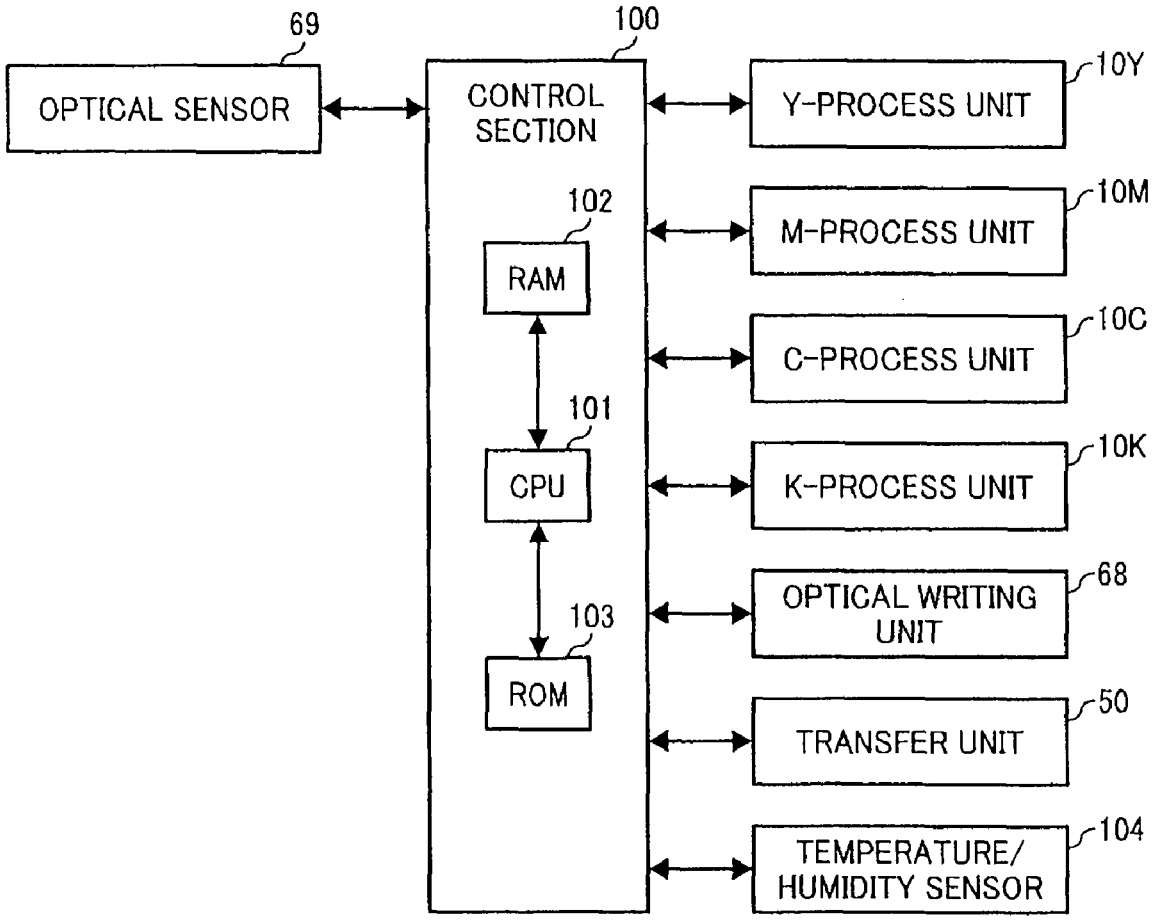
FIG. 5 illustrates an essential portion of an exemplary electric circuit.

Now, an exemplary essential part of an electric circuit included in the copier is described with reference to FIG. 5. A control section 100 includes a CPU 101, a RAM 102, and a ROM 103 and the like. To the control section 100, plural process units 10Y to 10K, the optical writing unit 68, the transfer unit 50, the optical sensor unit 69 and the like are connected. The control section 100 controls these devices based on control program stored in the ROM 103 or the RAM 102.

Further, the control section 100 executes process control as image density control for adjusting image density of respective colors every time when a power is supplied or a prescribed number of sheets have been printed.

Figure 6:
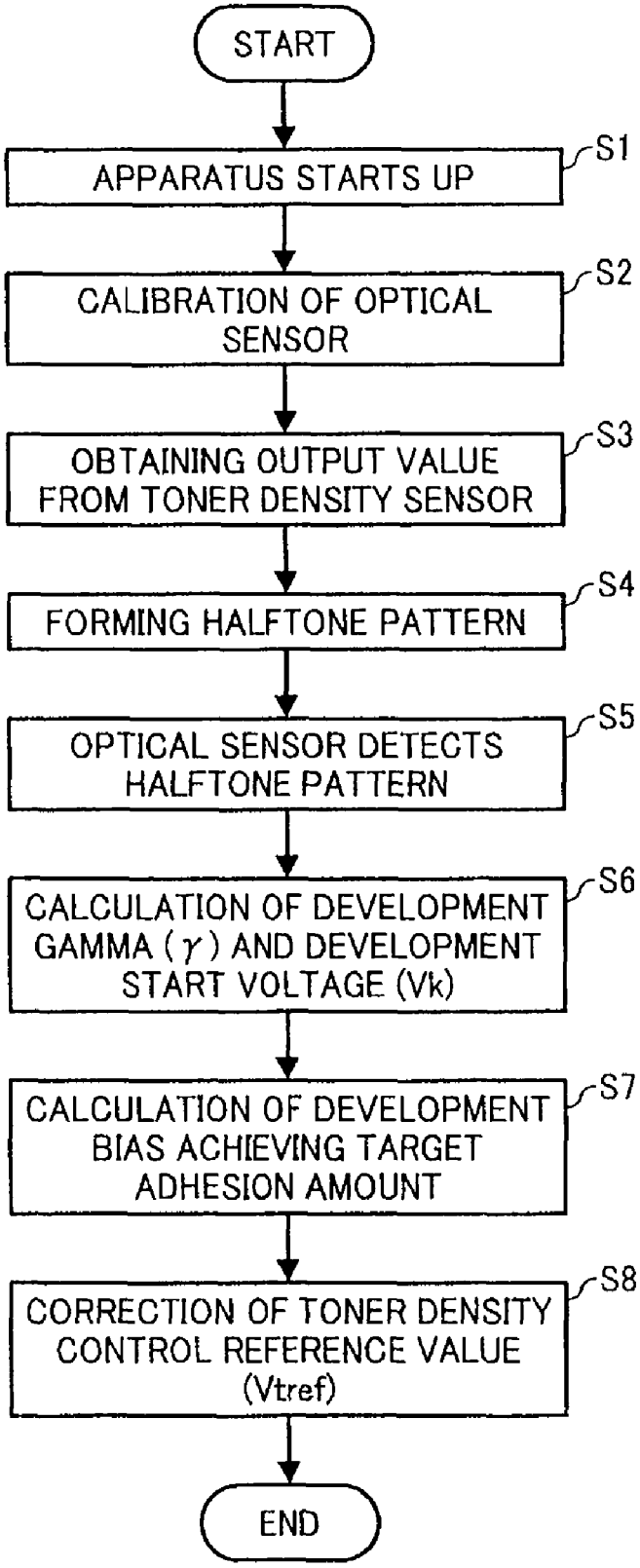
FIG. 6 illustrates an exemplary sequence of a process control.

FIG. 6 illustrates an exemplary sequence of process control starting when the power is supplied. When the power is supplied and an apparatus starts up in step S1, the control section 100 executes calibration for an optical sensor 69 in step S2. Specifically, a light intensity of a light emission element 311 is adjusted so that an output of a fair reflection light-receiving element 312 of the optical sensor 69 reaches a prescribed level (e.g. 4V). The optical sensor 69 does not need calibration.

Figure 7:
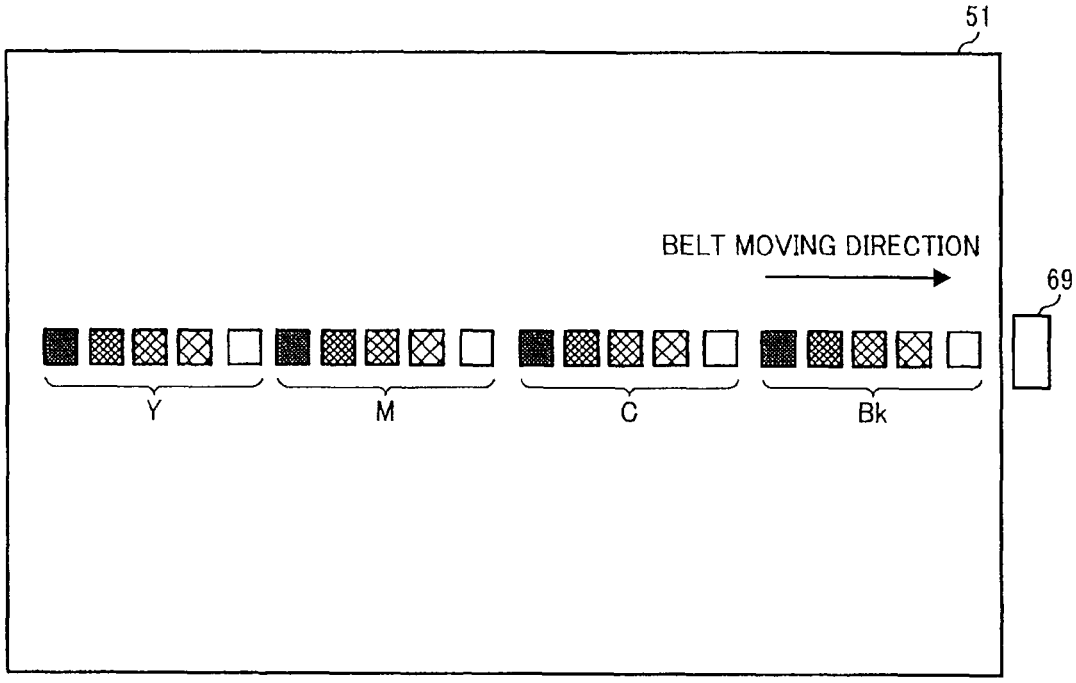
FIG. 7 illustrates an exemplary gradation sequence pattern formed on the intermediate transfer belt.

Then, the control section 100 obtains an output value TV of a toner density detection sensor 45 to recognize toner density in a development device of each of colors in step S3 and forms a gradation sequence pattern per color opposing each of optical sensors 69 as shown in FIG. 7 in step S4. Each of the gradation patterns of the respective colors includes about five toner patches having a different toner attraction amount with each other, and has a length of 14.4 mm in a sub scanning direction at an interval of 5.6 mm and is arranged in the order of Bk to Y gradation patterns on the intermediate transfer belt 51. The gradation pattern is formed by changing charge and development bias conditions per toner patch on an exposure condition having a predetermined level of full exposure capable of sufficiently removing a charge from a photoconductive member. Operations of setting the development and charge biases for each of the respective toner patches in the gradation patterns are mentioned later in detail. The gradation patterns of respective colors on the intermediate transfer belt 51 are optically detected by the optical sensor 69 in step S5.

Then, the output value obtained by detecting each of the toner patches in each of the gradation patterns of respective colors is converted into a toner attraction amount (i.e., image density) by using toner attraction amount calculation algorithm established based on a relation between an toner attraction amount and an output value of a light acceptance unit.

In this embodiment, a toner attraction amount is calculated using a fair reflection light fairly reflected from a toner patch and a diffusion reflection light as described in Japanese Patent Application Laid Open No. 2004-354623. By calculating the toner attraction amount using both of the fair reflection light and the diffusion reflection light, a detection range capable of detecting a large toner attraction amount can be broadened in comparison with that calculating only with the fair reflection light.

Further, using toner attraction amount calculation algorithm of the Japanese Patent Application Laid Open No. 2004-354623, a toner attraction amount can be precisely obtained even if outputs of a light generation element and a light acceptance unit change due to deterioration with age or a change of temperature or deterioration with age of the intermediate transfer belt. A toner attraction amount calculation algorithm discussed in the Japanese Patent Application Laid Open No. 2004-354623 is now briefly described.

Initially, an output of a fair reflection light-receiving element 312 and that of a diffusion reflection light-receiving element 313 are obtained when each of toner patches is detected. Then, a sensitivity correction coefficient alpha serving as the minimum value of a ratio between the output value of the fair reflection light receiving element 312 and that of the diffusion reflection light receiving element 313 is calculated. Then, the output value of the fair reflection light-receiving element 312 is divided into fair reflection and diffusion reflection light components using the sensitivity correction coefficient alpha. Then, a ratio between an output value (i.e., a background output value) obtained when the surface of the intermediate transfer belt is detected and the fair reflection light component is obtained.

The fair reflection light component is then converted into a normalized value β (beta) from 0 to 1. Then, using a value obtained by multiplying the normalized value β (beta) by the output value of the diffusion reflection light receiving element 313, a diffusion reflection light component from the surface of the intermediate transfer belt is removed from the output value of the diffusion reflection light receiving element 313, so that a diffusion reflection light component from the toner patch is extracted.

Then, using the normalized value β (beta) and the diffusion reflection light component, a sensitivity correction coefficient η that corrects a sensitivity of the output value of the diffusion reflection light-receiving element 313 is calculated. Then, by multiplying the above-mentioned sensitivity correction coefficient η by the diffusion reflection light component from the toner, which is extracted from the output value of the diffusion reflection light-receiving element 313, the output value of the diffusion reflection light-receiving element 313 is corrected or calibrated. Then, a toner attraction amount of each of toner patches is uniquely obtained from the output value of the diffusion reflection light receiving element 313 corrected or calibrated using the above-mentioned sensitivity correction coefficient η.

Figure 8:
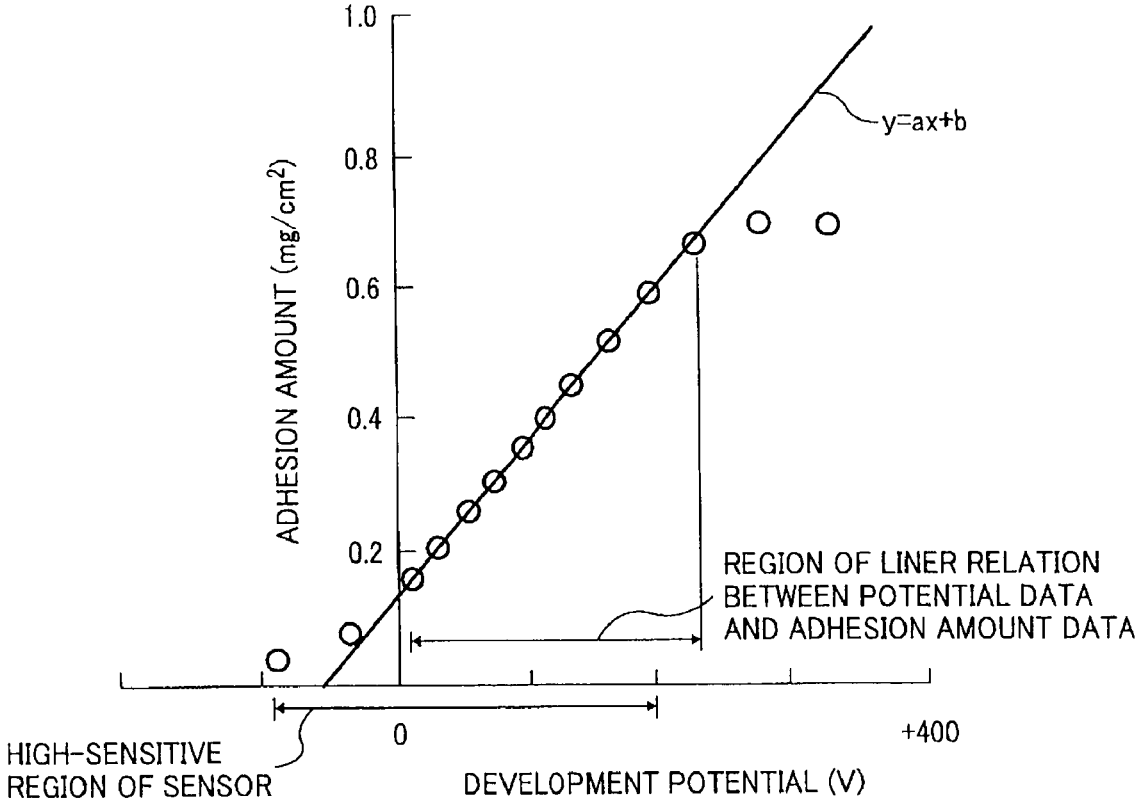
FIG. 8 illustrates an exemplary relation between a development potential and a toner attraction amount.

When the toner attraction amount for respective toner patches can be calculated using the toner attraction amount calculation algorithm, a development potential/toner attraction amount straight line (y=ax+b) approximated by the minimum square method is obtained per color based on a relation between the amount of toner attracting to each toner patch and a development potential used when each of toner patches is formed as shown in FIG. 8. Development gamma (i.e., an inclination "a") representing a developing ability and a development start voltage Vk (an intercept "b") are calculated per color based on the development potential/toner attraction amount straight line in step 6.

When having specified a development potential necessary for obtaining a prescribed target toner attraction amount based on the development gamma, the control section 100 calculates a development bias Vb matching with the development potential in step S7. The target toner attraction amount is determined by a coloring level of toner pigment, and generally amounts to 0.4 to 0.6 mg/cm$^2$.

Further, the control section 100 determines a charge bias Vc based on the calculated development bias Vb. The development bias Vb and the charge bias Vc are stored in a nonvolatile memory, such as a RAM 102, etc. The charge bias Vc is generally set high than the development bias by 100 to 200 volt. The development bias Vb is set to be 350 to 700 volt. Specifically, even when the calculated bias is 1 kV, the development bias Vb is set to be 700 volt. That is, when the setting value of the development bias exceeds 700 v, a capacity of a power supply is also exceeded, so that the bias possibly cannot be constantly maintained. When the setting value is not more than 350 v, the setting amount of charge bias decreases too much so that the charge tends to be uneven. As a result, an image formed last time appears on the next image as an abnormal image called image remaining.

When the development bias Vb is calculated, a toner density control reference value Vtref is corrected using the development gamma and output value Vt of the toner density detection sensor 45 in step S8. Specifically, a differential delta gamma is obtained by subtracting a target development gamma from a calculated development gamma. The target development gamma can be 1.0 (mg/cm$^2$)/KV, which represents that a toner attraction amount is 1.0 mg/cm$^2$ when the development start voltage Vk is 0V and the development potential is 1 KV. For example, when the development start Vk is 0 Volt, the target toner attraction amount is 0.5 mg/cm$^2$, and the potential Vl of a photoconductive member after exposure is 50 Volt, a development bias calculated from the target development gamma Vb amounts to 550 Volt.

When the calculated delta gamma deviates from the prescribed range, the toner density control reference value Vtref possibly exceeds the above-mentioned setting range. Thus, the toner density control reference value Vtref is corrected so that the development gamma can approximate a target level before the next process control. When the toner density control reference value Vtref is corrected to approximate the development gamma to the target level and an image is formed based on the calculated development bias, a toner attraction amount does not reach a target level.

However, since toner density in the developing device does not immediately reach the target level and a toner replenishing control is executed so that the toner density gradually reaches the target level in the developing device, the development gamma does not sharply change. Specifically, the target toner attraction amount can be obtained using the calculated development bias in the beginning of the correction of the toner density control reference value Vtref. Then, the toner attraction amount gradually recedes from the target. An amount of correction of the toner density control reference value Vtref is set so that the toner attraction amount does not largely recede from the target level even when an image is formed based on the calculated development bias. Thus, the image does not significantly deteriorate. When the output value Vt of the toner density detection sensor 45 generated at the time of gradation sequence pattern formation is largely different from the toner density control reference value Vtref, and the toner density control reference value Vtref is corrected, the toner attraction amount is possibly deviated from the target level. Thus, it is determined if the toner density control reference value Vtref is corrected also in connection with the output value Vt of the toner density detection sensor 45. For example, toner density is decreased from the current level by decreasing the toner density control reference value Vtref by 0.2V when the following inequalities are established simultaneously:

$$\text{Delta Gamma} \geqq 0.30(\text{mg/cm}^2)/\text{kV, and}$$

$$Vt - Vtref \leqq -0.2\text{V}$$

The toner density is increased from the current level by increasing the toner density control reference value Ttref by 0.2V when the following inequalities are established simultaneously:

$$\text{Delta Gamma} \leqq -0.30(\text{mg/cm}^2)/\text{kV, and}$$

$$Vt - Vtref \geqq 0.2\text{V}$$

Whereas, the toner density control reference value Ttref is not corrected when the following inequalities are established:

$$-0.30(\text{mg/cm}^2)/\text{KV} < \text{Delta Gamma} < 0.30(\text{mg/cm}^2/\text{KV}$$

Now, operations of setting a development bias and a charge bias for each toner patch in a gradation sequence pattern are described.

Initially, the first embodiment for forming each of toner patches constituting a gradation sequence pattern using an exemplary development bias and a charge bias is described. In the first embodiment, some of the toner patches are formed based on a prescribed development bias while the other toner patches are formed based on a development bias calculated based on the development bias Vb determined in the last process control. Specifically, a development bias Vb obtained by executing the last process control and stored in a non-volatile memory, such as RAM, etc., is obtained. The maximum development potential Potmax is then obtained using the formula 1-1 by substituting the development bias therein. In the formula, the after exposure voltage of a solid image section (Vl) represents a potential of a photoconductive member having been subjected to the exposure depending on a performance of the photoconductive member.

Then, by substituting the maximum development potential PotMax in the formula 1-2, development biases forming toner patches are calculated based on the development bias Vb determined in the last process control, respectively. In the formula, "Vpb" represents a development bias forming each of toner patches constituting a gradation sequence pattern. "n" represents an order of a toner patch to be formed based on the development bias Vb obtained by executing the last process control. "m" represents a number of toner patches to be formed based on the development bias Vb. As shown, four toner patches among those included in the gradation sequence pattern are formed based on the development bias Vb.

The predetermined development bias for forming the toner patches can be represented by the formula 1-3. In the formula 1-3, "k" represents an order of a toner patch formed by the predetermined development bias. The initial value "Vpb" represents a development bias enabling a toner attraction amount to always enter a region highly sensitively detectable for a sensor as shown in FIG. 8, in which a development potential and the toner attraction amount show a linear relationship even if the development gamma is high. Such an initial value "Vpb" is previously obtained through an experiment or the like and is stored in a non-volatile memory, such as a RAM, etc.

Then, using the thus obtained development bias Vpb, a charge bias forming each of toner patches in a gradation sequence pattern is calculated using a formula 1-4. In the formula, the background potential coefficient and the background potential offset are set not to cause background stein.

These development bias and charge bias are stored in a non-volatile memory, such as a RAM, etc., and are used to form the gradation sequence pattern.

Figure 9:
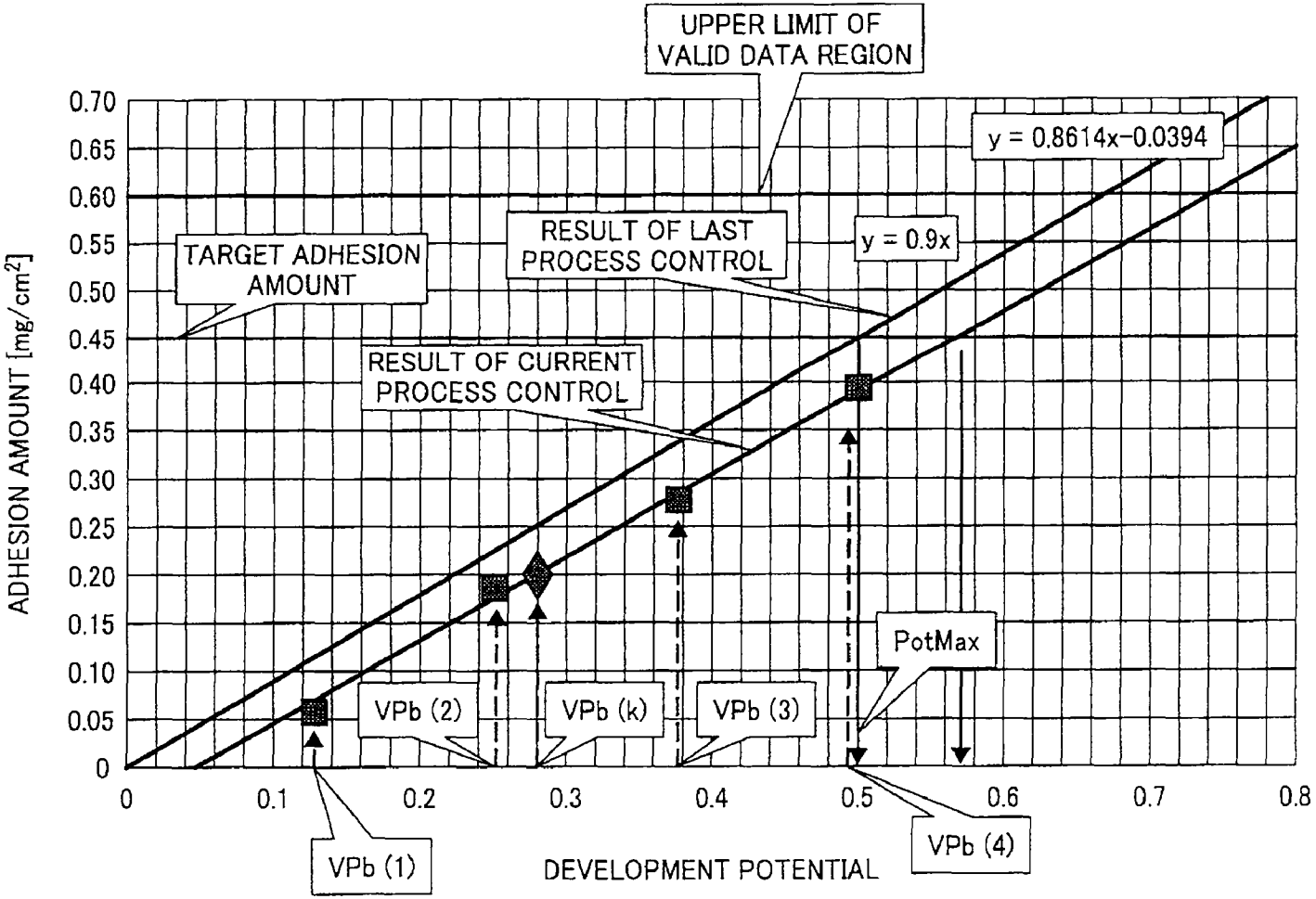
FIG. 9 illustrates an exemplary toner attraction amount of a gradation sequence pattern when development gamma is not largely changed between process control executed last time and this time according to a first embodiment of the present invention.
Figure 10:
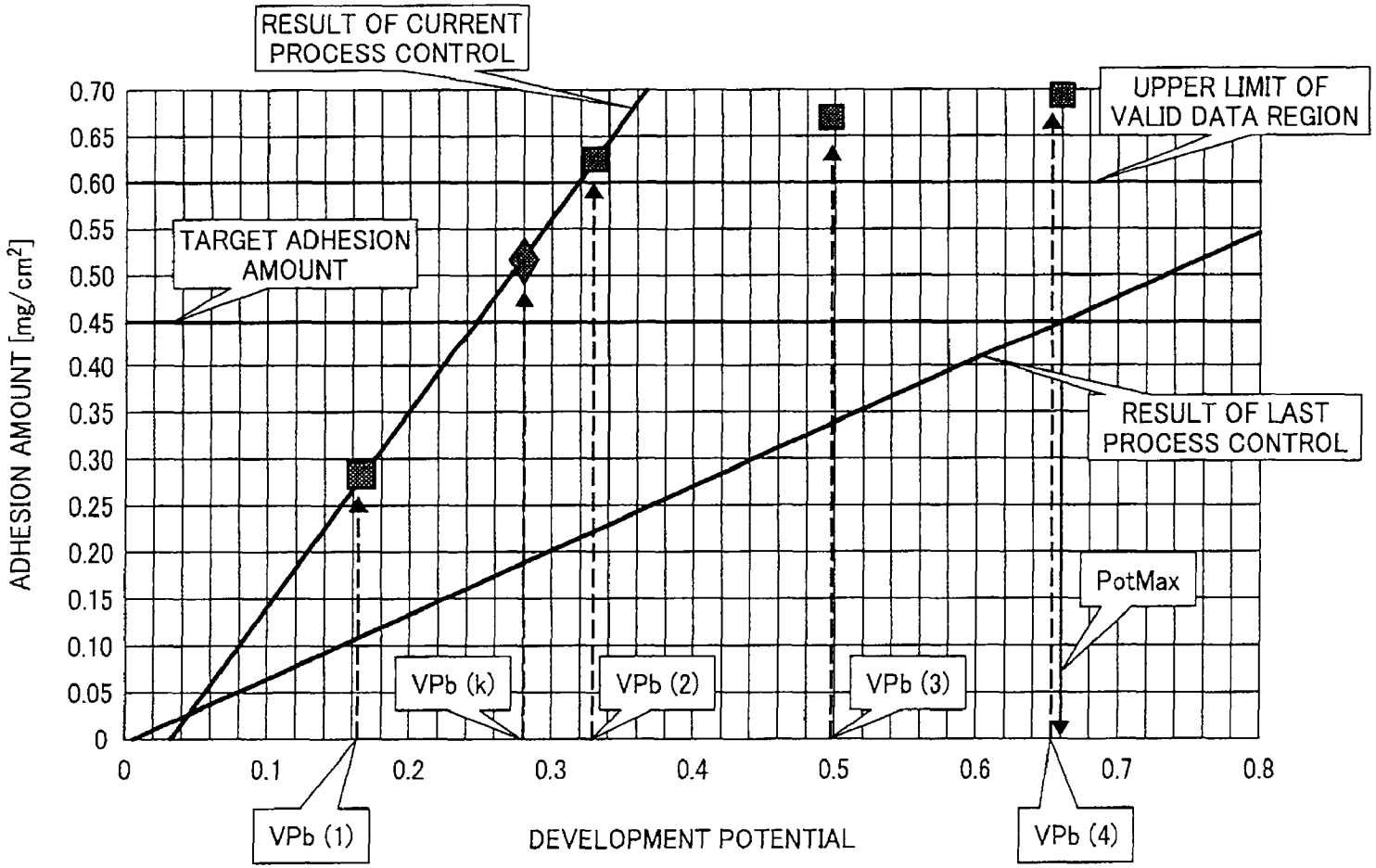
FIG. 10 illustrates an exemplary toner attraction amount of a grasp when development gamma widely increases in this time of process control from that of the last time according to the first embodiment of the present invention.

Now, effect of the first embodiment is specifically described with reference to FIGS. 9 and 10. FIG. 9 illustrates an exemplary toner attraction amount of a gradation sequence pattern of the first embodiment when a difference of a development gamma between last and this time of process controls is not large. Whereas, FIG. 10 illustrates an exemplary toner attraction amount of a gradation sequence pattern of the first embodiment when the development gamma in this time of the process control widely increases. A black square mark in FIGS. 9 and 10 illustrates toner patches formed based on a development bias determined in the last process control. A black rhomboid mark illustrates toner patches formed based on the predetermined development bias. When the development gamma between the last time and this time of the process control is not largely different as illustrated by the black square mark of FIG. 9, all of the toner patches formed based on a development bias calculated based on the development bias Vb determined in the last process control can enter a valid data range. The valid data range represents a region of high sensitivity for the optical sensor in which the development potential and data of the toner attraction amount shows linearity. Thus, a number of the toner patches detected by the sensor increases and performance info, such as development gamma, etc., can be precisely obtained even though a small number of toner patches are used.

However, when a development gamma of this time of process control widely increase than that of the last process control, only toner patches on a low toner attraction amount side among those formed based on a development bias (calculated?) based on the development bias Vb determined in the last process control sometimes enter the valid data range. Especially, a performance of developer readily changes and a development gamma tends to widely change in an apparatus downsized by decreasing a capacity of a developing device for developer.

However, in the first embodiment, when a development gamma in this time of process control widely increases than that in the last process control as shown in FIG. 10, only toner patches on a low toner attraction amount side among those formed based on a development bias determined based on the development bias Vb determined in the last process control enters the valid data range. On the other hand, as shown by the black rhomboid mark in FIG. 10, toner patches formed based on a predetermined development bias enters the valid range even though a development gamma in this time of process control widely increases than that in the last process control. Thus, more than two toner patches can enter the valid range even though a development gamma in this time of process control widely increases than that in the last process control. As a result, both of a development gamma and a development start voltage Vk can be obtained and accordingly a development bias Vb can be calculated even though a development gamma in this time of process control widely increases than that in the last process control.

Figure 11:
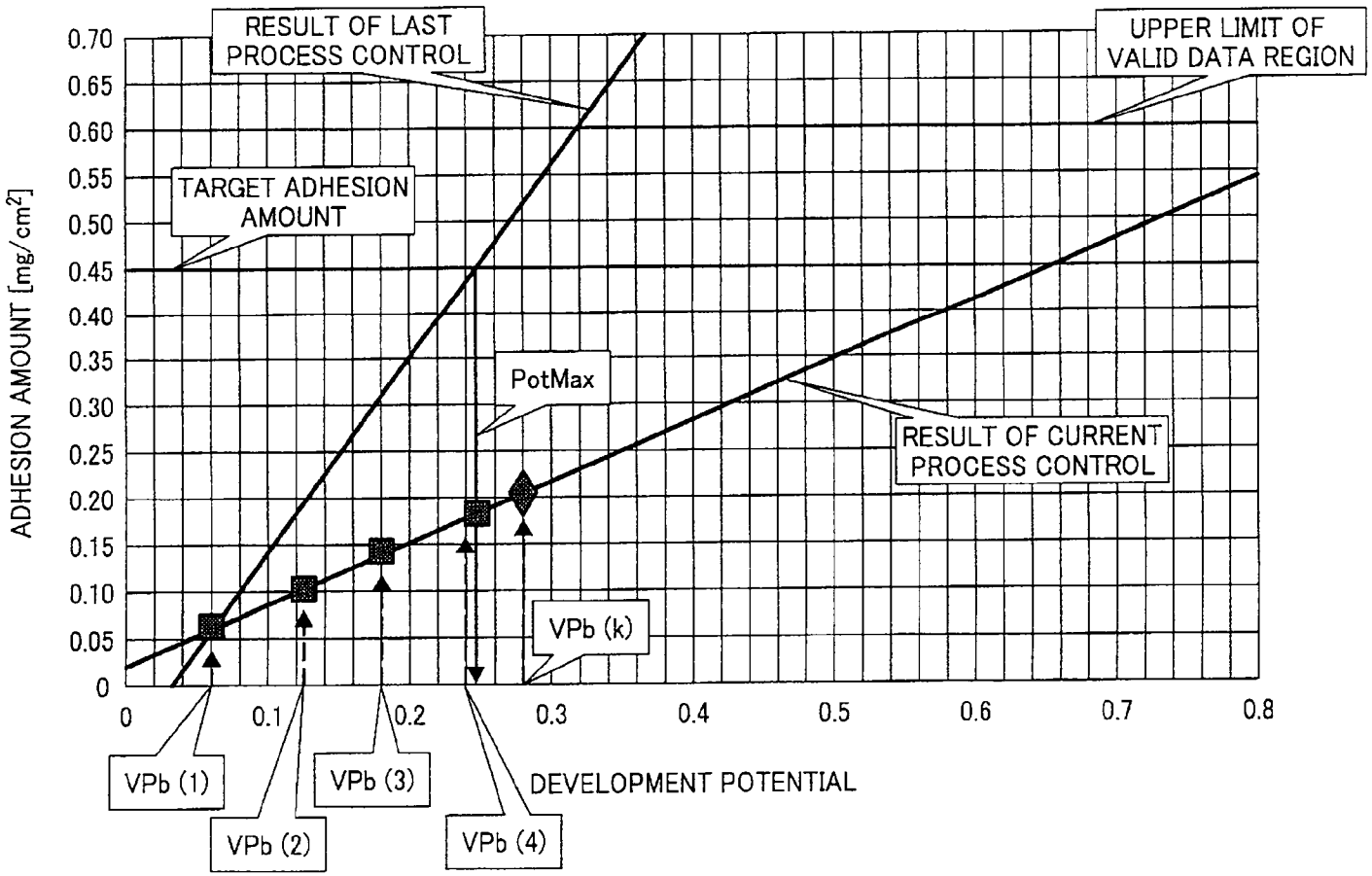
FIG. 11 illustrates an exemplary toner attraction amount of a grasp when development gamma widely decreases in this time of process control from that of the last time according to the first embodiment of the present invention.

Further, as shown in FIG. 11, a toner attraction amount of each of toner patches of a gradation sequence pattern concentrates on a low toner attraction amount side, when a development gamma in this time of process control widely decreases than that in the last process control. As a result, precision of development gamma is readily affected by unevenness of a toner attraction amount and possibly deteriorates. In view of this, when the development gamma is small, a number of toner patches formed based on a fixed development bias capable of increasing a toner attraction amount (i.e., high density) can be increased.

Figure 12:
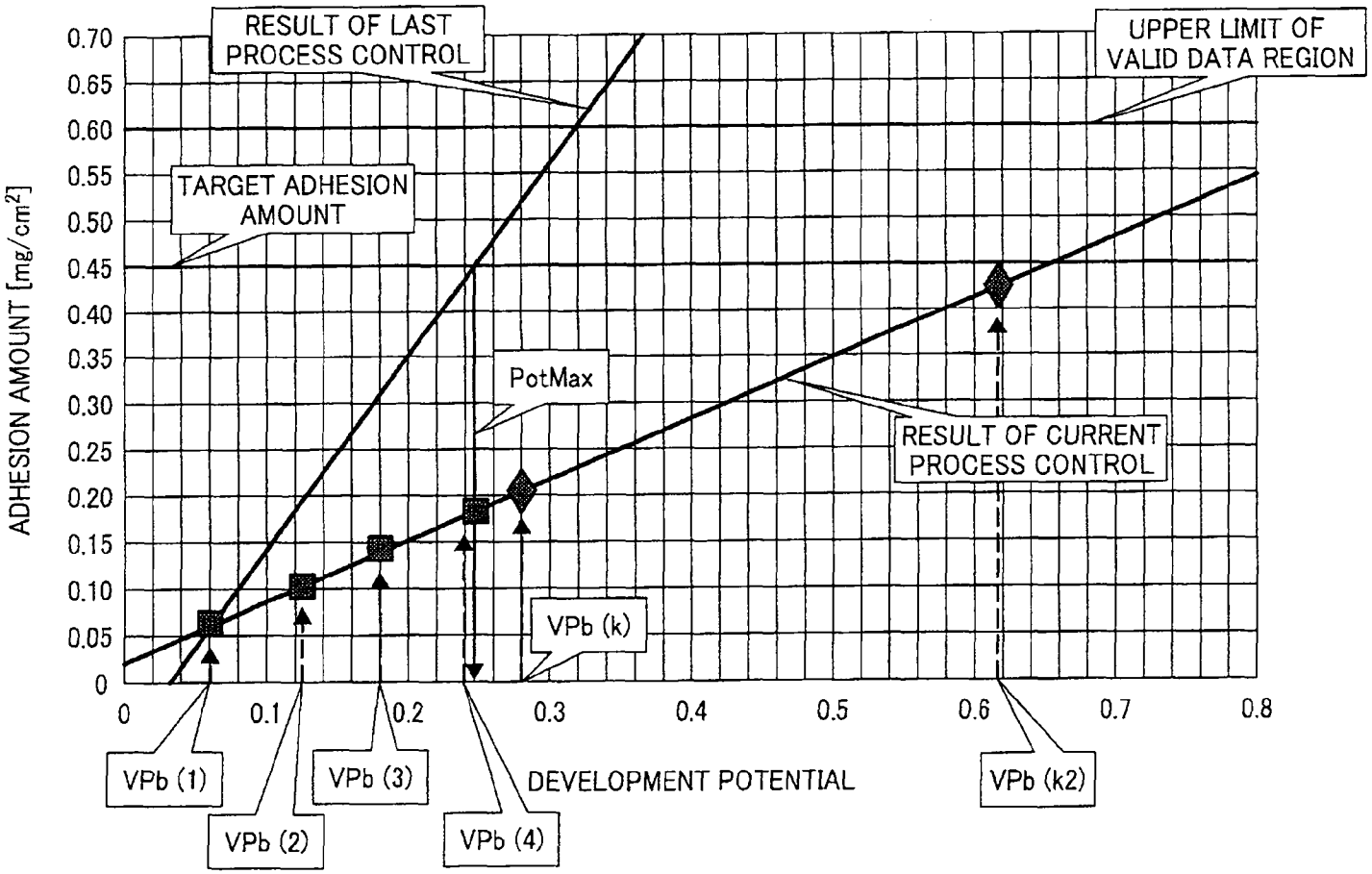
FIG. 12 illustrates an exemplary modification of the toner attraction amount of FIG. 11.

As shown in FIG. 12, by providing toner patches formed based on a prescribed (fixed) development bias Vpb (k1) enabling a toner attraction amount of the toner patches to enter the valid range when development gamma is large, and those formed based on a prescribed (fixed) development bias Vpb (k2) enabling those to have a high toner attraction amount entering the valid range when development gamma is small, the development bias Vb can be calculated even though a development gamma in this time of process control widely increases than that in the last process control.

In addition, one of the toner patches in the gradation sequence pattern can simultaneously be arranged on the high toner attraction amount side in the valid range even though a development gamma in this time of process control widely decreases than that in the last process control. As a result, influence of unevenness of the toner attraction amount can be reduced, and deterioration of precision of development gamma can be suppressed.

Now, the first embodiment is described more in detail. The maximum potential is obtained by the following calculation, when a number of toner patches included in a gradation sequence pattern is five, a number (k) of toner patches formed based on a prescribed development bias is one (i.e. k=1), a development bias (Vb) is 550V as a result of the last process control, a potential (Vl) of a solid image section after exposure is 50V, and an initial value (k) is 520V.

$$Potmax=550-50=500[V]$$

Each of the development bias forming each of the toner patches based on the development bias Vb obtained by executing the last process control is calculated as follows:

$$Vpb(1)=Potmax\times 1/4+Vl=500\times 1/4+50=175[V]$$

$$Vpb(2)=Potmax\times 2/4+Vl=500\times 2/4+50=300[V]$$

$$Vpb(3)=Potmax\times 3/4+Vl=500\times 3/4+50=425[V]$$

$$Vpb(4)=Potmax\times 4/4+Vl=500\times 4/4+50=550[V]$$

Further, each of the charge bias forming each of the toner patches based on the development bias Vb obtained by executing the last process control is calculated as follows when a background potential coefficient is zero and a background potential offset is 200V:

$$Vpc(1)=175+200=375[V]$$

$$Vpc(2)=300+200=500(V)$$

$$Vpc(3)=425+200=625[V]$$

$$Vpc(4)=550+200=750[V]$$

Further, a charge bias forming toner patches based on the prescribed development bias is calculated by the below described formula:

$$Vpc(k)=520+200=720[V]$$

When development gamma is calculated by forming a gradation sequence pattern based on the above-mentioned development bias and charge bias, the following data are obtained:

$$\text{Development gamma } (\gamma)=0.86[(mg/cm^2)/kV],$$

$$\text{Development start voltage } Vk=0.046[kV]$$

Further, the maximum development potential can be obtained using the formula 1-5.

A maximum development potential amounts to 0.567, when the target toner attraction amount is 0.45 mg/cm$^2$ and the development gamma and the development start voltage Vk are substituted. The development bias Vb amounts to 617V (i.e., Vb=617 [V]), because the development bias Vb is calculated as follows:

$$\text{Development bias } Vb=\text{Maximum potential}+\text{Potential } (Vl) \text{ of solid image section after exposure}$$

In this example, since development gamma is corrected to approach a target by adjusting a toner density in the developing device when the development gamma widely deviated from the target, the initial value serving as a development bias enabling a toner attraction amount to always enter a detectable range for an optical sensor within a variable range of the development gamma can be set high. Further, since the upper limit of the development bias Vb is 700V, at least two points among four of the toner patches formed based on the development bias Vb determined by the last process control can enter the detectable range even if the development gamma widely changes from lower to higher sites. This is because, the development bias for the four pts amount to 175V, 350V, 525V, and 700V, and accordingly, and two points of them are lower than the initial value Vpb (k) of 520V when the upper limit of the development bias Vb determined in the last process control amounts to 700V, and accordingly, these toner patches formed by 175V and 350V credibly enter the detectable range.

Thus, in this example, since even if the initial value Vpb is neglected, two points of the toner attraction amount credibly enter the detectable range, the development gamma can be calculated even if the development gamma widely increases than before.

In addition, by forming toner patches formed based on the initial value Vpb, it becomes possible to credibly enter three points of the toner attraction amount within the detectable range and to precisely calculate the development gamma even if the development gamma widely increases than before. The initial value (k) of Vpb can be less than 520V.

However, when the initial value (k) of Vpb is set a higher as possible, toner patches formed based on the Vpb initial value (k) can be arranged on the high toner attraction amount site even when the development gamma widely changes from higher to lower sites Now, the second embodiment for forming each of toner patches constituting a gradation sequence pattern using an exemplary development bias and a charge bias is described. In the second embodiment, some of the toner patches are formed based on a prescribed development bias determined from environment such as temperature/humidity, etc., while the other toner patches are formed based on a development bias calculated based on the development bias Vb determined in the last process control.

Figure 13:
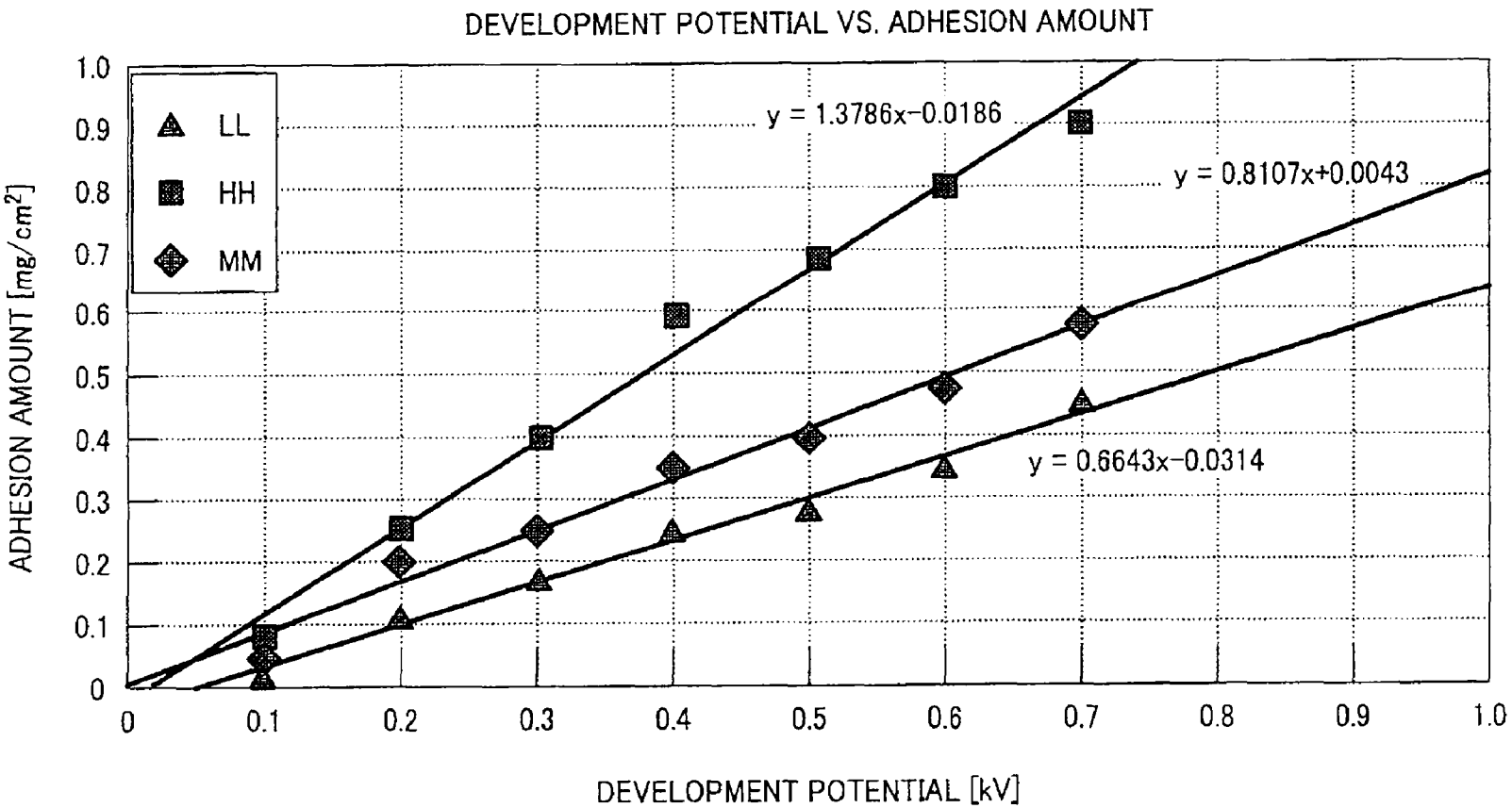
FIG. 13 illustrates an exemplary relation between a development potential and a toner attraction amount in a different environment.

FIG. 13 illustrates a relation between a development potential and a toner attraction amount in each of environments. As shown, in comparison with MM environment (i.e., a standard environment condition of 23° C. and 50% RH), development gamma increases in a high temperature and humidity environment of 27° C. and 80% RH. This is because, since humidity in the developing device increases, a lot of water is present around toner, and electrode of the toner becomes readily disposed by the influence of the water. As a result, the toner charge amount decreases and the development gamma increases. Whereas since electrode of the toner becomes hardly disposed and the charge amount increases due to small amount of the water in the developing device in LL environment (i.e., a low temperature and humidity environment condition of 10° C. and 15% RH, the development gamma decreases in comparison with that in the MM environment.

In this way, since the development gamma changes in accordance with a change of environment, the development gamma widely changes when the environment widely changes in this time of process control from that in the last process control. As a result, as mentioned above, only toner patches on the low toner attraction amount site among those formed based on the development bias calculated in the last process control sometimes enter the valid range or data of a toner attraction amount concentrates on the lower toner attraction amount site. Then, according to the second embodiment, at least one toner patch of a gradation sequence pattern is formed based on a prescribed development bias determined from the environment.

Specifically, similar to the first embodiment, the control section 100 determines a development bias Vpb (n) and a charge bias Vpc (n) for forming each of toner patches included in a gradation sequence pattern based on a development bias Vp obtained in the last process control.

The, the control section 100 obtains a value of a temperature humidity sensor 104 and determines a development bias Vpb (e) forming a toner patch based on the environment using the formula 1-6. In the formula, the environment correction coefficient represents a coefficient changeable depending on the value of the temperature humidity sensor 104, and is listed on a LUT (Look Up Table) in correspondence with an output value of the temperature humidity sensor stored in a non-volatile memory, such as RAM, etc. Specifically, an environment correction coefficient used for calculation is determined based on the thus acquired value with reference to the LUT.

Further, a LUT including correspondence between outputs of the temperature humidity sensor and the above-mentioned outputs can be provided and a development bias Vbp (e) can be determined from the output value of the temperature humidity sensor without multiplying the environment correction coefficient.

When having determined the development bias Vpb (e) forming toner patches in accordance with the environment, the control section 100 adds a prescribed value (e.g. 100V to 200V) to the thus determined development bias vpb (e) and determines a charge bias Vpc (e) forming the toner patches in accordance with the environment.

Figure 14:
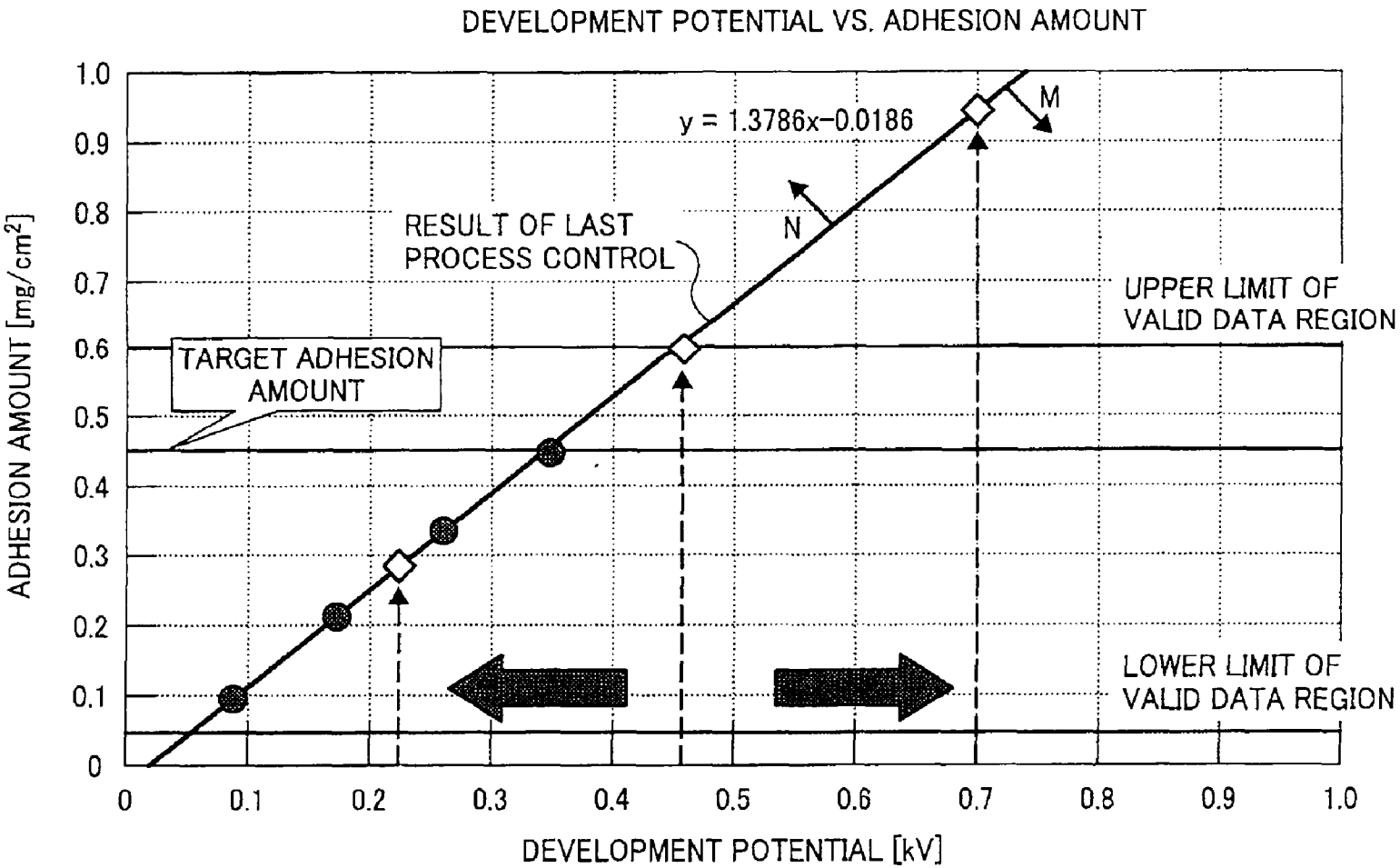
FIG. 14 illustrates an exemplary gradation sequence pattern according to a second embodiment of the present invention.

In the LL environment, the development gamma is predicted to move in a direction shown by an arrow M in FIG. 14 and decreases in comparison with that in the last process control. Thus, the development bias Vpb (e) forming the toner patches is increased in accordance with the environment by increasing the environment correction coefficient. Thus, even if the development gamma widely decreases due to the environment in comparison with that of before, the toner patches formed based on the development bias in view of environment have a high toner attraction amount. As a result, deterioration of precision of the development gamma can be suppressed even though the toner patches formed based on the development bias calculated in the last process control concentrates on the lower toner attraction amount site.

Whereas in the HH environment, the development gamma is predicted to move in a direction shown by an arrow N in FIG. 14 and widely increases in comparison with that in the last process control. Thus, the development bias Vpb (e) forming the toner patches is decreased in accordance with the environment by decreasing the environment correction coefficient.

Thus, even if the development gamma widely decreases due to the environment in comparison with that of before, a toner attraction amount of the toner patches formed based on the development bias in view of environment can enter the valid range. As a result, the development gamma can be calculated even though only one toner attraction amount of the toner patches formed based on the development bias calculated in the last process control enters the valid range.

Thus, in the first embodiment, at least two points of toner patches are necessarily formed based on the prescribed fixed development bias to handle both cases when the development gamma widely increases and decreases. However, the second embodiment can handle the both cases and is accordingly capable of decreasing a number of toner patches than that in the first embodiment.

Now, the third embodiment for forming each of toner patches constituting a gradation sequence pattern using an exemplary development bias and a charge bias is described. In the third embodiment, some of the toner patches are formed based on a prescribed development bias calculated based on deterioration with age, while the other toner patches are formed based on a development bias calculated based on the development bias Vb determined in the last process control.

Figure 15:
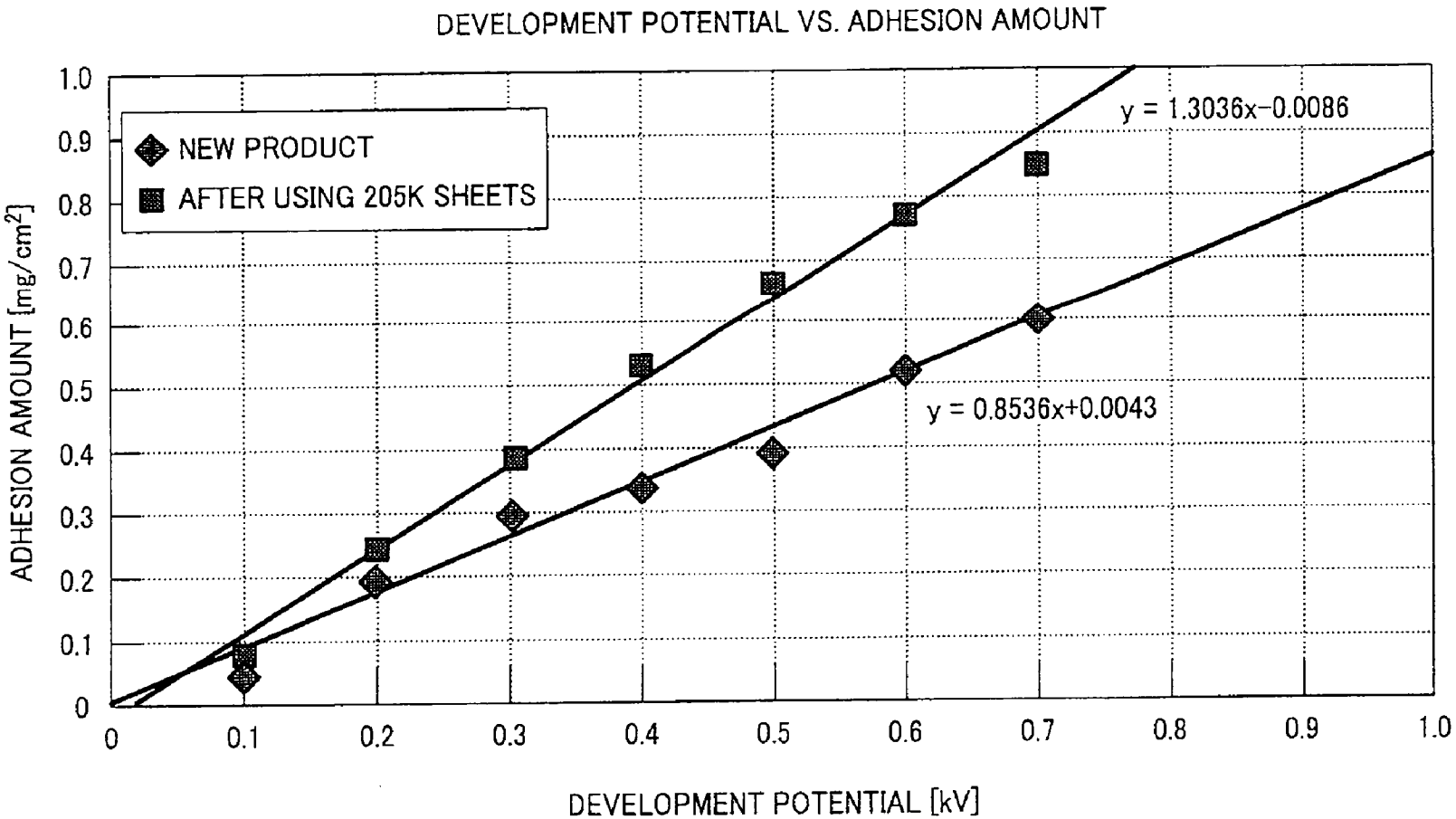
FIG. 15 illustrates an exemplary relation between a development potential and a toner attraction amount in each of cases when fresh developer and developer having been used for developing 205K copy sheets are used.
Figure 16:
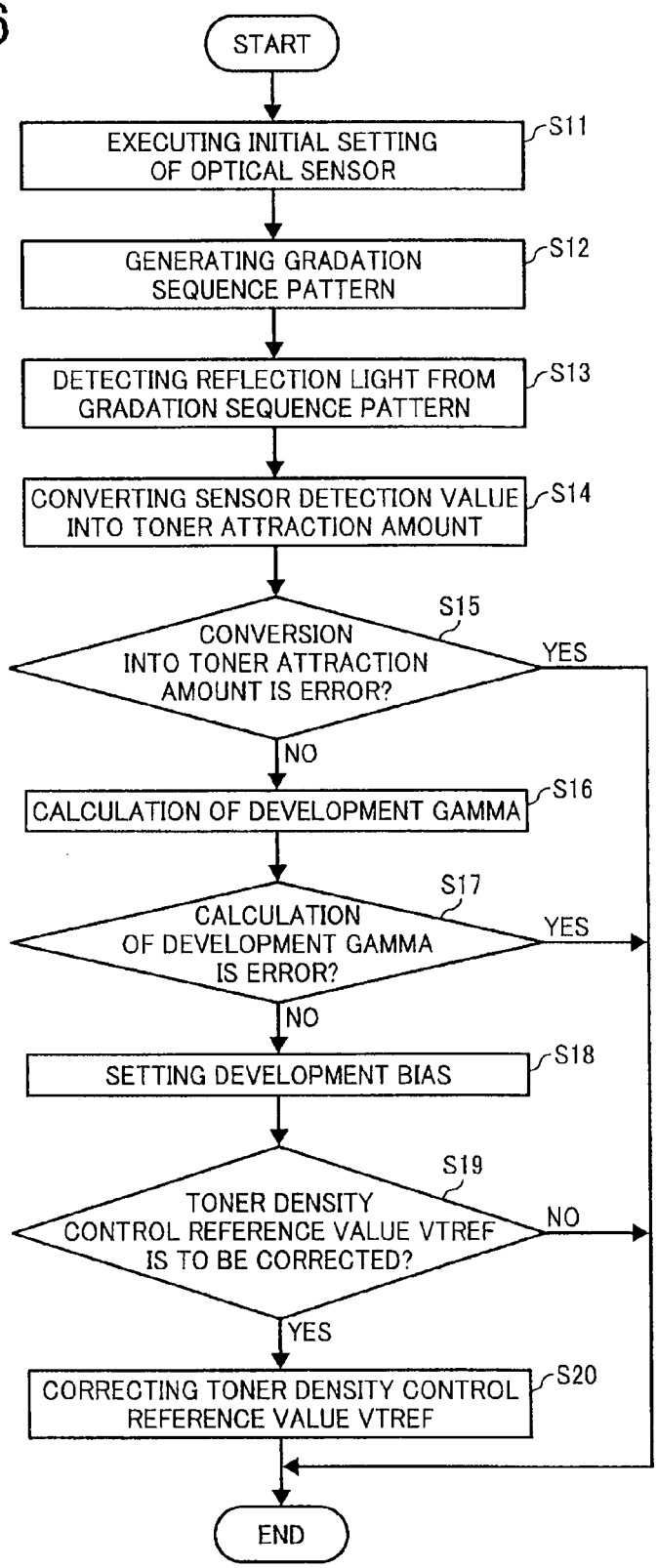
FIG. 16 illustrates another exemplary sequence of a process control.
Figure 17:
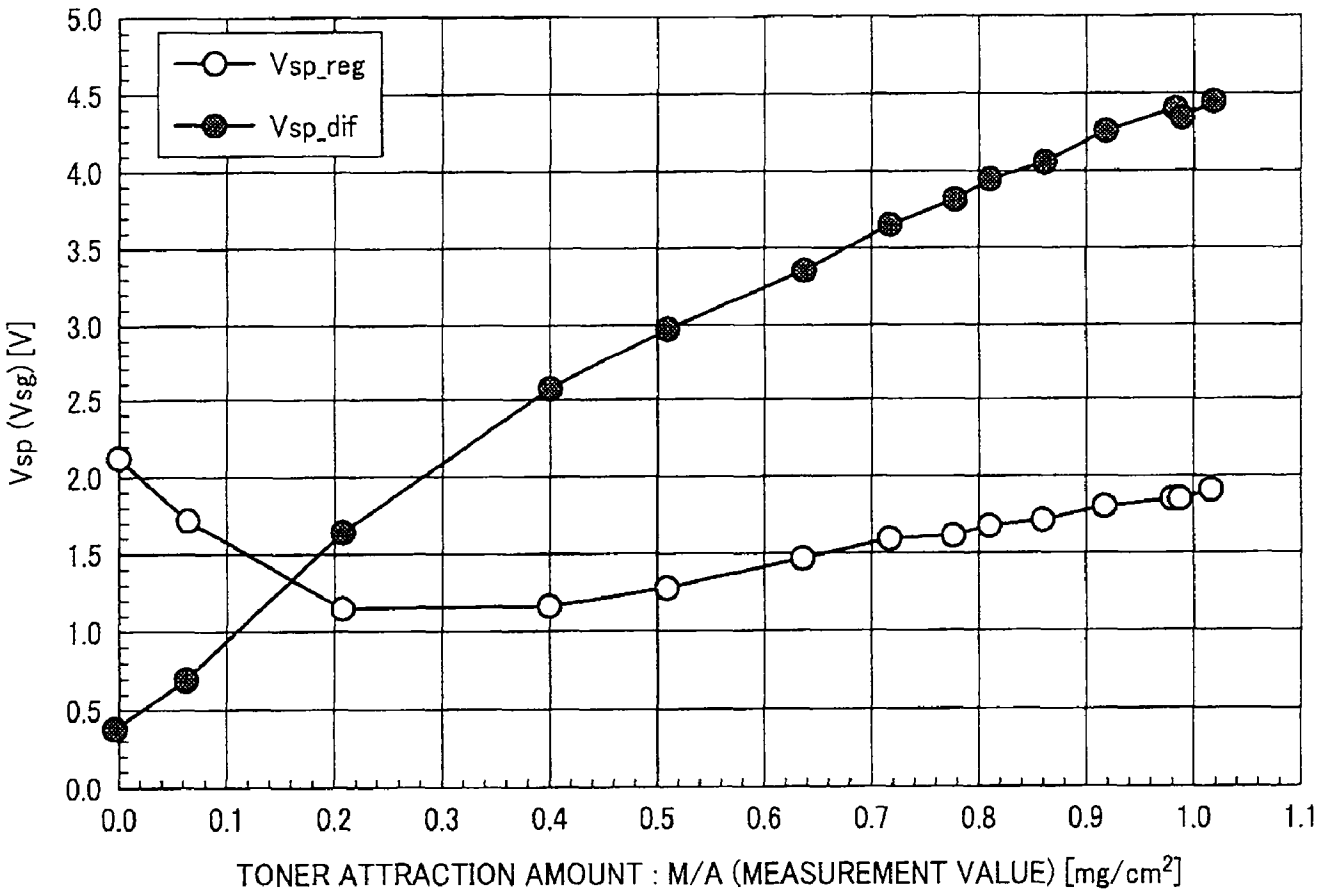
FIG. 17 illustrates an exemplary relation between an amount of toner attracting to a toner patch and Vsp or Vsg.
Figure 18:
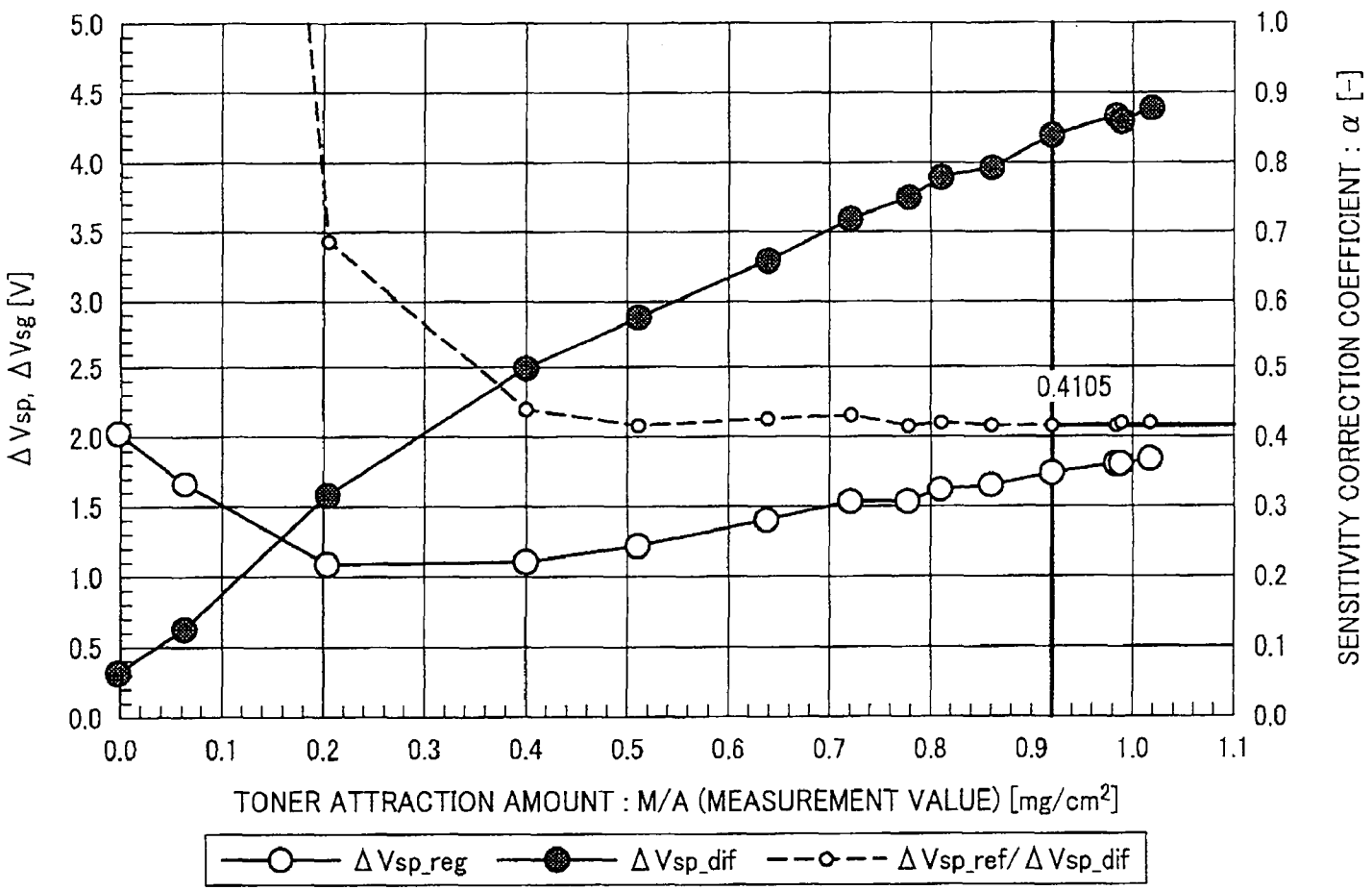
FIG. 18 illustrates an exemplary relation among an amount of toner attracting to a toner patch, delta Vsp or delta Vsg, and sensitivity correction coefficient η.
Figure 19:
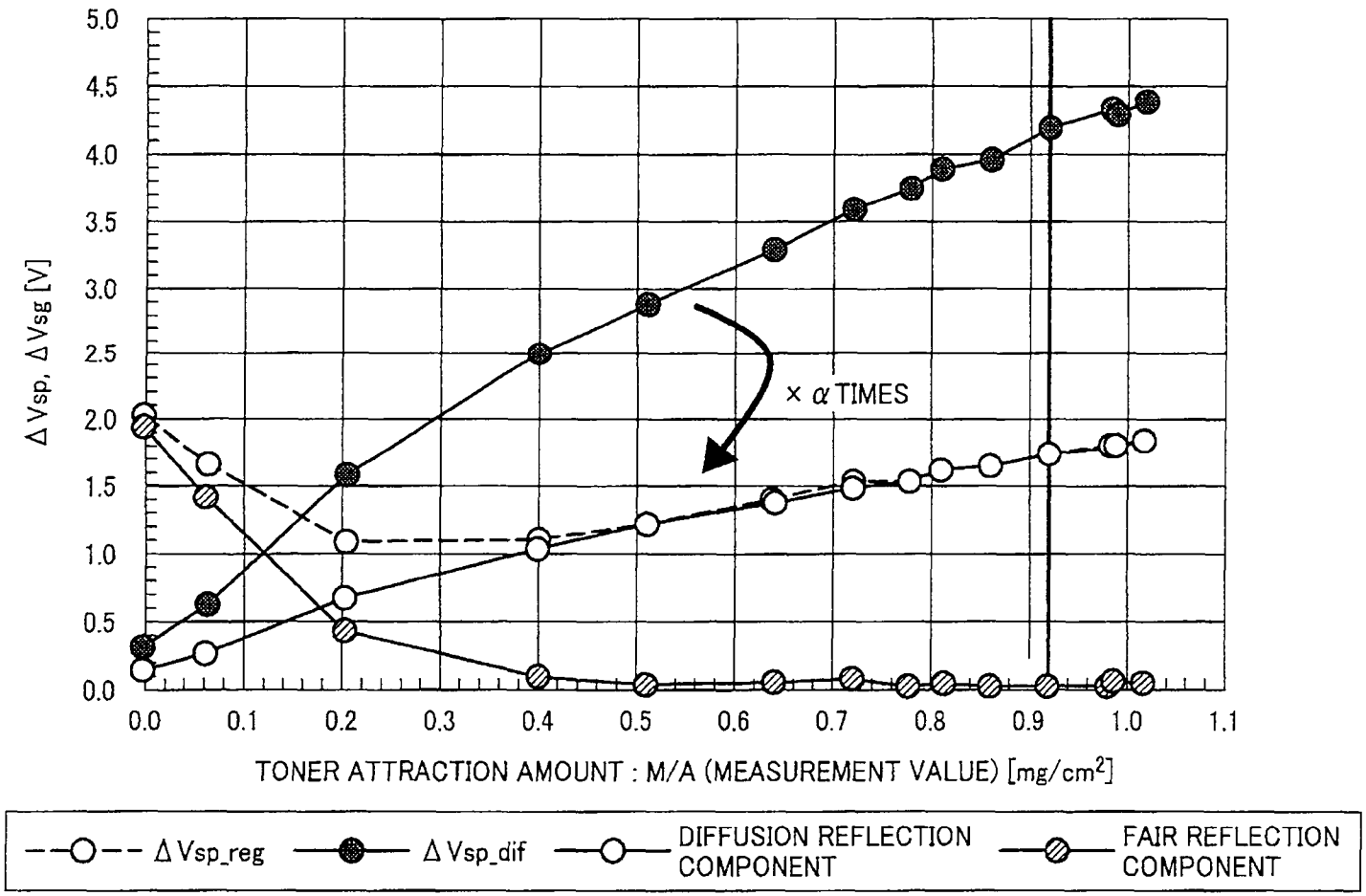
FIG. 19 illustrates an exemplary relation among an amount of toner attracting to a toner patch, a diffusion reflection component, and a fair reflection light component.
Figure 20:
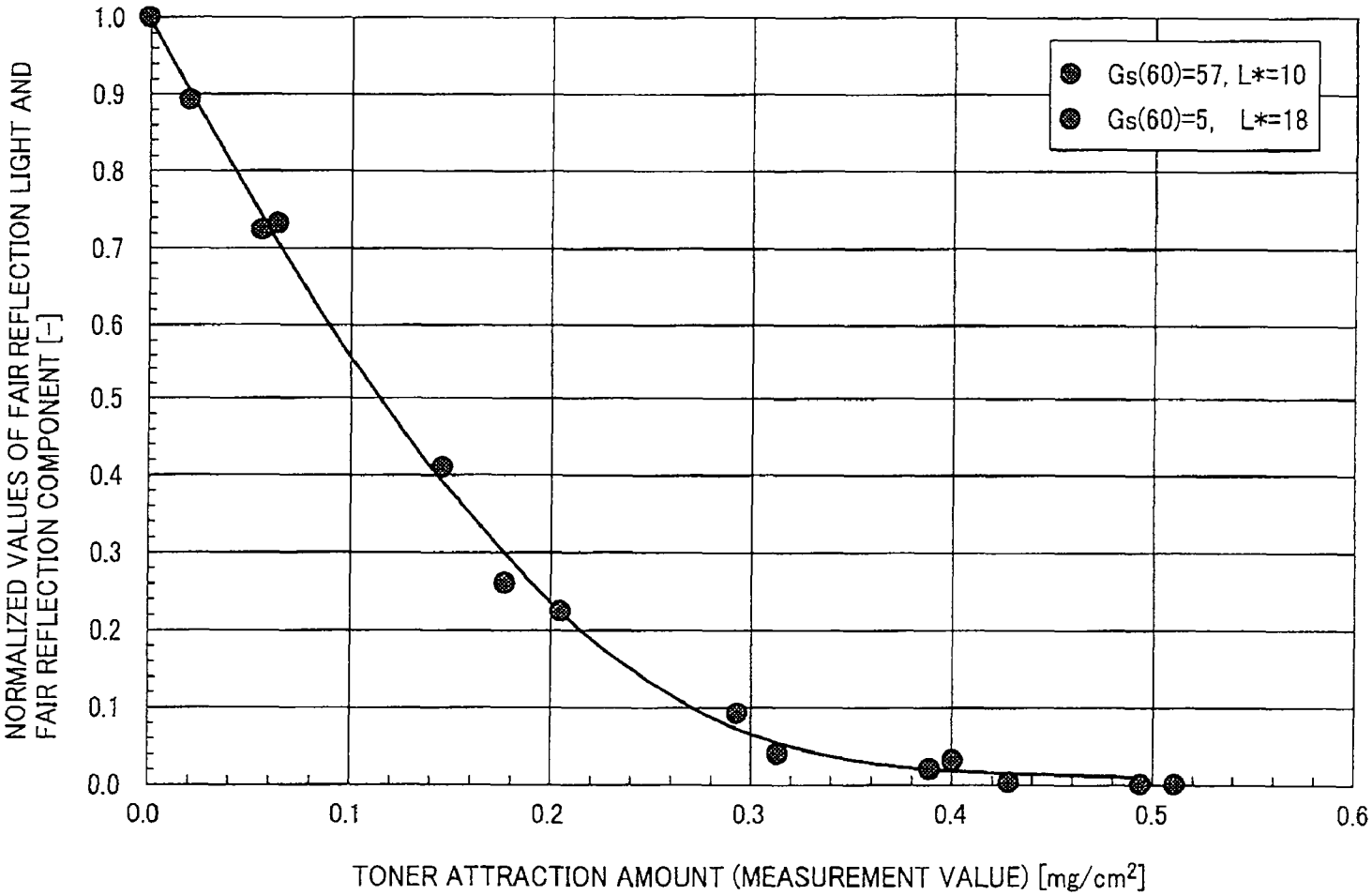
FIG. 20 illustrates an exemplary relation between an amount of toner attracting to a toner patch and a normalized value of the fair reflection component of the fair reflection light.
Figure 21:
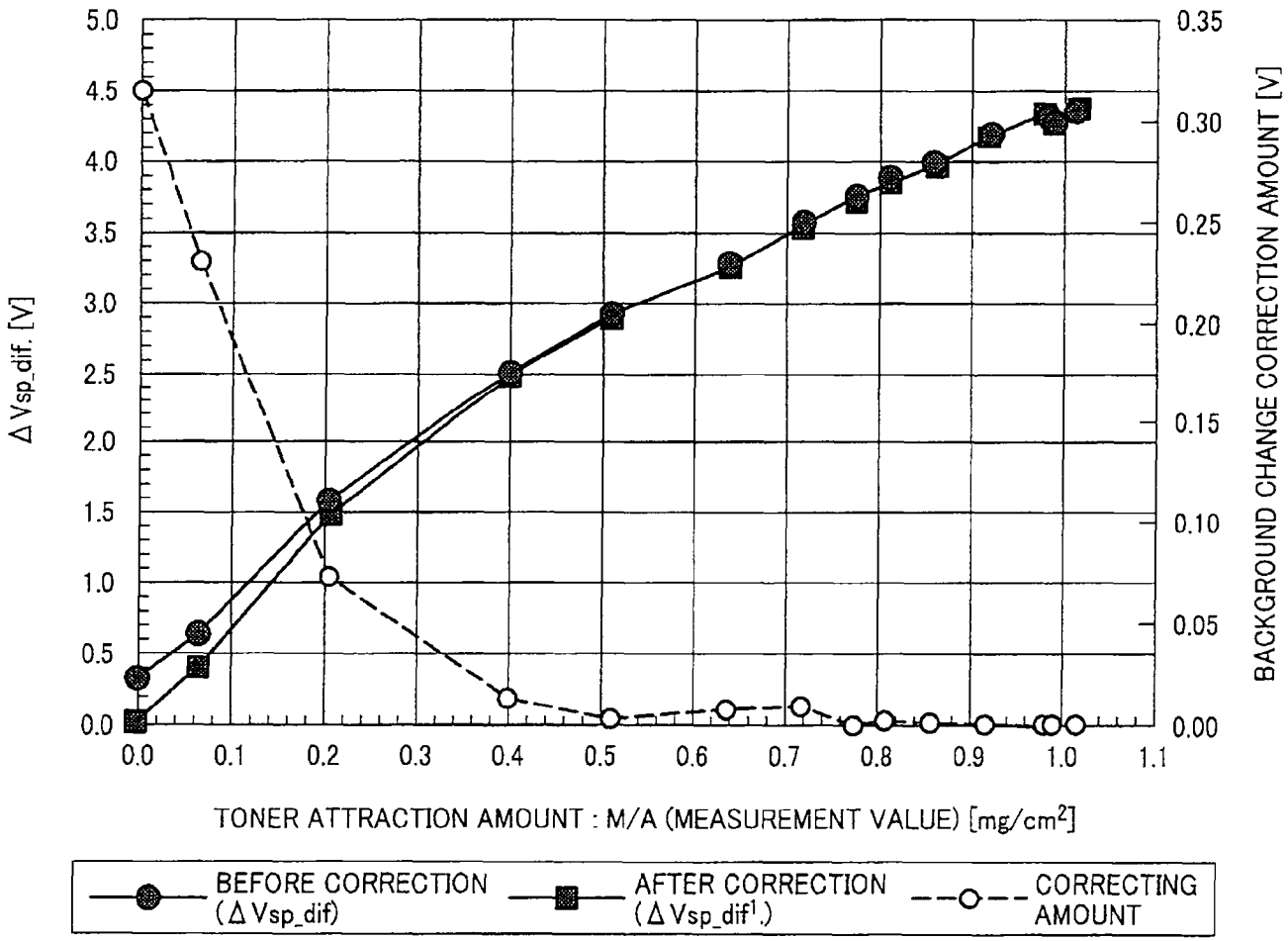
FIG. 21 illustrates an exemplary relation between an amount of toner attracting to a toner patch and delta Vsp_dif and a background correction amount.

FIG. 15 illustrates a relation between a development potential and a toner attraction amount in the cases when fresh developer is used and developer having been used for image formation of 250K sheets. As apparent from the drawing, the development gamma increases when the developer used in the 250K-image formation is used than when the fresh developer is used. This is because, due to time elapse, external additive either peels off or is embedded into the toner, fluidity or charge ability of the toner itself deteriorates. As a result, a charge amount of the toner decreases in the developing device due to deterioration of age, so that the development gamma increases. As a result, the developer with deterioration with age causes the development gamma to more widely increases than when the fresh developer is used when environment or the like changes. Thus, when already high development gamma due to the deterioration of the toner further widely increases due to a change of the environment or the like in the first embodiment in which some of toner patches of the gradation sequence pattern are formed based on the prescribed fixed development bias, a toner attraction amount of toner patches formed based on the prescribed fixed development bias possibly does not enter the valid range.

Then, according to the third embodiment, at least one toner patch of a gradation sequence pattern is formed based on a development bias determined in view of deterioration of age of developer.

Specifically, similar to the first embodiment, the control section 100 determines a development bias vpb (n) and a charge bias Vpc (n) forming each of toner patches included in a gradation sequence pattern based on a development bias Vp obtained in the last process control.

Then, the control section 100 determines a development bias forming the toner patch based on the deterioration of age. The control section 100 counts a number of rotations of a photoconductive member and stores a count value in a non-volatile memory, such as RAM, etc. When determining the development bias, the control section 100 acquires the rotation number of the photoconductive member from the memory and determines the development bias Vpb (c) for the toner patches formed in view of the deterioration of age using the formula 1-7.

In the formula, the time elapse correction coefficient represents a coefficient changeable depending on the rotation number of the photoconductive member, and is listed on a LUT (Look Up Table) in correspondence with a rotation number of the photoconductive member stored in a non-volatile memory, such as RAM, etc. Specifically, a time elapse correction coefficient used for calculation is determined based on the thus acquired value with reference to the LUT.

Further, a LUT including correspondence between a rotation number of the photoconductive member and a development bias Vpb (c) is provided, and a development bias Vbp (c) can be determined from the rotation number of the photoconductive member without executing calculation. Instead of the rotation number of the photoconductive member, a number of image formation sheets or an accumulated working time period can be used to recognize the deterioration of age.

When having determined the development bias Vpb (c) forming toner patches in accordance with the deterioration of age, the control section 100 adds a prescribed value (e.g. 100V to 200V) to the thus determined development bias vpb (c) and determines a charge bias Vpc (c) forming the toner patches in accordance with the deterioration of age.

As a number of rotation of the photoconductive member increases, the time elapse correction coefficient decreases, and accordingly, the development bias Vpb (c) forming the toner patches in view of the deterioration of the developer decreases. Thus, even if the developer deteriorates and a large development gamma tends to increase due to a change of the environment or the like, a toner attraction amount of toner patches formed based on the development bias determined based on the deterioration of the developer can enter the valid data range. As a result, the development gamma can be calculated even though only one toner attraction amount of the toner patches formed based on the development bias calculated in the last process control enters the valid range.

Further, some of the toner patches are formed based on a prescribed development bias determined in view of changes of the environment and deterioration of age, while the other toner patches are formed based on a development bias calculated based on the development bias Vb determined in the last process control.

Now, still another embodiment is described herein below. An exemplary essential part of an electric circuit included in the copier is described with reference to FIG. 5. A control section 100 includes a CPU 101, a RAM 102, and a ROM 103 and the like. To the control section 100, plural process units 10Y to 10K, the optical writing unit 68, the transfer unit 50, the optical sensor unit 69 and the like are connected. The control section 100 controls these devices based on control program stored in the ROM 103 or the RAM 102.

The control section 100 also adjusts an image formation condition for forming an image. Specifically, the control section 100 controls charge bias applied to each of charge members of the process units 1Y to 1K. Thus, the photoconductive members 2Y to 2K are uniformly charged to have prescribed drum charge voltages for respective colors Y to K. The control section 100 also separately controls each of four semiconductor lasers of the optical writing unit 68 corresponding to the respective process units 1Y to 1K. The control section 100 also controls development bias applied to each of the development rollers included in the process units 1Y to 1K of the respective colors. Thus, a development potential for electro statically moving a toner from the surface of the sleeve to the photoconductive member is provided between latent images on the photoconductive members 2Y to 2K and the development sleeve, and develops the latent images.

The control section 100 also executes a process control of controlling image density for providing an appropriate image density of respective colors each time when a power is supplied or a prescribed number of copies are printed as shown in FIG. 6, in which an exemplary sequence of the process control executed when the power is supplied is described.

Initially, the control section 100 executes initial setting for the optical sensor 69 in step S1. Specifically, a light generation intensity of the light generation unit 311 is adjusted so that an output of the fair reflection light acceptance unit 312 of the optical sensor 69 becomes a prescribed value (4V). However, initial setting can be omitted for the optical sensor 69.

Then, the control section 100 automatically forms gradation sequence patterns on the intermediate transfer belt 51 at positions opposing the respective optical sensors 69 for respective colors as shown in FIG. 7 in step S2.

Each of the gradation sequence patterns of the respective colors includes about five toner patches having a different toner attraction amount from the other, and has a length of 14.4 mm in a sub scanning direction at an interval of 5.6 mm and is arranged in the order of Bk to Y gradation sequence patterns on the intermediate transfer belt 51. The gradation sequence pattern is formed by changing charge and development bias conditions per toner patch with an exposure condition of a predetermined level capable of executing full exposure capable of sufficiently removing a charge from a photoconductive member. Operations of setting the development and charge biases for each of the respective toner patches in the gradation sequence patterns are mentioned later in detail. The gradation sequence patterns of respective colors on the intermediate transfer belt 51 are optically detected by the optical sensor 69 in step S3.

Then, the output value of the light acceptance unit obtained by detecting each of the toner patches in each of the gradation sequence patterns of respective colors is converted into a toner attraction amount (i.e., image density) by using toner attraction amount calculation algorithm established based on a relation between an toner attraction amount and an output value of a light acceptance unit.

In this embodiment, a toner attraction amount is calculated using a fair reflection light fairly reflected from a toner patch and a diffusion reflection light as described in Japanese Patent Application Laid Open No. 2006-139180. By calculating the toner attraction amount using both of the fair reflection light and the diffusion reflection light, a detectable range capable of detecting a large toner attraction amount can be wider in comparison with that calculated using only the fair reflection light. Further, using toner attraction amount calculation algorithm of the Japanese Patent Application Laid Open No. 2006-139180, a toner attraction amount can be precisely obtained even if outputs of a light generation element and a light acceptance unit change due to deterioration with age or a change of temperature.

Now, exemplary toner attraction amount calculation algorithm according to one embodiment of the present invention is described below, wherein Vsg represents an output voltage (i.e., a background detection voltage) transmitted from an optical sensor that detects a background of a transfer belt. Vsp represents an output voltage (i.e., a patch detection voltage) transmitted from the optical sensor that detects respective reference patches. Voffset represents an offset voltage (i.e., an output voltage when an LED is turned off). "_reg" represents a fair reflection light output (i.e., abbreviation of Regular Reflection). "_dif" represents a diffusion reflection light output (i.e., abbreviation of Diffusion Reflection), which relates to a color standardized by JIS Z 8105. "n" (factor number) represents alignment parameter of n.

Initially, toner attraction amount calculation algorithm for K toner is described. First, an offset voltage is subtracted from a fair reflection light using below described formulas;

$$\text{Delta } Vsg_reg(K)(n) = Vsg_reg(K)(n) - V\text{offset}_reg$$

$$\text{Delta } Vsp_reg(K) = Vsg_reg(K) - V\text{offset}_reg(K)$$

Second, fair reflection light data is normalized as follows:

$$\text{Normalized value } Rn(K) = \text{Delta } Vsg_reg(K)(n)/\text{Delta } Vsp_reg(K)$$

Third, the normalized value is converted into a toner attraction amount using the LUT (Look Up Table). The toner attraction amount is obtained by previously creating an toner attraction amount conversion table corresponding to a normalization value and referring thereto.

Now, color toner attraction amount calculation algorithm is described. The color toner attraction amount is calculated by executing seven steps of processing as mentioned below.

In step 1, data sampling is executed and delta Vsp and delta Vsg are calculated. Initially, a difference from an offset voltage is calculated for all of n numbers of reference patches beside a fair reflection light output and a diffusion reflection light output, so that an increasing amount of an output of a sensor is preferably finally represented only by a difference of increase of an toner attraction amount of color toner.

The increase of the fair reflection light output is obtained by the formula 1 as illustrated in FIG. 30A. The increase of the diffusion reflection light output is obtained by the formula 2 as illustrated in FIG. 30A. Such a difference processing can be omitted if an operation amplifier, in which an offset output voltage (Voffset_reg, Voffest_dif) is a sufficiently small and negligible level, is employed. As a result, a performance curvature is obtained in step 1 as shown in FIG. 14.

Figure 25:
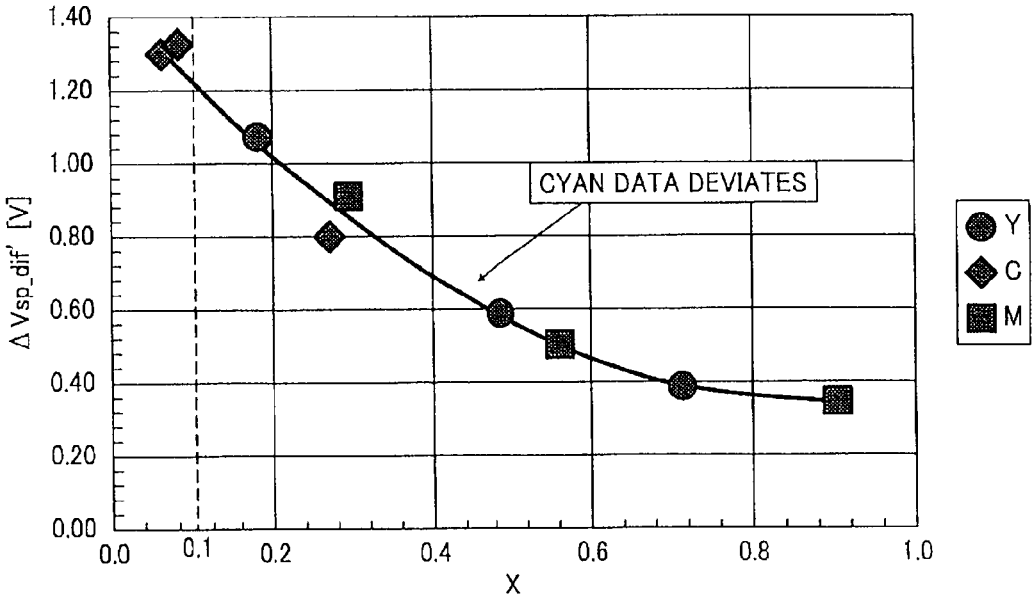
FIG. 25 illustrates an exemplary graph showing plots representing detection data of toner patches of respective colors when a sensitivity correction coefficient η is calculated while development gamma for Cyan widely significantly increases after execution of the last process control.

In step 2, a sensitivity correction coefficient alpha is calculated. First, based on delta Vsp_reg. (n) and delta Vsp_dif. (n), delta Vsp_reg. (n)/delta Vsp_dif. (n) is calculated per reference patch. Then, the sensitivity correction coefficient alpha to be multiplied to the diffusion light output (delta Vsp_reg. (n)) of delta Vsp_reg. (n) when the fair reflection light output is divided into components using the formula 3 as shown in FIG. 30A as mentioned later in detail in step 3. As a result, a performance curvature is obtained in step 2 as shown in FIG. 25. The sensitivity correction coefficient alpha is the minimum among the delta Vsp_reg. (n) and the delta Vsp_dif. (n). Because, it is previously known that the minimum value of the fair reflection component of the output of the fair reflection light is substantially zero and positive.

Figure 26:
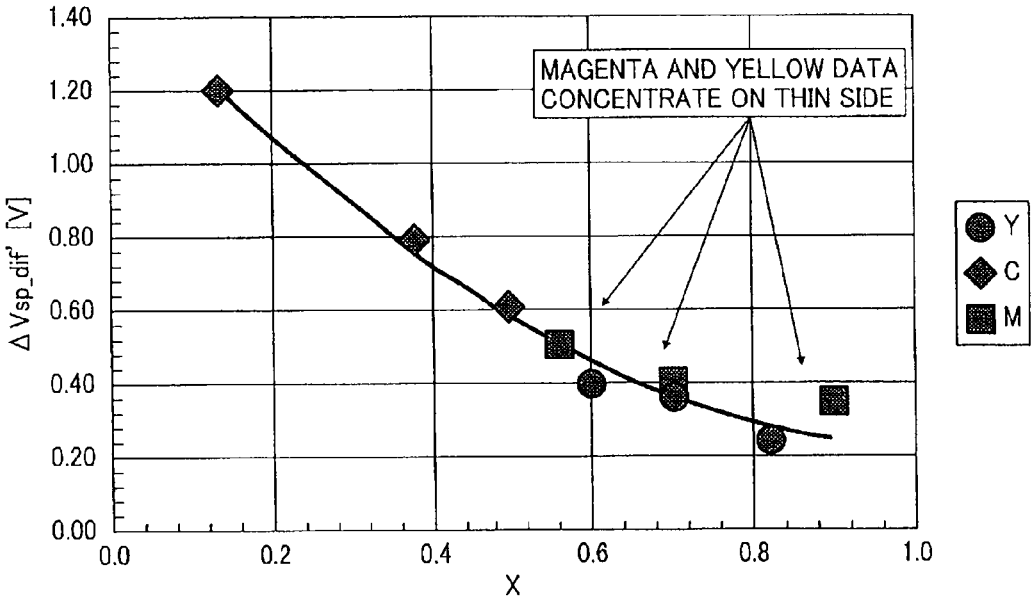
FIG. 26 illustrates an exemplary graph showing plots representing detection data of toner patches of respective colors when the gradation sequence patterns of all colors are formed under fixed development biases and a sensitivity correction coefficient η is calculated while development gamma for Cyan widely increases as expected after execution of the last process control.

In step 3, the fair reflection light is divided into components. A diffusion light component of an output of the fair reflection light is calculated using the formula 4 as shown in FIG. 30A: Further, a fair reflection light component of the output of a fair reflection light is calculated using the formula 5 as shown in FIG. 30A: As a result of executing the component resolution in this way, the fair reflection light component of the fair reflection light output becomes zero at a patch detection voltage where the sensitivity correction coefficient alpha is obtained. Further, as illustrated in FIG. 26, the fair reflection light output is divided into components of the fair reflection light and the diffusion light.

In step 4, the fair reflection light component of the fair reflection light output is normalized.

Figures 27, 28:
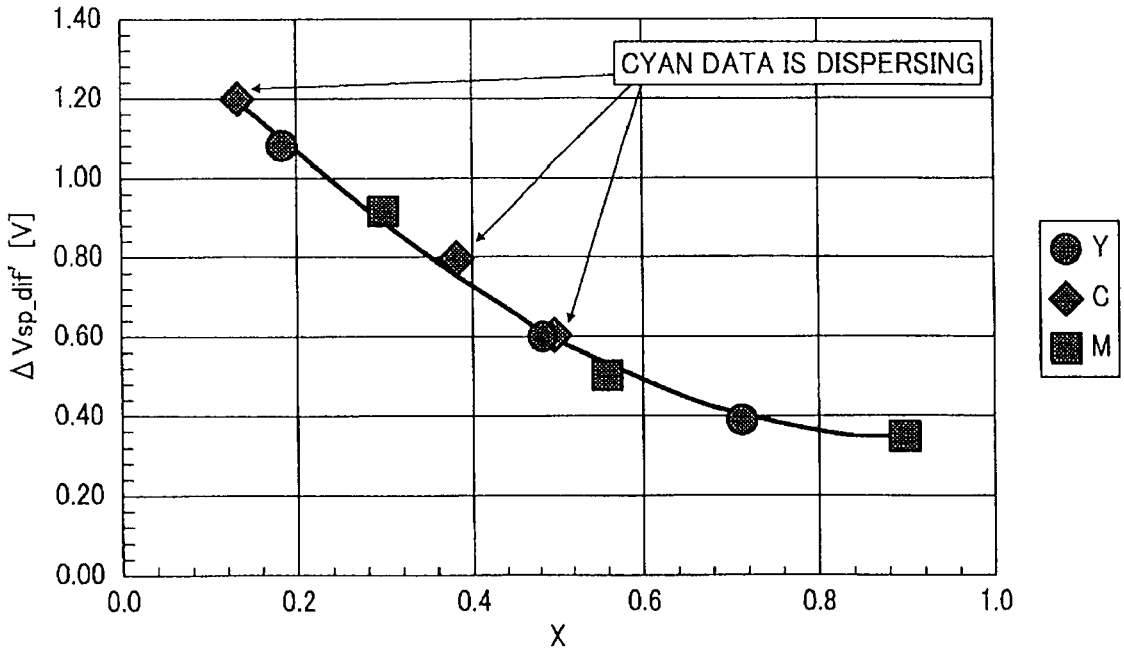
FIG. 27 illustrates an exemplary graph showing plots representing detection data of toner patches of respective colors when the gradation sequence pattern of only Cyan is formed under fixed development biases and a sensitivity correction coefficient η is calculated while development gamma for Cyan widely increases after execution of the last process control as expected.
FIG. 28 illustrates an exemplary look up table.

Specifically, using the formula 6, a ratio between a detection voltage of each patch and a background detection voltage is obtained and is converted into a normalized value of from zero to one. As a result, a performance curvature is obtained in step 4 as shown in FIG. 27.

In step 5, a background correction is executed for removing a diffusion light as a noise from a background from a diffusion light output.

Initially, using formula 7, a diffusion light output component obtained from a belt background is removed from a diffusion light output voltage. As a result, an influence of the background of the intermediate transfer belt 10 can be removed. Thus, in a low toner attraction amount region where a fair reflection light output has sensitivity, the diffusion light component directly reflected from the belt background can be removed from the diffusion light output. Then, a corrected diffusion light output is converted into a value having a first order linear relation with a toner attraction amount starting from zero to one layer formation while passing through the original point as shown in FIG. 28.

In step 6, a sensitivity of a diffusion light output is corrected. Specifically, as shown in FIG. 31, a diffusion light output after a background correction is plotted in relation to a normalized value of a fair reflection component of a fair reflection light. Then, a sensitivity of the diffusion light output is obtained by approximating a plotted line and is corrected to be a prescribed level.

Then, a plot line formed by plotting a diffusion light output after a background correction in relation to a normalized value of (a fair reflection component of) a fair reflection light is approximated by multi formulas (e.g. secondary formula approximation), thereby a sensitivity correction coefficient $\eta$ is calculated. Specifically, the plot line is approximated by the secondary approximation formula ($y=\xi 1x2+\xi 2x+\xi 3$), and coefficients $\xi 1$, $\xi 2$, and $\xi 3$ are obtained by applying a minimum square method, wherein m represents a number of data, x(i) represents a normalized value of a fair reflection light_a fair reflection component, and y(i) represents a diffusion light output subjected to background correction. A range of x used in calculation is as follows:

$$0.1 \leqq x \leqq 1.0$$

By calculating the above listed simultaneous equation, the coefficients $\xi 1$, $\xi 2$, and $\xi 3$ can be obtained.

Then, a prescribed sensitivity correction coefficient $\eta$ enabling a normalized value "a" calculated from the thus plotted approximation line to become "b" is obtained.

Correction is made so that a prescribed relation is established between an toner attraction amount and a diffusion output by multiplying the diffusion light output subjected to the background correction obtained in step 5 and the sensitivity correction coefficient $\eta$ obtained in step 6.

In step 7, an output value of a sensor is converted into a toner attraction amount. Specifically, since a change in the diffusion reflection output caused with age by decrease in intensity of a LED is entirely corrected by a process up to step 6, the output value of the sensor is finally converted into the toner attraction amount with reference to the toner attraction amount conversion table.

However, as shown in FIG. 31, when not more than two plots of diffusion light outputs, which have been subjected to background correction, exist within a range of a normalized value of a fair reflection light_fair reflection component used for calculation of the above-mentioned sensitivity correction coefficient $\eta$ in relation to a normalized value of a fair reflection component of a fair reflection light, a sensitivity correction coefficient $\eta$ can not be calculated. As a result, conversion to the toner attraction amount is impossible. Thus, when calculation of the toner attraction amount results in error (Yes, in step S5), the process control is terminated without changing a development bias Vb or the like. Otherwise, prescribed processing can be executed to minimize an interval before the next process control.

When the toner attraction amount for respective toner patches can be calculated using the toner attraction amount calculation algorithm (No, in step S5), a development potential/toner attraction amount straight line ($y=ax+b$) approximated by the minimum square method is obtained per color based on a relation between the amount of toner attracting to each toner patch and a development potential used when each of toner patches is formed as shown in FIG. 8. Development gamma (i.e., an inclination "a") representing a developing ability and a development start voltage Vk (an intersept "b") are calculated per color based on the development potential/toner attraction amount straight line in step 6. Instead of the liner approximation, secondary approximation can be employed wherein development gamma is a differential value of a relational expression of a plot line.

The process control is terminated without changing the development bias Vb regarding that calculation of the development gamma is failed (Yes, in step S7) when an toner attraction amount of almost all of toner patches is deviated from the high sensitivity region of the optical sensor 69*e* other than one data. Thus, the development gamma cannot be calculated when the calculated development gamma is significantly large or small in relation to a generally supposed change.

When the calculation of the development gamma is successful (No, in step S7), the control section 100 specifies a development potential necessary for obtaining a prescribed target toner attraction amount based on the development gamma, and calculates a development bias Vb matching with the development potential in step S7. The target toner attraction amount is determined by a coloring level of toner pigment, and generally amounts to 0.4 to 0.6 mg/cm$^2$.

Further, the control section 100 determines a charge bias Vc based on the calculated development bias Vb. A LD power is adjusted to amount between 80 to 120% in accordance with a charge potential, but is not described here in detail. The development bias Vb, the charge bias Vc, and the LD power are stored in a non-volatile memory, such as a RAM 102, etc. The charge bias Vc is generally set high than the development bias by 100 to 200 volt.

The development bias Vb is set to be 350 to 700 volt. Specifically, even when the calculated bias is 1 kV, the development bias Vb is set to be 700 volt. That is, when the setting value of the development bias exceeds 700 v, a capacity of a power supply is also exceeded, so that the bias possibly cannot be constantly maintained. When the setting value is not more than 350 v, the setting amount of charge bias decreases too much so that the charge tends to be uneven. As a result, an image formed last time appears on the next image as an abnormal image called image remaining.

When the development bias Vb is calculated, it is determined if a toner density control reference value Vtref needs to be corrected in step S9. Specifically, a differential delta gamma is obtained by subtracting a target development gamma from a calculated development gamma. When the calculated delta gamma falls within a prescribed range, the control section 100 determines that the toner density control reference value Vtref does not need to be corrected (No, in step S9), thereby terminating process control. When the calculated delta gamma does not fall within the prescribed range, the control section 100 determines that the toner density control reference value Vtref needs to be corrected (Yes, in step S9). Because, a developing bias Vb calculated in the next development bias adjustment possibly exceeds the above-mentioned setting range (350 to 700V). The toner density control reference value Vtref is not corrected when the following condition is met;

$$-0.30((\mathrm{mg/cm^2})/\mathrm{KV}) < \text{Delta gamma} < 0.30((\mathrm{mg/cm^2})/\mathrm{KV})$$

Whereas the toner density control reference value Vtref is corrected when the following condition is met;

$$\text{Delta gamma} \leqq -0.30((\mathrm{mg/cm^2})/\mathrm{KV}), \text{ or}$$

$$\text{Delta gamma} \geqq 0.30((\mathrm{mg/cm^2})/\mathrm{KV})$$

Although necessity of the correction is determined based on the development gamma in the above, a calculated development start voltage Vk can be based. In such a situation, when the calculated development start voltage Vk is either more than the upper limit or less than the lower limit, the toner density control reference value Vtref is corrected.

When the calculated delta gamma deviates from the prescribed range and it is determined that the toner density control reference value Vtref needs to be corrected, the toner density control reference value Vtref is corrected so that the development gamma can approximate a target level before the next process control in step S10. When the toner density control reference value Vtref is corrected to approximate the development gamma to the target level and an image is formed based on the calculated development bias, a toner attraction amount does not reach a target level.

However, since toner density in the developing device does not immediately reach the target level and a toner replenishing control is executed so that the toner density gradually reaches the target level in the developing device, the development gamma does not sharply change. Specifically, the target toner attraction amount can be obtained using the calculated development bias in the beginning of the correction of the toner density control reference value Vtref.

Then, the toner attraction amount gradually recedes from the target. An amount of correction of the toner density control reference value Vtref is set so that the toner attraction amount does not largely recede from the target level even when an image is formed based on the calculated development bias. Thus, the image does not significantly deteriorate. When the output value Vt of the toner density detection sensor 45 generated at the time of gradation sequence pattern formation is largely different from the toner density control reference value Vtref, and the toner density control reference value Vtref is corrected, the toner attraction amount is possibly deviated from the target level. Thus, it is determined if the toner density control reference value Vtref is corrected also in connection with the output value Vt of the toner density detection sensor 45.

For example, toner density is decreased from the current level by decreasing the toner density control reference value Vtref by 0.2V when the following inequalities are established simultaneously:

$$\text{Delta Gamma} \geqq 0.30((\mathrm{mg/cm^2})/\mathrm{kV}), \text{ and}$$

$$Vt - Vtref \leqq -0.2\mathrm{V}$$

Further, the toner density is increased from the current level by increasing the toner density control reference value Vtref by 0.2V when the following inequalities are established simultaneously:

$$\text{Delta Gamma} \leqq -0.30((\mathrm{mg/cm^2})/\mathrm{kV}), \text{ and}$$

$$Vt - Vtref \geqq 0.2\mathrm{V}$$

In the above, when the toner density control reference value Vtref is corrected, toner is replenished so that the toner density in the developing device gradually reaches the target level. However, the toner replenishment can be executed to reach the target level when the toner density control reference value Vtref is corrected. In such a situation, the process control is executed again when the toner density control reference value Vtref is corrected.

Now, operations of setting a development bias and a charge bias for each toner patch in a gradation sequence pattern are described. When a primary line is obtained using the minimum square method and development gamma is calculated therefrom, it is preferable that data points evenly disperse within a valid range. That is, if the data points concentrate, precision of the development gamma is hardly obtained due to an error, such as an unevenness of an amount of toner attracting to a toner patch owing to cyclic unevenness of a developing sleeve, a toner attraction amount error caused from an output error of an optical sensor due to a cut on the intermediate transfer belt, etc. Accordingly, when similar development biases are used respectively, and accordingly, a difference of a toner attraction amount among the respective toner patches decreases, the development gamma becomes erroneous. Thus, in view of precise calculation of the development gamma, an amount of toner attracting to the patches needs to disperse at the same interval within a valid toner amount detectable range for the optical sensor 69 from small to large toner attraction sides. Further, such distribution is also significantly important in view of toner attraction calculation.

In this embodiment, the only one optical sensor 69 is employed and detects infrared light, because a reflection rate thereof is not significantly different of depending on color.

Thus, the sensitivity correction coefficient η can be calculated using output data obtained when toner patches of plural colors are detected. Thus, the sensitivity correction coefficient η can also be efficiently obtained in a system employing a few numbers of toner patches.

Further, in order to precisely obtain the sensitivity correction coefficient η, it is important that a lot of normalized values x of the fair reflection light_fair reflection component calculated from the detection data (i.e., an output value) of the toner patches of respective colors detected by the optical sensor 69 meet the following inequality dispersing at the same interval:

$$0.1 \leqq x \leqq 1.0$$

Specifically, as the lot of data disperses at the same interval meeting the above-mentioned inequality, multiple degree approximation (e.g. second order curvature approximation) can be precisely executed. As a result, the sensitivity correction coefficient η can be extraordinary precise. Since the sensitivity correction coefficient η is directly linked with an toner attraction amount, precision of toner attraction amount conversion can be significantly improved when the sensitivity correction coefficient η is precisely calculated.

Specifically, it is important that toner patches of respective colors evenly disperse within a prescribed range to calculate both the development gamma and the sensitivity correction coefficient η. Then, according to this embodiment, to evenly disperse in that way, an image formation bias for a gradation sequence pattern is calculated as mentioned below.

Now, calculation of an exemplary image formation bias for a gradation sequence pattern is described more in detail in which a gradation sequence pattern is typically formed from four toner patches.

First, development biases Vb for respective colors obtained based on a result of a last process control are obtained, and the maximum development potential PotMax is calculated from the development bias Vb using the formula 11 as illustrated in FIG. 30B. In the above, the solid section post exposure voltage V1 represents a voltage of a photoconductive member after exposure relying on a performance of the photoconductive member, and is −50 v in this example. When the development bias is −550 v as a result of the last process control, the development potential PotMax is calculated as follows:

$$\text{PotMax}=|-550-(-50)|=500\text{ v}$$

The maximum development potential PotMax physically enables to obtain a prescribed solid image density. ID (Image Density) amounts to 1.4 when a toner attraction amount is 0.45 (mg/cm$^2$). In this way, by using the eleventh formula, the maximum development potential PotMax is obtained for each of the respective colors.

Then, a development bias is calculated for a toner patch in each of the respective color gradation sequence patterns based on the maximum development potential of each color. The development bias for the black color is differently calculated from that for the other colors of C to Y, because a toner attraction amount of the black color is differently detected from the other. Specifically, as mentioned above, the toner attraction amount of the black color is calculated only using the fair reflection light, whereas the remaining colors of C to Y are calculated using both of the fair reflection light and the diffusion reflection light.

Since a light emitted to black color toner is absorbed at the surface thereof, sensitivity for the diffusion reflection light cannot be obtained. Thus, the amount of toner attracting to the black color is detected only using the fair reflection light. Further, when the toner attraction amount is detected only using the fair reflection light, sensitivity deteriorates as the toner attraction amount increases. As a result, a detectable range of the toner attraction amount is narrowed in comparison with a case when both of the diffusion reflection light and the fair reflection light are used for the detection thereof. Thus, a development bias is calculated so that toner attraction amounts of the respective the toner patches in the black color gradation sequence pattern evenly disperse on the lower toner attraction amount region than 0.45 (mg/cm$^2$) for solid image density. In this embodiment, the development bias (K) is calculated so that the toner attraction amounts of the respective toner patches evenly disperse meeting the following relation:

$$0.05(\text{mg/cm}^2) \leqq (K) \leqq 0.35(\text{mg/cm}^2)$$

Specifically, the development bias in the gradation sequence pattern of the black color is calculated by substituting the maximum development potential PotMax (K) of the black color as obtained by the formula 11 to the formula 12 as illustrated in FIG. 30B, wherein. VPn represents a development bias of each toner patch and suffix "n" represents an order of the gradation sequence patterns.

Thus, respective development biases VPn for forming respective toner patches of the gradation sequence pattern of the black color can be represented as listed below:

$$VP1(K)=\text{PotMax}(K)\times(2/12)-V1(-\text{V})$$

$$VP2(K)=\text{PotMax}(K)\times(4/12)-V1(-\text{V})$$

$$VP3(K)=\text{PotMax}(K)\times(6/12)-V1(-\text{V})$$

$$VP4(K)=\text{PotMax}(K)\times(8/12)-V1(-\text{V})$$

By setting the development biases VPn to form the respective toner patches of the gradation sequence pattern of the black color, gradation sequence pattern density can disperse in a lower toner attraction amount region than the solid image density.

Now, examples of C to Y colors are described.

When a sensitivity correction coefficient η is calculated for each of the gradation sequence patterns of C to Y, toner patches of the respective colors ideally disperse evenly meeting the following relation as shown in FIG. 32;

$$0.1 \leqq x \leqq 1.0$$

Thus, the development bias is calculated so that the respective toner patches evenly disperse meeting the above-mentioned relation for the colors.

Specifically, the maximum development potentials of C to Y colors obtained by the formula 11 are compared and an order is assigned, initially. For example, the maximum development potentials among the C to Y colors are assigned PotMax (1), PotMax (2), and PotMax (3) in order of intensity. For example, when the maximum development potentials of C, M, and Y colors are larger in this order, the following results are obtained:

$$\text{PotMax}(1)=\text{PotMax}(C),\ \text{PotMax}(2)=\text{PotMax}(M),\ \text{and}\ \text{PotMax}(3)=\text{PotMax}(Y).$$

If the maximum development potentials of C, M, and Y colors are the same, the order descends from C to Y.

Then, thus ordered maximum development potentials are substituted to the formula 13, and development biases of gradation sequence patterns are calculated, wherein "n" of VPn (m) represents "n" order in the gradation sequence pattern of each color, and "m" represents orders (1, 2, 3) of biases.

Using the above-mentioned formula 13, development biases for respective toner patches of the gradation sequence pattern of each color can be represented as follows:

$$VP1(1)=PotMax(1)\times(1/12)-V1$$

$$VP1(2)=PotMax(2)\times(2/12)-V1$$

$$VP1(3)=PotMax(3)\times(3/12)-V1$$

$$VP1(1)=PotMax(1)\times(4/12)-V1$$

$$VP1(2)=PotMax(2)\times(5/12)-V1$$

$$VP1(3)=PotMax(3)\times(6/12)-V1$$

$$VP1(1)=PotMax(1)\times(7/12)-V1$$

$$VP1(2)=PotMax(2)\times(8/12)-V1$$

$$VP1(3)=PotMax(3)\times(9/12)-V1$$

$$VP1(1)=PotMax(1)\times(10/12)-V1$$

$$VP1(2)=PotMax(2)\times(11/12)-V1$$

$$VP1(3)=PotMax(3)\times(12/12)-V1$$

The toner attraction amounts as shown in FIG. 31 are obtained when the following relations are established;

$$PotMax(1)=PotMax(C),\ PotMax(2)=PotMax(M),\ \text{and}\ PotMax(3)=PotMax(Y).$$

As shown in FIG. 32, toner patches of yellow having the low maximum development potential (i.e., high development gamma) are formed on the high toner attraction amount side, whereas toner patches of cyan having the high maximum development potential (i.e., low development gamma) are formed on the low toner attraction amount side in comparison with the other colors.

Now, the reason why a development bias is set for each of the toner patches in the gradation sequence pattern based on a priority order of color, which is given by comparing the maximum development potentials calculated based on the previous development bias Vb for respective colors, is described. That is because, a lot of toner patches can be formed within the valid range and calculation thereof can be constant even when developer performance changes and the development gamma increases. Specifically, in this embodiment, toner patches of a color other than that having the lowest maximum development potential are formed with high density (i.e., a high toner attraction amount) in comparison with the other colors in the lower toner attraction amount region than the solid image density. Thus, even when the development gamma increases owing to a change of a performance of the developer, toner patches of a color other than that having the lowest maximum developing potential can enter the detectable range for the optical sensor, and decreasing of a number of the toner patches entering there can be suppressed.

In this way, by setting the development biases VPn for forming respective toner patches of the gradation sequence patterns of C to Y colors, the toner patches can evenly disperse meeting the following relation;

$$0.1\leqq x\leqq 1.0.$$

Now, a setting operation for setting each of the charge biases VPcn executed when a gradation sequence pattern of each of colors is formed is described. The setting operations for the colors K to Y are the same and calculation is executed using the formula 14.

Not to cause background stein, a background potential off set voltage is set to −200V as a charge bias in this embodiment.

As mentioned above, by calculating a development bias VPn for forming each of toner patches in a gradation sequence pattern based on a development bias Vb calculated in the last process control, each of the toner patches disperses from small to large toner attraction sides at the same interval within the detectable range for the optical sensor 69. As a result, the toner attraction amount conversion and calculation of the development gamma can be precisely executed even with a fewer toner patches. However, when the development gamma widely increases after the last process control, the toner patches entering the detectable range for the optical sensor 69 decreases, and accordingly, the toner attraction amount conversion and the calculation of the development gamma cannot be precise. Then, a contribution factor that changes development gamma this time after the last time is detected as mentioned later, a development bias VPn for forming the respective patches is fixed to a prescribed level or is appropriately corrected (to be the development bias VPn).

There are lots of contribution factors changing the development gamma, and it is difficult to predict the development gamma by detecting all of the same, because of increasing of a cost of an apparatus. Thus, a principal contribution factor, such as environment, an absence time of the apparatus, etc., which changes the development gamma widely, are only detected to predict a change. However, development gamma sometimes cannot precisely predicted only based on the principal changing contribution factors, and there sometimes exists a difference between the predicted and actual development gamma. For example, even predicting that development gamma does not change widely based on the principal contribution factors, and a gradation sequence pattern is formed based on the previously calculated development bias Vb, the development bias sometimes actually widely increases this time from the last time. In such a situation, only one point of a toner patch probably enters the detectable range for the optical sensor 69, and accordingly, the development gamma cannot be calculated.

Then, in this embodiment, in order to credibly calculate the development gamma even the development gamma increases more than a predicted level deviating from the prediction, one toner patch is formed based on a prescribed fixed development bias VPk so that toner attraction amount thereof can always enter the detectable range for the optical sensor 69 within a variable range of the development gamma. Specifically, four toner patches in a gradation sequence pattern are formed based on the development bias VPn calculated based on the maximum development potential calculated based on the previous development bias Vb while one toner patch is formed based on the prescribed fixed amount VPk. However, number of the toner patches is not limited thereto. Further, the number of toner patches of respective colors is not limited to five. Further, 520(−V) is set as the prescribed fixed development bias VPk in this embodiment, but can appropriately be determined in accordance with a configuration or the like.

FIG. 26 illustrates an exemplary toner attraction amount of a gradation sequence pattern when development gamma significantly increases in this time of the process control from that of the last process control, wherein the black square mark represents a toner patch formed base on the development bias VPn calculated based on the development bias Vb determined in the last process control, and the rhombus black mark represents a toner patch formed based on a prescribed development bias VPk. As represented by the black square mark, only one toner patch enters the detectable range for the optical sensor 69 among toner patches formed based on development biases VP1 to VP4 calculated based on the previous development bias Vb predicting that the development gamma does not largely change from the last time. As represented by the rhombus black mark, plural toner patches formed based on prescribed fixed development bias VPk enter the detectable range for the optical sensor 69 even if the development gamma widely increases from the last time.

In this way, more than two points can enter the detectable range for the optical sensor 69, so that the development gamma can be calculated.

Further, when prediction as to the development gamma results in error, and development gamma calculated this time widely increases in relation to the development gamma of the last process control, data of a toner attraction amount of a gradation sequence pattern concentrates on a low toner attraction amount side. As a result, unevenness of the toner attraction amount readily affects and possibly deteriorates precision of the development gamma calculation. Thus, a toner patch to be formed based on a fixed development bias to have a high density within a detectable range for the optical sensor 69 when the development gamma is low can be added.

Now, a method of setting a fixed development bias VPn for forming respective toner patches when the development bias possibly largely changes and that of correcting the development bias VPn based on a principal factor predicted to largely change development gamma are described in detail.

As a first example, when a factor possibly widely increasing the development gamma is detected, all of toner patches constituting a gradation sequence pattern are formed based on a prescribed fixed development bias so that a toner attraction amount of all of them always enters the detectable range for the optical sensor 69. Possible factors of widely increasing the development gamma includes the followings:

Due to poor calculation precision of a sensitivity correction coefficient η or development gamma calculated in the last process control, a calculation error is large in relation to the actual development gamma. Due to a large change of toner density in the developing device in this time of a process control from that of the last time, a charge amount of toner in the developing device largely changes from the process control executed last time.

Figure 22:
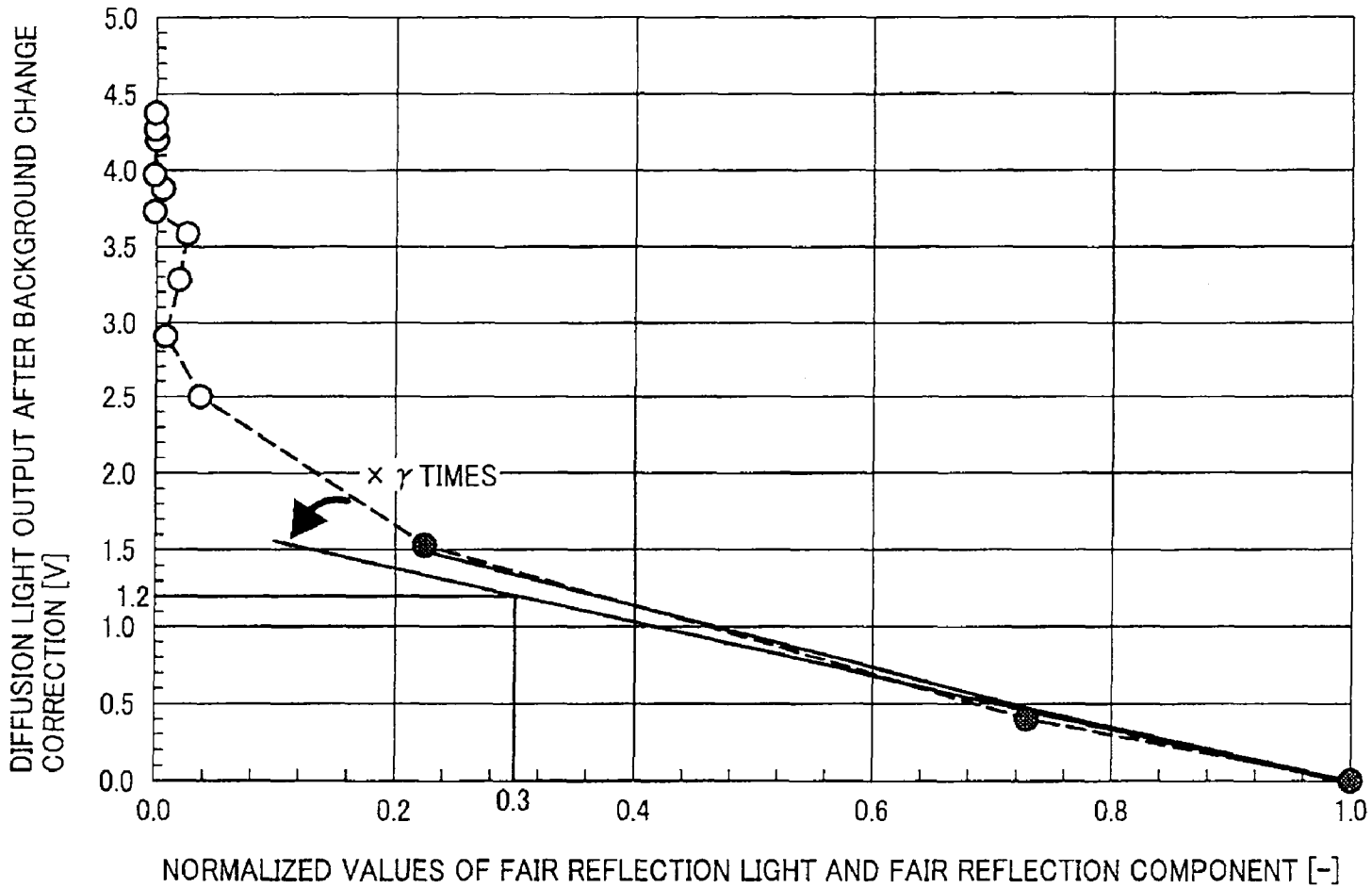
FIG. 22 illustrates an exemplary relation between a normalized value of the fair reflection component of a commercially available light shielding and an output value of diffusion light having received correction of background change.
Figure 23:
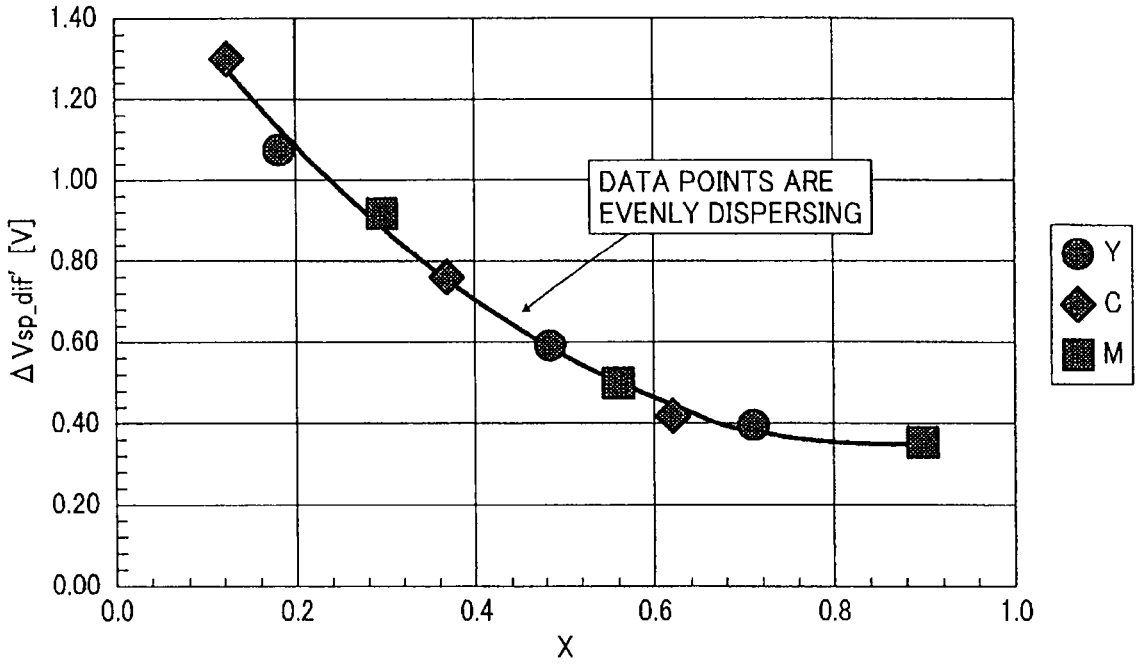
FIG. 23 illustrates an exemplary ideal data diffusion condition when the sensitivity correction coefficient η is calculated.
Figure 24:
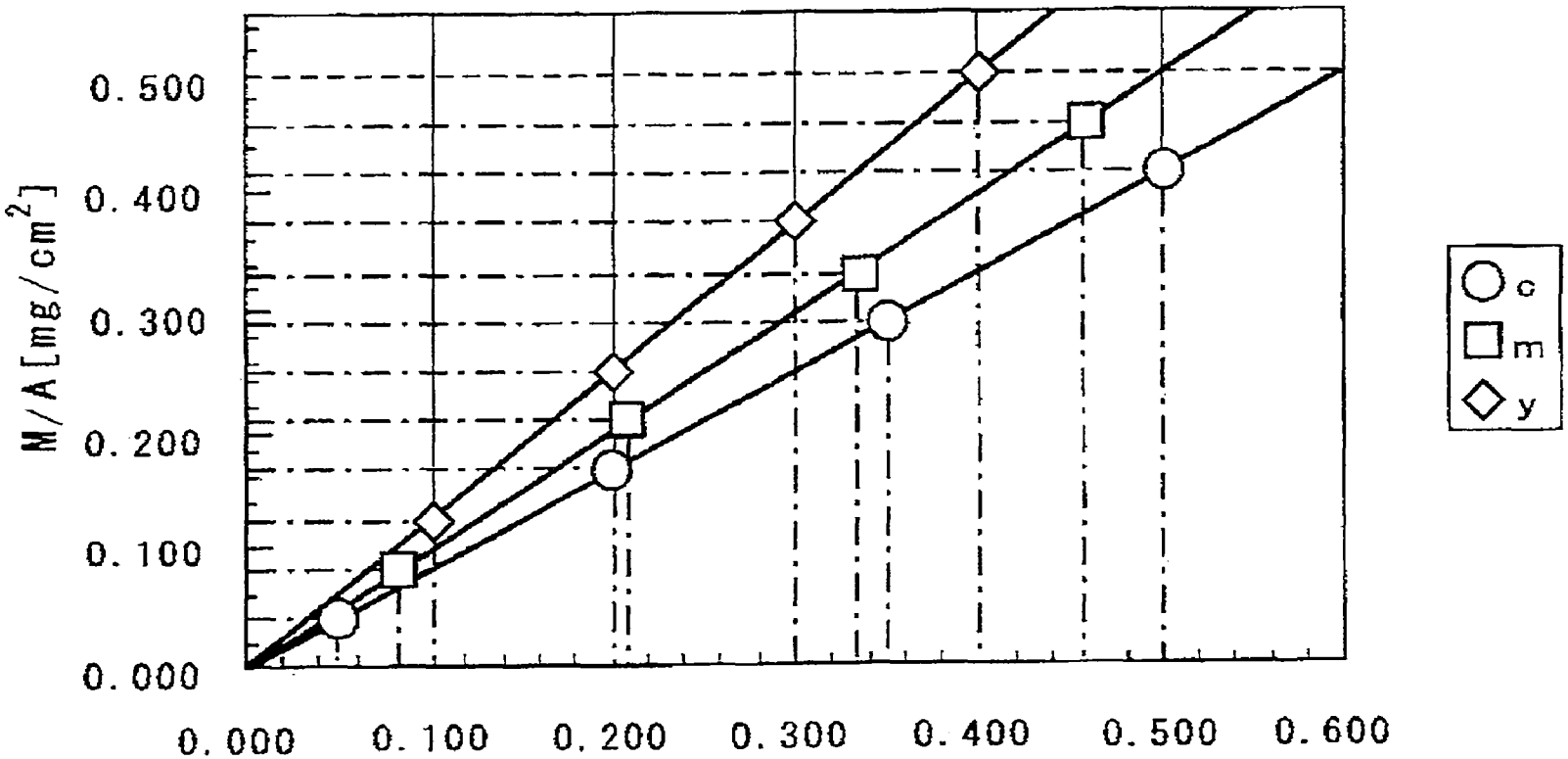
FIG. 24 illustrates a relation between a toner attraction amount and a development potential.

Specifically, the control section 100 detects conditions as listed in the tables of FIGS. 22 and 23 as a factor possibly increasing the development gamma. When at least one of the conditions listed is met, all of the toner patches constituting a gradation sequence pattern are formed based on the fixed development bias. However, all of the conditions are not necessarily detected. The conditions are not limited to the above and are appropriately determined in accordance with a configuration of the apparatus.

Now, the first condition is described in detail. FIG. 25 illustrates a graph drawn by plotting detection data of toner patches of respective colors obtained when development gamma of Cyan widely increases after execution of the last process control and a sensitivity correction coefficient η is to be calculated therefrom.

As shown, two points of the detection data of the cyan color have the normalized value (x) of the fair reflection light_fair reflection component not more than 0.1 and thus deviate from a range used for calculating the sensitivity correction coefficient η. Whereas, only one point enters the range. In such a situation, the sensitivity correction coefficient η is obtained using three points of toner patches of the magenta color, three points of toner patches of the yellow color, and one point of a toner patch of the cyan color (totally, seven toner patches). When the normalized data "x" amounts to 0.2, a diffusion light output after a background correction is adjusted to be 1.2V, the sensitivity correction coefficient η becomes "2". Whereas, when the toner patches of Y to C of FIG. 32 evenly disperses within the ideal range ($0.1 \leqq x \leqq 0.1$) used in calculating the sensitivity correction coefficient η, the sensitivity correction coefficient η is obtained using nine toner patches to be 1.81. Thus, in the situation as shown in FIG. 25, the sensitivity correction coefficient η is erroneous in relation to the ideal condition of FIG. 32.

Owing to the error, a calculation toner attraction amount calculated thereafter increases by 2/1.81 times of the ideal condition. As a result, a development gamma calculated based on the toner attraction amount is also erroneous in relation to the ideal condition. Since the sensitivity correction coefficient η is used in calculating a toner attraction amount of all of the colors Y to C, development gamma for respective colors produce errors. Since calculation precision of the sensitivity correction coefficient η is higher when toner patches of Y to C colors disperse evenly within the computable range ($0.1 \leqq x \leqq 0.1$) as shown in FIG. 32 than that as illustrated in FIG. 25, a displacement value from an actual development gamma shown in FIG. 25 becomes larger than the ideal one as shown in FIG. 32. Thus, a development gamma possibly widely changes this time from the development gamma calculated in the last process control.

More specifically, when calculation precision of the sensitivity correction coefficient η is poor in the last process control and accordingly, a development gamma calculated from an actual development gamma deviates to a lower side while the development gamma slightly increases in this time of process control, a development gamma widely increases from that calculated in the last process control this time. As a result, only one of the toner patches formed based on the development gamma VPn calculated based on the development bias Vb which is calculated in the process control of the last time sometimes enters the detectable range for the optical sensor 69.

Thus, when there exists a color of a toner patch only entering one point within the valid range used for calculating the sensitivity correction coefficient η in the last process control as in the first condition, calculation error of the development gamma becomes significant and the development gamma possibly increases more than that calculated last time. Accordingly, all of the toner patches constituting the gradation sequence pattern are formed based on the prescribed fixed development bias so as to always enter the detectable range for the optical sensor 69. When the control section 100 detects the first condition, the toner patches of Y to C colors are formed based on the prescribed fixed development bias, because the development gamma for those colors can widely change.

Now, a second condition is described in detail. When there are two points of data used in calculating the development gamma, the development gamma can be calculated. However, calculation precision of the development gamma becomes worse than when more than three points of toner patches evenly disperse within the detectable range for the optical sensor 69 used to calculate the development gamma. As a result, an error of calculated development gamma is possibly significant in relation to the actual development gamma.

Thus, as shown in the second condition, when two points of data are used in development gamma calculation in the last process control, the calculation error of the development gamma becomes significant and development gamma possibly widely increases this time in comparison with that calculated last time. Accordingly, all of toner patches are formed based on a prescribed fixed development bias so that data of a toner attraction amount of all of the toner patches constituting the gradation sequence pattern enter the detectable range for the optical sensor 69. When the control section 100 detects the second condition, only toner patches of a corresponding color are formed based on the fixed development bias.

Now, a third condition is described in detail. As mentioned earlier, when a difference of delta gamma between calculated development gamma and target development gamma is out of the range, toner density adjustment is executed by correcting the toner density control reference value Vtref so as to approximate the development gamma to the target development gamma in this embodiment. When the toner density adjustment is executed, density of toner in the developing device when the previous process is performed this time becomes different from that when the process control is executed last time. When the toner density in the developing device becomes different, a charge amount therein changes from when process control is executed last time to when performed this time. Thus, the development gamma possibly widely increases when the process control is executed this time in comparison with that calculated last time. Accordingly, all of toner patches constituting the gradation sequence pattern are formed based on a prescribed fixed development bias so that data of a toner attraction amount of all of the toner patches enter the detectable range for the optical sensor 69 when toner density adjustment is executed in the last process control, because the development gamma calculated in the last process control possibly widely increases this time. When the control section 100 detects the third condition, only a toner patch of a corresponding color are formed based on the fixed development bias. Further, based on the calculated development start voltage Vk, it can be determined if the toner density control reference value Vtref is corrected. In such a situation, when the calculated development start voltage Vk is not less than the upper limit or when the calculated development start voltage Vk is not more than the lower limit, toner density adjustment is executed to correct the toner density control reference value Vtref.

When the toner density adjustment is executed not only when the process control is executed last time, but also executed between the process controls of last time and this time, toner density in the developing device when a process control is executed this time becomes different from that when it is executed last time. Thus, only toner patches corresponding to a color are formed based on the fixed development bias when toner density adjustment is executed between this time and the last time of the process controls.

Now, a fourth condition is described in detail. As mention above, in this embodiment, since the sensitivity correction coefficient $\eta$ cannot be calculated when less than two points of toner patches are present within the range used to calculate the sensitivity correction coefficient $\eta$, it is determined that the process control results in error, and the process control is terminated without calculating the development bias Vb or the like. When there exists one point of data to be used in calculating the development gamma, the development gamma cannot be calculated, and it is determined that the process control results in error, so that the process control is terminated without calculating the development bias Vb or the like. In this way, since the development gamma is not calculated for a long time when the process control is failure, the development gamma possibly widely increases. Thus, when the last process control results in error, all of the toner patches are formed based on the prescribed fixed development bias so that data of a toner attraction amount of all of the toner patches constituting the gradation sequence pattern enter the detectable range for the optical sensor 69. When the control section 100 detects the fourth condition, toner patches are formed for all colors based on the fixed development bias.

Now, a fifth condition is described in detail. When developer in the developing device is replaced with a new, a charge amount of toner in the developing device is supposed to widely change before and after the replacement. Specifically, whenever the developing device 20 is replaced with the new, the developer in the developing device is always replaced. Accordingly, when the developing device 20 is replaced with the new, it is determined that the developer in the developing device is replaced. For example, the replacement of the developing device 20 is recognized based on a determination if a toner density initial adjustment is executed.

Specifically, a toner density sensor 45 is arranged in the developing device 20. When the developing device 20 is replaced, both of developer and the toner density sensor 45 are replaced. Since a performance of the toner density sensor 45 is different per sensor, a toner density sensor initial adjustment is executed for adjusting a voltage applied to the toner density sensor 45, so that an output of the toner density sensor 45 becomes a prescribed level when toner density is a prescribed level, when the developing device 20, and accordingly, the toner density sensor 45 are replaced. Thus, the control section 100 can detect if the developing device 20 is replaced in accordance with a determination if the toner density sensor initial adjustment is executed. Further, depending on a type of a device, a developer-replenishing mode is employed to replenish fresh developer to the developing device 20 while ejecting the deteriorated developer therefrom. Since the developer in the developing device is also always replaced when the developer-replenishing mode is executed, the control section 100 can determine that the developer is replaced when the developer-replenishing mode is executed.

Thus, when the developer in the developing device is replaced by replacing the developing device 20 during the last and currently executed process controls, it is supposed that a charge amount of the toner in the developing device largely changes after execution of the last process control. Thus, since the development gamma possibly widely increases this time from the development gamma calculated in the last process control, all of toner patches constituting the gradation sequence pattern are formed based on the prescribed fixed development bias so that data of an toner attraction amount of the all of the toner patches enter the detectable range for the optical sensor 69. When the control section 100 detects the fifth condition, only toner patches of a corresponding color are formed based on the fixed development bias.

Now, a sixth condition is described in detail. When toner stored in a toner bottle, not shown, to be replenished to the developing device 20 is used up, the toner bottle is replaced with a new. When the new toner bottle is provided, a toner end recovery process is executed to forcibly replenish the toner into the developing device 20. As a result, a toner density increases after completion of the toner end recovery process more than before. As a result, density of toner in the developing device obtained in this time of process control becomes different from that obtained in the last process control. A charge amount in the developing device thus decreases in this time of the process control from the last process control. Thus, a development gamma possibly widely changes in the process control this time from the development gamma calculated in the last process control. Thus, when the toner end recovery process is executed during the last and present process controls, it is supposed that the development gamma widely increases from the development gamma calculated in the last process control, and all of toner patches are formed based on the prescribed fixed development bias so that data of a toner attraction amount of all of the toner patches forming the gradation sequence pattern enter the detectable range for the optical sensor 69 within a variable range of the development gamma. When the control section 100 detects the sixth condition, only toner patches of a corresponding color are formed based on the fixed development bias.

Now, a seventh condition is described in detail. A toner initial replenishing mode is executed to replenish toner to a toner replenishing path arranged in a toner replenishing device and a hopper or the like so as to establish a condition capable of replenishing the toner to the developing device 20, when a new copier arrives at a user site is prepared for usage or when a toner replenishing device is replaced. Then, density of toner in the developing device increases than before after execution of the toner initial replenishing mode, because the toner is always replenished into the developing device, toner density increases in the developing device. As a result, a charge amount of toner in the developing device in this time of process control is predicted to decrease when the process control is executed this time from that of the last time. Thus, when the toner initial replenishing mode is executed, it is supposed that the charge amount of the toner in the developing device decreases after execution of the last process control, while the development gamma widely increases this time in relation to the development gamma calculated in the last process control. Accordingly, all of toner patches forming the gradation are formed based on the prescribed fixed development bias so that an toner attraction amount of the all of the toner patches pattern enter the detectable range for the optical sensor 69 within a variable range of the development gamma. When the control section 100 detects the seventh condition, only a toner patch of a corresponding color are formed based on the fixed development bias.

Exemplary fixed biases used when the first to seventh conditions are met are described as follows:

$$VP1=100(-V),\ VP2=175(-V),\ VP3=250(-V),\ VP4=325(-V),\ \text{and}\ VP5=520(-V)$$

However, such values are changed in accordance with an image formation system.

As mentioned heretofore, according to the first example, when the development gamma possibly widely increases in this process control from the development gamma calculated in the last process control, all of toner patches forming the gradation sequence pattern are formed based on the prescribed fixed development bias so that an toner attraction amount of the all of the toner patches of a corresponding color enter the detectable range for the optical sensor 69.

Thus, all of the toner patches can enter the detectable range for the optical sensor 69, even if the development gamma widely increases this time from the development gamma calculated in the last process control. As a result, calculation precision of the development gamma and the sensitivity correction coefficient $\eta$ can be maintained.

Further, when none of the above-mentioned first to seventh conditions is met, since the development gamma of this time does not possibly widely increase from that calculated last time, four toner patches are formed based on the development bias Vb calculated in the last process control among the five toner patches of the gradation sequence pattern, and a toner attraction amount disperses within the detectable range for the optical sensor 69 from small to large toner attraction sides at the same interval. Thus, the calculation precision of the development gamma and the sensitivity correction coefficient $\eta$ can be improved.

Further, even when none of the above-mentioned first to seventh conditions is met, the development gamma sometimes widely increases this time from the development gamma calculated in the last process control due to a change of environment. Accordingly, only a toner patch having the lowest density (i.e., low toner attraction amount) sometimes enters the detectable range for the optical sensor among the four toner patches formed based on the development bias VPn calculated based on the development bias Vb which is calculated based on the last process control. However, even in such a situation, at least one toner patch among the five toner patches of the gradation sequence pattern is formed based on the prescribed fixed development bias so that an toner attraction amount thereof always enters the detectable range for the optical sensor. Thus, at least two toner patches can enter the detectable range for the optical sensor 69. As a result, the development gamma can be calculated even when the none of the above-mentioned first to seventh conditions is met, and accordingly, the development gamma widely increases this time from the development gamma calculated in the last process control due to the entrance of the toner patches within the detectable range.

In the second, third, and fifth to seventh conditions, the toner patches are not formed based on the fixed development bias for all of colors, but formed only for applicable color. That is, when the cyan color meets one of the second, third, and fifth to seventh conditions, and the development gamma widely increases in this time of the process control from that calculated in the process control of the last time, the toner attraction amount can disperse evenly within the detectable range for the optical sensor by forming all of the toner patches for the cyan color based on the prescribed fixed development bias as shown in FIG. 26. However, when all of the toner patches of the yellow and magenta colors not detected as increasing the development gamma in this time of the process control from that calculated in the last process control are formed based on the fixed bias, the toner patches of these colors concentrate on the lower toner attraction side as shown in FIG. 26. As a result, only the toner attraction amount of the cyan color evenly disperse within the detectable range of the optical sensor 69, and accordingly, the sensitivity correction coefficient $\eta$ and the development gamma are not precisely detected. Further, by forming only the toner patches of the cyan color, which is predicted to widely increase the development gamma in this time of the process control from that calculated in the last process control, based on the prescribed fixed development bias, while forming the toner patches of the yellow and magenta colors, which are not predicted to widely increase the development gamma, based on the development bias calculated in the last process control, all of the toner attraction amounts of the yellow, magenta, and cyan can evenly disperse within the detectable range for the optical sensor as shown in FIG. 27.

Hence, a factor possibly widely increasing the development gamma is detected, and each of the toner patches is formed based on a fixed development bias enabling the toner attraction amount to always enter the detectable range for the optical sensor even if the development gamma widely increases. However, it is not limited thereto. For example, when a factor possibly widely changing the development gamma is detected, all of toner patches of a gradation sequence pattern can be formed based on a prescribed fixed bias based on the following conditions. Specifically, plural toner patches also formed based on the prescribed fixed bias so as to credibly enter the detectable range for the optical sensor when the development gamma is high, and plural toner patches are formed based on a prescribed fixed bias to have a large toner attraction amount within the detectable range when the development gamma is low. Even though the development gamma changes at a low level, the toner attraction amount of the toner patches of the gradation sequence pattern evenly disperse from small to large toner attraction side within the detectable range for the optical sensor. As a result, the development gamma and the sensitivity correction coefficient η can be precisely calculated.

Further, when the development gamma does not largely change in an apparatus and a factor causing the development gamma to widely change is detected, the fixed development bias for forming the respective toner patches can be determined based on a medium value of the variant of the development gamma. Thus, when the development gamma largely increases, the all of the toner patches of the gradation sequence pattern are formed based on the fixed development bias, so that the plural toner patches on the low toner attraction amount side enter the detectable range for the optical sensor, and accordingly, the development gamma can be calculated. Whereas, when the development gamma largely decreases, the toner attraction amount of the toner patches disperses at the same interval from small to large toner attraction amount sides within the detectable range for the optical sensor. Thus, the calculation precision of the development gamma can be maintained.

Now, a second embodiment is described. In this embodiment, when a main factor predicted to widely changing the development gamma is detected, a development bias VPn calculated based on the development bias Vb calculated in the last process control is corrected in accordance with the main factor.

Such development biases VPn can be exemplified in the fifteenth formula.

The control section 100 detects conditions predicted to cause the development gamma to largely change as listed on table 2 in FIG. 32. Specifically, the below-described conditions are factors, which change a toner charge amount in the developing device.

Initially, an eighth condition is specifically described. For example, when a lot of images having a small image area are outputted before executing the last process control, a toner charge amount increases in the developing device, because toner in the developing device is rarely replaced. As a result, the development gamma decreases when the last process control is executed. When a lot of images having a high image area are outputted before executing the last process control, toner without sufficient charge increases in the developing device, because toner in the developing device is frequently replaced. Thus, the development gamma increases when process control is executed this time. As a result, the development gamma is predicted to widely increase in this time of the process control from the development gamma calculated in the last process control. In contrast, a lot of images having the large image area are outputted before the last process control is executed, and a lot of images having the small image area are outputted before this time of the process control, the development gamma is predicted to widely decreases.

Then, when an average of area rates of output images before execution of this time of the process control is widely different from that of the output images before execution of the last process control, the development bias VPn calculated based on the development bias Vb calculated in the last process control is corrected.

Specifically, when the average of the image area rates (or a movement average of the image area rates) of the output images increases in a prescribed time period prior to the execution of this time of the process control from that obtained in a prescribed time period prior to the execution of the last process control, it can be predicted that a developing ability increases (i.e., development gamma increases). Then, a development bias calculated by using the thirteenth formula is corrected to shift to a lower side. In contrast, when the average of the image area rates of the output images calculated in a prescribed time period prior to the execution of this time of the process control decreases from that obtained in a prescribed time period prior to the execution of the last process control, the development gamma calculated using the thirteen formula is corrected to shift to a high level side, because the developing ability can be predicted to deteriorate (i.e., the development gamma decrease). For this purpose, a look up table (LUT) is stored in a non-volatile memory provide in the apparatus as shown in FIG. 28. When the process control is executed, a difference "z" is obtained by subtracting the average of the image area rates of the outputted images calculated in the prescribed time period prior to this time of process control from that of the previous one. A correction value for correcting the development bias may be obtained in accordance with the difference "z" from the LUT. The image area rate of the output image can be obtained per color and a development bias for forming toner patches of an applicable color can be corrected. In general, based on assumption that respective color toners are equally consumed, the development biases for toner patches can be corrected for all colors.

Now, a ninth condition is described in detail. When the environment of temperature and humidity changes to be higher in this process control from that when the last process control is executed, toner becomes hardly charged and a charge amount of the toner decreases to be less than when the last process control is executed. This is because, the humidity increases in the developing device and a lot of moisture is present around toner, so that electrode of the toner becomes easily disposed owing to moisture. As a result, when the environment of this time of the process control becomes high temperature and humidity in relation to that of last process control, it is predicted that the development gamma of this time widely increases from that in the last process control. Whereas when the environment of temperature and humidity in this time of the process control decreases from that of last process control, it is predicted that the toner is readily charged in the developing device, and accordingly, a toner charge amount increases more than when the last process control is executed. That is, humidity decrease in the developing device and the developing device includes a small amount of moisture, and accordingly, the electrode of the toner is hardly disposed. As a result, when the environment of temperature and humidity decreases in this time of the process control less than when the last process control is executed, it is predicted that the development gamma widely decreases less than when calculated last time.

Thus, when the environ of the process control executed this time largely changes than that of the last process control, the development bias VPn for forming toner patches calculated based on the development bias Vb calculated in the last process control is corrected.

Specifically, when humidity increases by more than 10 ($g/cm^2$) from the last process control in this time of process control, it is predicted that a developing ability increases (i.e., development gamma increases). Thus, the development bias calculated using the thirteenth formula is corrected to shift to the lower side. Whereas when humidity decreases by 10 ($g/cm^2$) or more less than that in the last process control this time, it is predicted that a developing ability decreases (i.e., development gamma decreases). Thus, the development bias calculated using the thirteenth formula is corrected to shift to the higher side. Further, the correction is executed based on the humidity, but can be corrected based on the temperature. For example, when an amount of the change of the temperature is not less than 10 (deg), it can be predicted that the humidity increases to be high. Then, the development bias calculated by using the thirteenth formula is corrected to shift to the lower side. Whereas when the amount of the change of the temperature is not more than −10 (deg), it can be predicted that the humidity decreases. Then, the development bias is corrected to shift to the higher side using the thirteenth formula. Since the environment affects all of colors, the development biases VPn are corrected for toner patches of all colors.

Now, a tenth condition is described in detail. Since a charge amount of toner in the developing device is insufficient when the apparatus is left unused for a long time before the process control is executed this time, the development gamma is predicted to be high in relation to the development gamma calculated in the last process control. Then, development bias VPn for forming toner patches calculated based on the development bias Vb calculated in the last process control is corrected. Specifically, since a developing ability is predicted to increase (i.e., a development gamma increases) when the left over time exceeds a hundred hours, development bias calculated by using the thirteenth formula is corrected to shift to the lower side. Since the left overtime affects all of the colors, the development biases VPn for toner patches are corrected for all colors.

In the second embodiment, the above-mentioned eighth to tenth conditions are detected when the development gamma is predicted to increase, the development bias VPn calculated based on the development bias Vb calculated in the last process control is corrected to be lower.

Thus, even though the development gamma of the process control executed this time widely increases from that calculated in the last process control, data of a toner attraction amount of the toner patches formed based on the development bias VPn calculated based on the development bias Vb calculated in the last process control can evenly disperse within the detectable range for the optical sensor. Thus, since a number of data used in calculating the development gamma and the sensitivity correction coefficient η does not decrease, the development gamma and the sensitivity correction coefficient η can be precisely calculated. When the above-mentioned eighth to tenth conditions are detected, and as a result, the development gamma is predicted to decrease, the development bias VPn calculated based on the development bias Vb calculated in the last process control is corrected to be higher. Thus, even though the development gamma widely decreases in the process control executed this time from that calculated in the last process control, data of a toner attraction amount of toner patches formed based on the development bias VPn calculated based on the development bias Vb calculated in the last process control among those of toner patches of the gradation sequence pattern can evenly disperse within the detectable range for the optical sensor. Thus, since data used in calculating the development gamma and the sensitivity correction coefficient η does not concentrate on the low toner attraction side, the development gamma and the sensitivity correction coefficient η can precisely be calculated.

As mentioned earlier, when the development gamma is predicted to widely increase, the development bias for forming all of the toner patches constituting the gradation sequence pattern is set to be a fixed value in the first embodiment. Thus, the development gamma can be calculated even if the development gamma widely increases. However, when the development gamma widely decreases, data of a toner attraction amount of the toner patches concentrate on the low toner attraction amount side. As a result, calculation precision is possibly not obtained sufficiently. Whereas in the second embodiment, since the development gamma is predicted whether to decrease or increase, and the development bias for forming toner patches is corrected to be higher, when the development gamma is predicted to widely decrease, the development gamma and the sensitivity correction coefficient η can be more highly precisely calculated than in the first embodiment widely decrease. Because, data of a toner attraction amount of the toner patch do not concentrate on the low toner attraction amount side.

Further, regardless when the above mentioned eighth to tenth conditions are detected and even none of the development gamma is predicted to change, the development gamma sometimes practically widely increases this time from the development gamma calculated previously by a factor not known. In such a situation, only a toner patch having the lowest density enters the detectable range for the optical sensor among the four toner patches formed based on the development bias VPn calculated based on the development bias Vb which is calculated based on the last process control. However, even in such a situation, at least one toner patch among the five in a gradation sequence pattern is formed based on the prescribed fixed development bias so that a toner attraction amount of the at least one toner patch always enters the detectable range for the optical sensor. Thus, data of at least two toner patches can enter the detectable range for the optical sensor 69. Hence, the development gamma can be calculated even when the above-mentioned eighth to tenth conditions are detected and the development gamma is not predicted to widely change but practically widely changes this time from the development gamma calculated last time.

An image forming apparatus of the above-mentioned first embodiment comprises a photoconductive member serving as a latent image carrier; a charge device that charges the latent image carrier with a prescribed potential; and an optical writing unit serving as a latent image forming device that forms a latent image on the surface of the photoconductive member charged with the prescribed potential. Also comprised are a developing device that applies a development biases to a developer carrier carrying developer at least including toner and transfers the toner on the developer carrier onto the latent image on the photoconductive member and develops the latent image; a transfer device that transfers the toner image from the latent image carrier to an intermediate transfer belt serving as a transfer member; and an optical detection device that detects a light reflected from the toner image formed on one of the latent image carrier and the transfer member. Further comprised is a control device that forms gradation sequence patterns each having plural toner patches formed based on different conditions so as to attract a different amount of toner with each other. The control device calculates index values representing a development ability of the development gamma and development start voltage based on detection values detected by the optical detection device from the plural toner patches and adjusts an image formation condition based on the calculated index values. Further in the image forming apparatus of the first embodiment, the control device functions as a detection device that detects a contributing factor causing development gamma calculated this time to change from that calculated last time. Specifically, the control device forms toner patches based on a prescribed fixed development bias VPk so that data of a toner attraction amount of the toner patches can partially enter a prescribed detectable range for the optical sensor, even when the contribution factor is not detect and a developing ability is different in this time of the process control from that in the last process control corresponding to the calculated development gamma. The control device forms remaining toner patches based on a development bias Vb established based on the development bias Vb adjusted in the last process control. When detecting the contribution factor, the detection device forms the entire toner patches are formed based on the prescribed fixed developing bias. With such a configuration, when the above-mentioned factor is detected and even the development gamma varies this time from the development gamma calculated in the last process control, the data of a toner attraction amount of toner patches can disperse within the detectable range for the optical sensor. Thus, the development gamma or the like can precisely be obtained, and the development bias is precisely adjusted. Further, when the above-mentioned factor is not detected and the development gamma does not varies, the toner patches formed based on the development bias Vb calculated based on the development bias Vb calculated in the last process control disperses evenly within the detectable range for the optical sensor. Thus, performance information, such as development gamma, etc., can precisely be obtained and the development bias is precisely adjusted using even a small number of toner patches. Further, when the development gamma widely increases due to a factor other than that detected by the apparatus, at least two toner patches formed based on a prescribed development bias can enter the detectable range for the optical sensor within a variable range of the development gamma. As a result, even when the development gamma widely increases due to the other factor and only one piece of data of the toner patch enters the detectable range for the optical sensor in the low density section among the plural toner patches formed based on the development bias calculated based on the development bias Vb calculated in the last process control, at least two pieces of data of a toner attraction amount of the patches can enter the detectable range for the optical sensor. Thus, development gamma and the like can be obtained and the development bias can be adjusted. Thus, the development bias can be adjusted only by forming a gradation sequence pattern once. As a result, the gradation sequence pattern does not need to be formed twice and control of the image density is quickly controlled suppressing a downtime of the apparatus. Further, consumption of toner can be suppressed.

Further, when an error is included in development gamma or sensitivity correction coefficient $\eta$ calculated in the last process control, development gamma possibly widely increases this time from the development gamma calculated last time. However, by detecting such inclusion of the error as a factor widely changing the development gamma this time, data of the toner patches can disperse within the detectable range for the optical sensor even when the significant error of the last calculation causes wide increase of the development gamma this time. Accordingly, the development gamma and the like can precisely be obtained and the development bias is precisely adjusted.

Further, when a charge amount of toner in the developing device widely changes from that during the last process control, the development gamma calculated this time possibly widely changes from the development gamma previously calculated. Thus, the control section detects such a probability of wide change of a charge amount of the toner in the developer as a factor causing the development gamma to widely change this time from that calculated in the last process control. As a result, data of the toner patches can disperse within the detectable range for the optical sensor even if the development gamma calculated this time widely changes from that calculated in the last process control due to the wide changes of the toner charge amount therefrom. Thus, the development gamma and the like can precisely be obtained, and the development bias is precisely adjusted.

Further, since a performance of developer in the developing device absolutely changes when the developer is replaced, a charge amount of toner in the developing device possibly widely changes from that in the last process control. Accordingly, the control section detects and recognizes that the toner charge amount of the developer widely varies in this adjusting operation for adjusting an image formation condition from that executed last time when the developer is replaced between when the last process control is executed and when the process control is executed this time. Thus, it can precisely be recognized if the toner charge mount of the developer in the developing device widely varies in this image formation condition adjustment from that previously executed.

Further, when toner density adjustment is executed, density of toner in the developing device obtained this time of the process control is different from that obtained in the last process control. As a result, a toner charge amount in the developing device becomes different. Thus, the control section detects and recognizes that the toner charge amount of the developer in the developing device widely changes, either when toner density adjustment is executed in the last process control or when executed between the times when the privies and current process controls are executed. Thus, it can precisely be recognized if the toner charge mount of the developer in the developing device widely varies in this image formation condition adjustment operation from that previously executed.

Further, when a toner bottle is replaced and a toner end recovery operation executed, toner is forcibly replenished to the developing device. As a result, toner density increases in the developing device and a toner charge amount decreases. Accordingly, the toner charge amount of the developer in the developing device widely changes decreases when the process control is currently executed from that executed in the last process control.

The control section then detects and recognizes that the toner charge amount of the developer in the developing device widely changes when the toner end recovery operation is executed between the previous and current adjustments of an image formation condition.

As a result, it can precisely be recognized if the toner charge mount of the developer in the developing device widely varies in this image formation condition adjustment operation from that in the previous one.

Further, when a toner initial replenishing mode is executed, toner is also forcibly replenished to the developing device similar to the toner end recovery mode. Thus, when the toner initial replenishing mode is executed, the control section detects and recognizes that the toner charge amount of the developer in the developing device widely changes in this image formation condition adjustment from that in the previous image formation condition adjustment. As a result, it can precisely be recognized if the toner charge amount of the developer in the developing device widely varies in this image formation condition adjustment operation from that in the previous one.

Further, all of toner patches constituting a gradation sequence pattern of a color, as to only which a factor probably causing development gamma to increase is detected, are formed using a prescribed fixed development bias, so that all of the toner patches always enter the detectable range for the optical sensor. Whereas, when a color as to which a factor probably causing development gamma to increase is not detected and all of toner patches forming a gradation sequence pattern of the color are controlled to be formed based on a prescribed fixed development bias so that all of the toner patches can enter the detectable range for the optical sensor, data of the toner patches highly probably concentrate on the low toner attraction amount side. As a result, calculation precision for the color, as to which the factor is not detected, deteriorates. However, since only toner patches constituting a gradation sequence pattern of a color, as to which a factor probably causing the development gamma to increase is detected, are formed based on a prescribed fixed development bias, calculation precision for the color does not deteriorate in the first embodiment.

Further, in the image forming apparatus of the second embodiment, the development bias VPn calculated based on the development bias Vb calculated in the last process control for forming the toner patches is corrected so that a toner attraction amount of the plural toner patches formed based on the development bias VPn decreases, when the control section as a predication device predicts that the development gamma increases. Thus, even when the development gamma widely increases as predicted, the toner patches can disperse within the detectable range for the optical sensor. Thus, performance information, such as a development gamma, etc., can precisely be obtained and the development bias is precisely adjusted. Further, the development bias VPn calculated based on the development bias Vb calculated in the last process control for forming the toner patches is corrected so that an toner attraction amount of the plural toner patches formed based on the development bias VPn increases, when the control section predicts that the development gamma decreases. Thus, even when the development gamma widely decreases as predicted, the toner patches can disperse within the detectable range for the optical sensor. Thus, performance information, such as a development gamma, etc., can precisely be obtained and the development bias is precisely adjusted. Whereas when it is predicted that the development gamma does not change, but practically widely increases owning to the other factor than the device detects, at least two toner patches formed based on a prescribed development bias enabling at least two toner patches to credibly enter the detectable range for the optical sensor enters within the detectable range within the variable range of the development gamma. As a result, even if the prediction results in error, the development gamma widely increases, and accordingly, only one toner patch enters the detectable range for the optical sensor among the toner patches formed based on the development bias VPn calculated based on the development bias Vb which is calculated in the last process control, the development gamma can be calculated and the development bias can be adjusted only by forming a gradation sequence pattern once. As a result, image density control can be quickly executed while suppressing a downtime of the apparatus. Further, consumption of toner used in image density control can be reduced.

Further, the control section detects a difference between image information generated in a time period prior to the last process control and that generated in a time period prior to the current process control as a factor that changes a toner charge amount of the developer in the developing device, and then predicts a change of development gamma based on the difference. When a lot of images having a low image area have been outputted and the process control is executed thereafter, the development gamma decreases. Because, toner is rarely replaced and a charge amount of toner increases in the developing device. Whereas, when a lot of images having a high image area have been outputted and the process control is executed thereafter, the development gamma increases. Because, toner in the developing device is frequently replaced and insufficiently charged toner increases therein. Thus, by detecting the a difference between image information generated within a prescribed time period prior to the last process control and that generated within a prescribed time period prior to the current process control as a factor which changes a toner charge amount of the developer in the developing device by the control section, the change of the development gamma can be precisely predicted.

Further, by using the image area rate of an output image as image information, it can readily be recognized if a lot of images of a low image area or a lot of a high image area is outputted.

Further, the control section can predict a change of development gamma based on a difference between environment of the last process control and that of the current process control. When the environment becomes more humid in the current process control than that in the last process control, a toner charge amount is predicted to decrease and the development gamma widely increased to be high in the developing device. Whereas when the environment becomes less humid in the current process control than that in the last process control, a toner charge amount is predicted to increase and the development gamma widely decreases in the developing device. Thus, by detecting a difference between the environments of the previous and current process controls as a factor that changes a toner charge amount of the developer in the developing device, the change of the development gamma can precisely be predicted.

Further, the change of the development gamma can be predicted by detecting an unused time period of the apparatus as a factor which changes a toner charge amount of the developer in the developing device. Specifically, in proportion to a downtime period, a charge amount is predicted to decrease and development gamma widely increases in the developing device. Thus, by detecting the unused time periods as a factor, which changes a toner charge amount of the developer in the developing device, the change of the development gamma can precisely be predicted.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising a latent image carrier;

a charge device configured to charge the latent image carrier with a prescribed potential;

a latent image forming device configured to form a latent image on the surface of the latent image carrier;

a developing device having a developer-carrying member configured to carry developer at least including toner, said developing device applying a development bias to the developer carrying member and transferring the toner on the developer-carrying member to the latent image on the latent image carrier and developing the latent image;

a transfer device configured to transfer a toner image from the latent image-carrying member to a transfer member;

an optical detection device configured to detect a light reflected from the toner image on one of the latent image carrier and the transfer member;

a control device configured to periodically form a gradation sequence pattern having at least two toner patches formed based on a different image formation condition attracting a different amount of toner with each other, said control device adjusting the image formation condition using a detection value detected by the optical detection device;

wherein, said control device controls image formation such that at least one toner patch of the at least two toner patches included in the gradation sequence pattern is formed based on a prescribed fixed image formation condition so that a toner attraction amount attracting to the at least one toner patch enters a prescribed range detectable for the optical detection device within a variable range of development gamma defined by a relation between a toner attraction amount and a development potential, while forming the rest of the at least one toner patch based on a previously adjusted prescribed image formation condition so that data of a toner attraction amount attracting to the rest of the at least one toner patch enter the prescribed range dispersing substantially at the same interval.

2. The image forming apparatus as claimed in claim 1, wherein said prescribed fixed image formation condition is determined in accordance with a change of one of environment and deterioration of age of the developer.

3. The image forming apparatus as claimed in claim 2, wherein said control device changes the image formation condition such that the toner attraction amount decreases when environment changes from normal temperature and humidity to higher temperature and humidity.

4. The image forming apparatus as claimed in claim 2, wherein said control device changes the image formation condition such that the toner attraction amount increases when environment changes from normal temperature and humidity to lower temperature and humidity.

5. The image forming apparatus as claimed in claim 2, wherein said previously adjusted prescribed image formation condition includes a development bias.

6. The image forming apparatus, as claimed in claim 1, further a prediction device configured to predict a change of the developing ability designated in the last adjustment based on a prescribed contribution factor changing a toner charge amount of the developer in the developing device;

wherein said control device periodically forms a gradation sequence pattern having at least two toner patches formed based on a different image formation condition attracting a different amount of toner from each other, said control device calculating a developing ability of the developing device based on a detection value detected by the optical detection device from the at least two toner patches, said control device adjusting the image formation condition based on the calculated developing ability; and wherein said control device forms the gradation sequence pattern such that a part of the at least two toner patches are formed based on a prescribed fixed image formation condition so that an amount of toner attracting to the part of the at least two toner patches enters a prescribed range detectable for the optical detection device when the developing ability becomes different from that in the last adjustment while forming the rest of the part of the at least two toner patches based on a prescribed formation condition in accordance with the image formation condition designated in the last adjustment; and wherein said control device corrects the image formation condition to decrease the amount of toner attracting to the remaining patches when the prediction device predicts that the developing ability widely increases, and said control device correcting the image formation condition to increase the amount of toner attracting to the remaining patches when the prediction device predicts that the developing ability widely decreases.

7. The image forming apparatus as claimed in claim 6, wherein said prediction device predicts the change of the developing ability by detecting a difference between image information generated in a prescribed time period prior to this time of image formation condition adjustment and that generated in a prescribed time period prior to the last time of image formation condition adjustment.

8. The image forming apparatus as claimed in claim 6, wherein image information includes an image area rate of an output image.

9. The image forming apparatus as claimed in claim 6, wherein said prediction device predicts the change of the developing ability by detecting a difference between respective environments for the image formation condition adjustments of the last time and this time.

10. The image forming apparatus as claimed in claim 6, wherein said prediction device predicts the change of the developing ability by detecting an absent time of the image forming apparatus.

11. An image forming apparatus, comprising a latent image carrier;

a charge device configured to charge the latent image carrier with a prescribed potential;

a latent image forming device configured to form a latent image on the surface of the latent image carrier;

a developing device having a developer carrying member configured to carry developer at least including toner, said developing device applying a development bias to the developer carrying member and transferring the toner on the developer carrying member to the latent image on the latent image carrier and developing the latent image;

a transfer device configured to transfer a toner image from the latent image carrying member to a transfer member;

an optical detection device configured to detect a light reflected from the toner image on one of the latent image carrier and the transfer member;

a control device configured to periodically form a gradation sequence pattern having at least two toner patches formed based on a different image formation condition attracting a different amount of toner from each other, said control device calculating a developing ability of the developing device based on a detection value detected by the optical detection device from the at least two toner patches, said control device adjusting the image formation condition based on the calculated developing ability; and a factor detection device configured to detect a contributing factor causing the developing ability to largely change after the last adjustment of the image formation condition;

wherein said control device controls image formation such that when the factor detection device does not detect the contribution factor, the at least two toner patches are partially formed based on a prescribed fixed image formation condition so that a toner attraction amount attracting to the part of the at least two toner patches enters a prescribed range detectable for the optical detection device, while forming the remaining toner patches of the at least two toner patches based on a prescribed image formation condition determined in accordance with the image formation condition previously adjusted; and wherein when the detection device detects the contribution factor, the entire toner patches are formed based on the prescribed fixed condition.

12. The image forming apparatus as claimed in claim 11, wherein said factor detection device detects a large error included in the developing ability calculated in the last adjustment of the image formation condition.

13. The image forming apparatus as claimed in claim 11, wherein said factor detection device detects a wide change of a charge amount of the toner included in the developer stored in the developing device after the last adjustment of the image formation condition.

14. The image forming apparatus as claimed in claim 13, wherein the factor detection device detects the wide change of a charge amount of toner by detecting replacement of the developer stored in the developing device.

15. The image forming apparatus as claimed in claim 13, wherein the factor detection device detects the wide change of a charge amount of toner by detecting execution of a toner density adjustment operation for adjusting density of the toner executed either on or after the last image formation condition adjustment.

16. The image forming apparatus as claimed in claim 13, wherein the factor detection device detects the wide change of a charge amount of toner by detecting replacement of a toner bottle containing toner to be replenished to the developing device.

17. The image forming apparatus as claimed in claim 13, wherein the detection device detects the wide change of a charge amount of toner by detecting execution of a toner initial replenishing mode (said mode providing preparation for development with fresh toner).

18. The image forming apparatus as claimed in claim 11, wherein said image forming apparatus forms different color toner images from each other, and wherein said control device forms all of toner patches constituting a gradation sequence pattern of prescribed color in the fixed image formation condition when said contribution factor is detected as to the prescribed color.

19. A method for controlling density of an image, comprising the steps of:

periodically forming a gradation sequence pattern including at least two toner patches using a different image formation condition attracting a different amount of toner with each other;

detecting the at least two toner patches with an optical detection device;

adjusting an image formation condition based on a detection value detected in the step of detecting the at least two toner patches; and forming at least one toner patch based on a prescribed fixed image formation condition so that an attraction amount of toner attracting to the at least one toner patch can enter a prescribed detectable range for a sensor within a variable range of development gamma defined by a relation between a toner attraction amount and a development potential, while forming the rest of the at least one toner patch in accordance with the image formation condition adjusted last time so that data of a toner attraction amount attracting to the rest of the at least one toner patch enter the prescribed range dispersing substantially at the same interval.

* * * * *